US005517854A

United States Patent [19]

Plumb et al.

[11] Patent Number: 5,517,854

[45] **Date of Patent: *May 21, 1996**

[54] METHODS AND APPARATUS FOR BOREHOLE MEASUREMENT OF FORMATION STRESS

[75] Inventors: Richard A. Plumb, North Tarrytown, N.Y.; Yogesh S. Dave, Stamford, Conn.

[73] Assignee: Schlumberger Technology Corporation, New York, N.Y.

[ * ] Notice: The term of this patent shall not extend beyond the expiration date of Pat. No. 5,353,637.

[21] Appl. No.: 236,356

[22] Filed: Apr. 29, 1994

Related U.S. Application Data

[63] Continuation of Ser. No. 896,116, Jun. 9, 1992, Pat. No. 5,353,637.

[51] Int. Cl.[6] ..... E21B 49/00; E21B 49/10

[52] U.S. Cl. ..... 73/151; 73/155; 73/784

[58] Field of Search ..... 73/151, 155, 784; 166/250, 101, 308, 264, 271

[56] References Cited

U.S. PATENT DOCUMENTS

| | | | |
|---|---|---|---|
| 4,266,827 | 5/1981 | Cheney | 299/20 |
| 4,733,567 | 3/1988 | Serata | 73/784 |
| 4,760,741 | 8/1988 | Koopmans et al. | 73/784 |
| 4,860,581 | 8/1989 | Zimmerman et al. | 73/155 |
| 4,899,320 | 2/1990 | Hearn et al. | 73/151 X |
| 5,165,276 | 11/1992 | Thiercelin | 73/155 |
| 5,295,393 | 3/1994 | Thiercelin | 73/155 |
| 5,353,637 | 10/1994 | Plumb et al. | 73/151 |

OTHER PUBLICATIONS

Evans et al., "Appalachian Stress Study, 1. A Detailed Description of In Situ Variations in Devonian Shales of the Appalachian Plateau", Journal of Geophysical Research, vol. 94, No. B6, pp. 7129–7154, Jun. 1989.

*Primary Examiner*—Michael J. Brock
*Attorney, Agent, or Firm*—Bruce D. Riter; Martin D. Hyden; Leonard W. Pojunas

[57] ABSTRACT

A modular sonde may be configured in various ways for measurements in open or cased boreholes. The sonde is conveyed on an electric wireline with or without a coiled tubing for conveying hydraulic energy from the surface. Modules common to the configurations include telemetry electronics, orientation, hydraulic energy accumulator, fluid chambers, hydraulic power, pumpout, and flow control. Each configuration has a stress/rheology module suited to the borehole situation. An open-hole sonde configuration has a stress/rheology module with an instrumented, inflatable packer module, an orienting module, and a probe module. A second open-hole sonde configuration has a stress/rheology module with an instrumented straddle-packer assembly. A cased-hole sonde configuration has a gunblock assembly, a gunblock orienting module hydraulics for formation pretest and hydraulics for stressing the formation to obtain data related to formation stress characteristics. A second cased-hole sonde configuration has a straddle-packer assembly, a casing perforation device in the straddle interval, and hydraulics for stressing the formation to obtain data related to formation stress characteristics.

11 Claims, 29 Drawing Sheets

INTERVAL PRESSURE
Pb
Pro
BOREHOLE P
PORE PRESSURE
CLOSURE
$t_0$ $t_1$ $t_2$ $t_3$ $t_4$ $t_5$ $t_6$ $t_7$ $t_8$ $t_9$ $t_{10}$
TIME

+1
0
-1
TIME

AE
TIME

VOLUME
0
V=MAX FRACTURE DIAMETER
INITIAL FRACTURE VOLUME
$t_1$ $t_2$ $t_3$ $t_4$ $t_5$
TIME

METHODS AND APPARATUS FOR BOREHOLE MEASUREMENT OF FORMATION STRESS

This application is a continuation of application number 07/896,116, filed Jun. 9, 1992, now U.S. Pat. No. 5,353,637.

BACKGROUND OF THE INVENTION

1. Field of the Invention

The present invention relates to methods and apparatus for measurement of insitu stress in an underground formation traversed by a borehole.

2. Background Information

The need for a tool which could measure the in-situ state of stress in deep wells has increased in recent years. Knowledge of earth stress is required for the planning of stimulation treatments, the prediction of wellbore stability and sand production. Environmental issues, such as the prediction of the long term stability of waste disposal sites, have created new applications for stress measurements at great depth.

Reservoir rocks are commonly sandstones bounded above and below by shale. The difference between the least principal horizontal stress (Sh) in the sandstone and Sh in the shale is dependent on the present tectonic maturity of the basin, the pore pressure, and the mechanical properties of the sandstone and shale. Stress measurements made at closely-spaced intervals in the same borehole indicate that stress magnitudes in sedimentary rocks can vary from bed to bed. Bed-to-bed variation in Sh favors propagation of natural joints in the low stressed beds and acts to prevent joints initiated in the lower stress beds from propagating into beds of higher stress. This phenomenon is exploited by petroleum engineers to contain hydraulic fractures within beds of low stress. A precise knowledge of differences in stress magnitude allows engineers to predict the type of fracture treatment that will assure containment in the reservoir beds. However, precise stress magnitude data are rarely obtained in shales. Instead it is commonly assumed that the least principal horizontal total stress in shales is greater than in adjacent reservoir rocks.

Various techniques have been proposed to measure in-situ stress. Perhaps the most reliable to date for measuring stresses at great depth is the micro-hydraulic fracturing technique. This technique uses the pressure response obtained during the initiation, the propagation and the closure of a hydraulic fracture to determine the state of stress.

In this technique, an interval is isolated using a packer arrangement. A fluid is injected in the interval at a constant flow rate until the wellbore is pressurized sufficiently to initiate a tensile fracture. The fracture initiates and propagates in a direction normal to the minimum stress. Fracture initiation is often recognized by a breakdown on a pressure vs. time record at a pressure termed the "breakdown" pressure, though fracture initiation may occur before the pressure breakdown.

Injection continues after the initial breakdown until the pressure stabilizes. Injection is then stopped and the pressure allowed to decay. The fracturing fluid is often a low viscosity fluid, such as mud or water. A quantity of fluid dependent upon the formation interval size (e.g., usually less than 400 liters) is injected into the formation at flow rates ranging from 1 liter/minute to 100 liters/minute. Several injection/fall-off cycles are usually performed until repeatable results are obtained. A down-hole shut-off tool is sometimes used to shut in the well and minimize any wellbore storage effect.

Careful monitoring of the shut-in behavior is required to determine the minimum stress.

The instantaneous shut-in pressure has often been assumed to approximate the minimum stress, though errors of the order of several MPa may result. In permeable formations, where the fracturing fluid leaks off from the fracture face, the minimum stress is better measured by the point at which the pressure decline deviates from a linear dependence on the square root of shut-in time. This technique could also be in error and alternate methods have been developed to estimate the minimum stress, such as the step rate test and the flow back test.

In a step rate test, the injection is increased by steps until the pressure response indicates that a fracture is widely open. Analysis of the propagating pressure vs. flow rates leads to an estimation of minimum stress. The flow back test consists of pumping the fluid out of the fracture once the injection has been stopped. Closure is determined from a change of the pressure response behavior. The closure stress is taken as a measure of the minimum stress.

Attempts have also been made to determine the intermediate stress (often the maximum horizontal stress) from the breakdown pressure. The breakdown is due to the tensile strength of the rock and the stress concentration induced around the well bore. The breakdown pressure Pb is predicted using linear isotropic elasticity and assuming a non-penetrating fluid by the Hubbert and Willis breakdown equation:

$$Pb=3Sh-SH+T-P_p$$

where SH and Sh are the maximum and minimum horizontal principal stresses, respectively, T is the tensile strength and $P_p$ is the pore pressure of the rock. For injection cycles which follow the first injection cycle, the breakdown corresponds to the reopening of the fracture, and T is then effectively equal to zero. As Sh have been determined from the closure, this equation can be used to estimate the intermediate stress. However this estimation is often poor: the fluid penetrates the fracture before the fracture re-opens, the assumption of linear isotropic elasticity does not apply, the wellbore is not aligned with a principal stress direction or the re-opening pressure is obscured by viscous effects.

A better approach to estimate the complete state of stress is to re-open a pre-existing fracture or a discontinuity. With this method, the closure stress is determined on pre-existing fractures by performing a series of step rates and shutins. The fluid is injected at a very low flow rate (e.g., less than 0.5 liter/minute) to percolate the pre-existing fracture. A clear breakdown is rarely observed, because the injection fluid penetrates the fracture before the opening occurs. The closure stress is a measure of the stress normal to the fracture plane. Measurements made on fracture planes with various dips and strikes allow the complete state of stress to be determined.

A drawback of the open hole hydraulic fracturing technique is that communication between the test interval and the borehole annulus above/below the test interval is often observed during the pressurization phase, preventing the test being carried out properly. Because of the communication problem, cased hole stress tests are often carried out. Cased hole tests are also preferred for operational and safety reasons. Except for the need to perforate the casing (usually a 2 foot interval is perforated), the technique is similar to the open hole hydraulic fracturing technique. Stress measurements in cased holes have disadvantages relative to open hole measurements: fracture orientation and width are hidden by the casing, the fracture may propagate in the cement, breakdown pressures are often much higher than those obtained in open hole, breakdown pressure cannot be easily interpreted (the Hubbert equation does not apply due to the existence of the casing and perforation) and, especially in a petroleum environment, operators are unwilling to perforate the casing in non-productive layers.

Another approach to measuring in-situ stress employs an instrumented, inflatable packer to initiate fractures in the rock without injection of fluid in the rock. U.S. Pat. No. 4,733,567 to Serata; O. STEPHANSSON, *Sleeve Fracturing for Rock Stress Measurement in Boreholes,* SYMPOSIUM INTERNATIONAL IN SITU TESTING, Volume 2, 571–578, Paris, 1983. While the packer-fracturing technique as proposed thus far has advantages over the hydraulic fracturing technique, its utility is limited by the lack of means for determining fracture orientation and other features needed to obtain useful measurements deep in the earth.

SUMMARY OF THE INVENTION

Methods and apparatus are provided in accordance with the invention for measurement of in-situ formation stress. A modular sonde may be configured in one of several ways for conducting the measurements in either open or cased boreholes. The sonde may be conveyed on an electric wireline with or without a coiled tubing for conveying hydraulic energy from the surface. Modules common to the configurations include a telemetry electronics module, an orientation module, a hydraulic energy accumulator module, fluid chambers, a hydraulic power module, a pumpout module, and a flow control module. Each configuration has a stress/rheology module suited to the borehole situation.

One open-hole sonde configuration comprises a stress/rheology module having an instrumented, inflatable packer module, an orienting module, and a probe module. The probe module is operated to obtain formation pore pressure. The packer is inflated in a series of stages designed to obtain data from which formation rheology and stress characteristics are determined. A second open-hole sonde configuration comprises a stress/rheology module having an instrumented straddle-packer assembly. The packers are positioned and inflated in a series of stages, and the formation is stressed hydraulically, to obtain data from which formation rheology and stress characteristics are determined. A pre-test is performed to obtain pore pressure before deforming the formation rock.

One cased-hole sonde configuration comprises a gunblock assembly for perforating casing, means for orienting the gunblock, means for conducting pre-test measurements of the formation through the perforation, and means for stressing the formation hydraulically to obtain data from which formation stress characteristics are determined. A second cased-hole sonde configuration comprises a straddle-packer assembly, means for perforating the casing in the straddle interval, and means for stressing the formation hydraulically to obtain data from which formation stress characteristics are determined.

Preferred embodiments of the apparatus of the present invention have the capability of injecting low flow rates, minimize the effects of wellbore storage on the pressure response, and allow good control over packer behavior. The provision of an accumulator and hydraulic intensifier allows increased hydraulic fracture pressure over that available with an electric pump, and offers improved fracture control by minimizing compressibility problems of tubing conveyed fracturing tools.

These and other features of the preferred embodiments will become apparent from the detailed description which follows with reference to the drawing Figures.

DETAILED DESCRIPTION OF THE PREFERRED EMBODIMENTS

Figure 1:
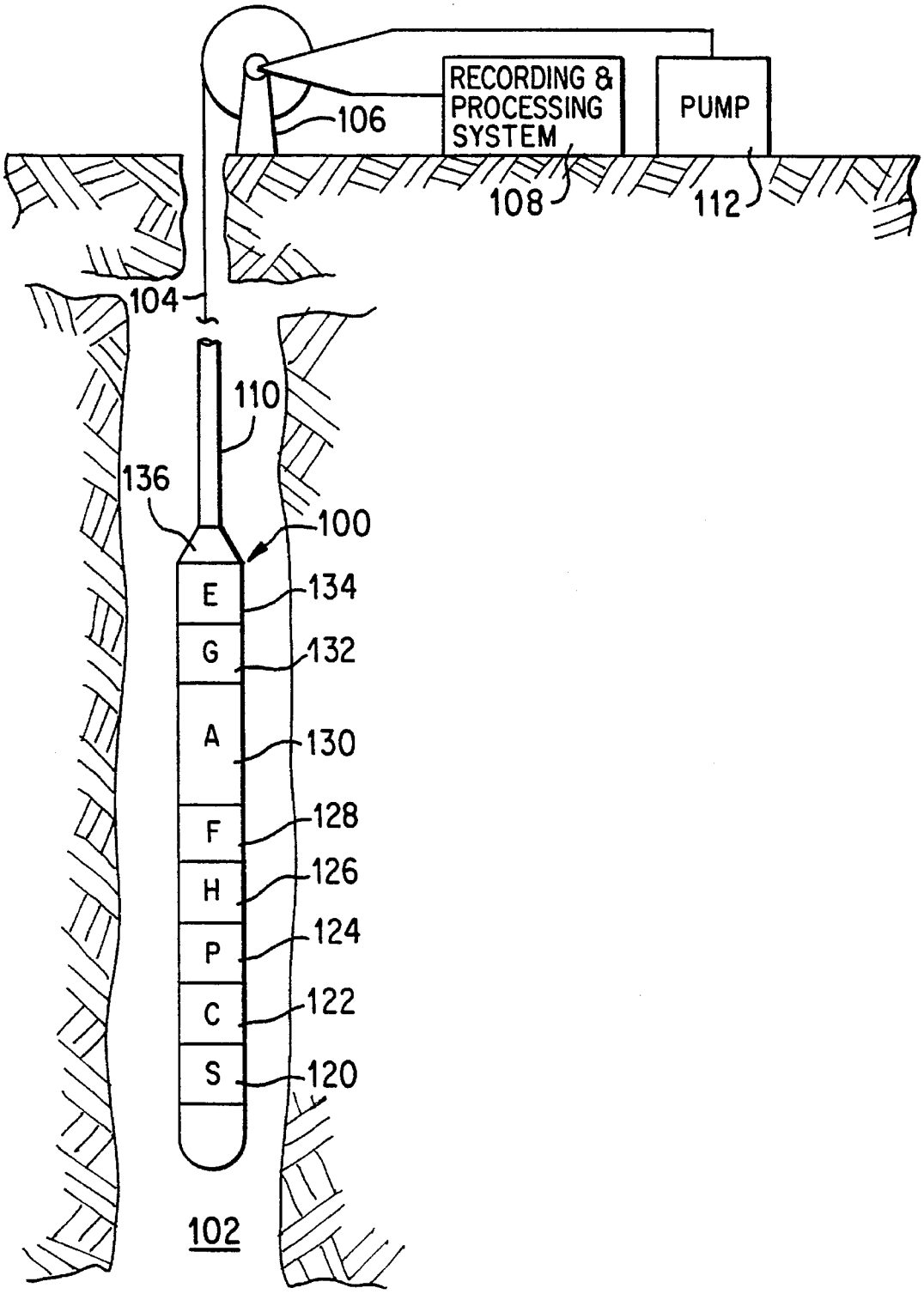
FIG. 1 is a schematic view of a sonde in accordance with the present invention.

FIG. 1 is a schematic view of a sonde 100 in accordance with the present invention. The sonde is suspended in a borehole 102 on a wireline cable 104, or a coiled tubing and wireline cable combination, from a winch assembly 106 or the like. Wireline cable 104 is preferably a conventional, armored, seven-conductor cable, but may be of any suitable construction. A surface recording and processing system 108 supplies electrical power to sonde 100 and receives data from sonde 100 via the wireline cable. Wireline cable is preferably run into the borehole inside a coiled tubing 110 (only a part of which is shown in FIG. 1) so that a surface pump 112 may be used to supply hydraulic pressure to sonde 100 through the annulus between coiled tubing 110 and cable 104 for purposes which are described later.

Sonde 100 comprises a stress/rheology module (S) 120, a flow control module (C) 122, a pumpout module (P) 124, a hydraulic power module (H) 126, fluid chambers (F) 128, an accumulator module (A) 130, an orientation module (G) 132, and telemetry electronics (E) 134 for transmitting data uphole via cable 104 to recording and processing system 108. Control signals for controlling operation of sonde 100 are transmitted downhole via cable 104 from recording and processing system 108. An adapter head 136 provides mechanical and electrical connection between wireline cable 104 and sonde 100.

If wireline cable 104 is run into the borehole inside a coiled tubing 110, adapter head 136 also provides hydraulic connection between sonde 100 and the annulus of tubing 110 and cable 104 so that hydraulic energy may be supplied to sonde 100 from pump 112 for purposes which are discussed below. Adapter heads for coiled tubing logging are known, such as those currently used by Dowell-Schlumberger to provide wireline logging services in highly deviated well-bores and to pump fluid through the coiled tubing while logging.

Sonde 100 is preferably constructed in modular fashion to allow configuration to meet a variety of borehole conditions. That is, it is intended that component modules 120, 122, 124, 126, 128, 130, 132 and 134 can be assembled in any of a number of sonde configurations. Stress/rheology module 120 may take any of a number of forms, preferred embodiments of which are described below.

Certain of the component modules may be the same as or similar to those used in the commercial Schlumberger MDT tool, as will become apparent from the description which follows. Salient features of the MDT tool are described in U.S. Pat. No. 4,860,581 to Zimmerman, the content of which is incorporated herein by this reference.

Figure 2A:
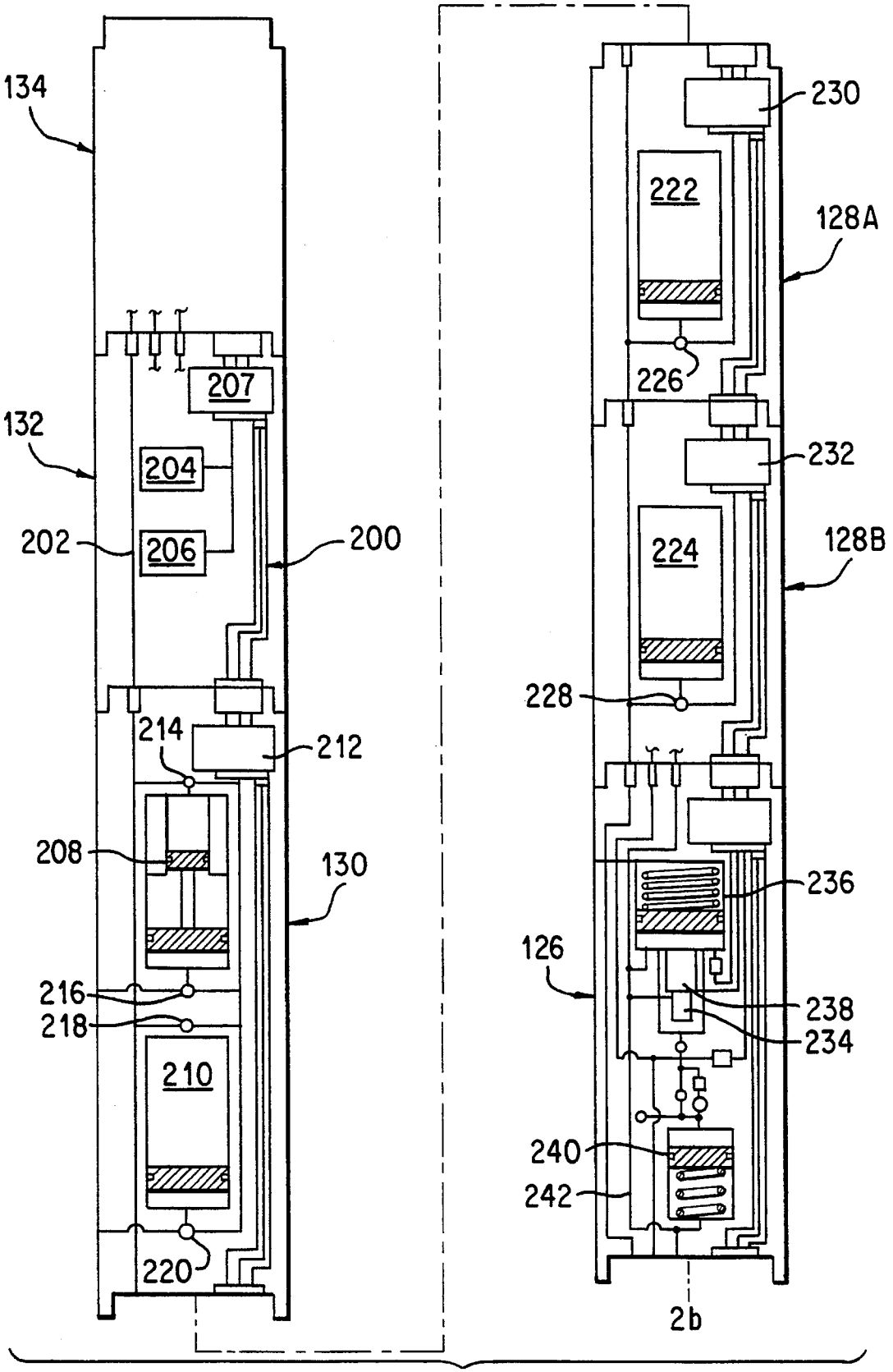
FIGS. 2A and 2B illustrate schematically some of the modular components of the sonde of FIG. 1 in accordance with the present invention.
Figure 2B:
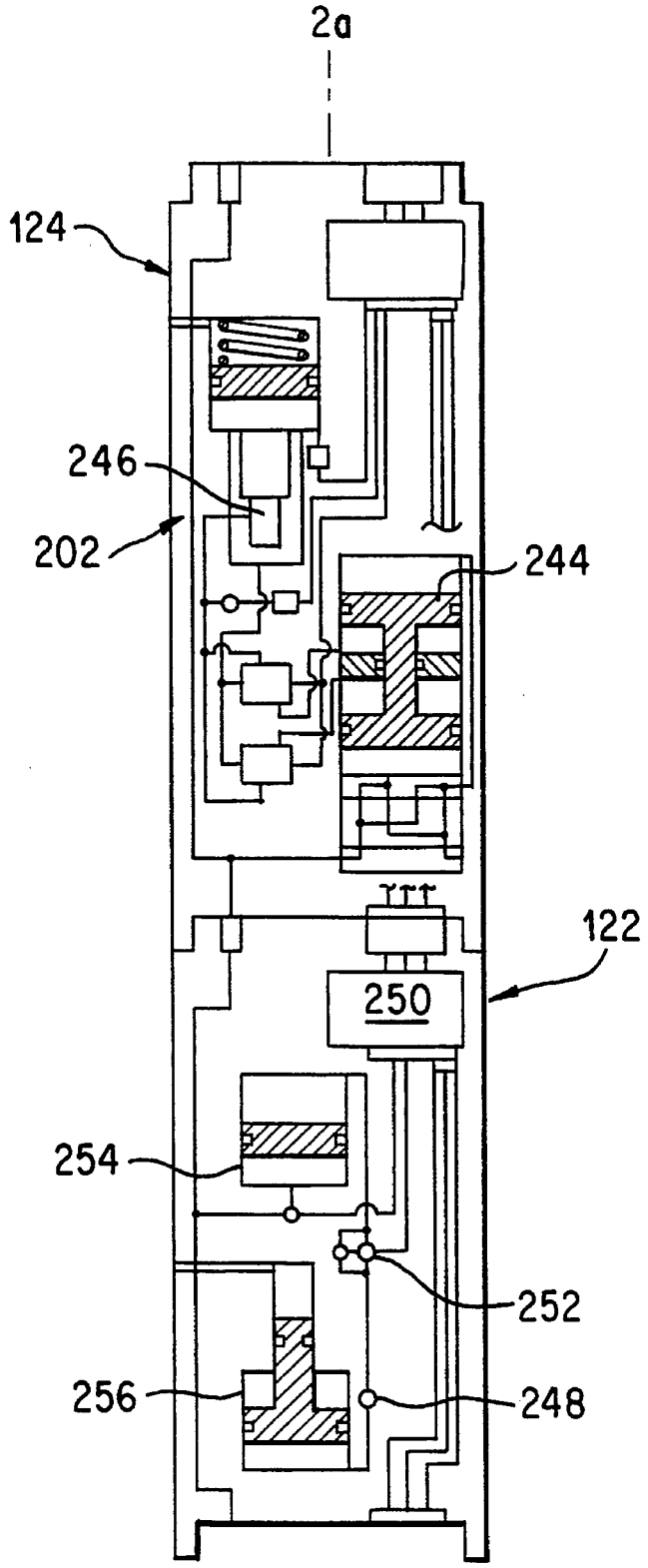

FIGS. 2A and 2B provide a schematic representation of apparatus in accordance with the invention illustrating some of the modular components of FIG. 1. Wireline and coiled tubing connections to sonde 100, as well as power supply and communications related circuitry of electronics module 134 are not illustrated for the purpose of clarity. Such power and communication components are known to those skilled in the art and have been in commercial use in the past. Power and communication lines 200 and flow lines 202 extend throughout the length of sonde 100 for connection to the various components.

Referring to FIG. 2A, orientation module 132 serves to detect the orientation of sonde 100 in the borehole, and may be constructed in the manner of the General Purpose Inclinometry Tool (GPIT) used commercially by Schlumberger or in any other suitable manner. Orientation module 132 preferably comprises a triaxial inclinometer 204 for detecting the earth's gravitational force, a triaxial magnetometer 206 for detecting the earth's magnetic field, and module control electronics 207. Orientation of sonde 100 is readily computed from the detected gravitational field and magnetic field vectors.

Accumulator module 130 includes a hydraulic intensifier 208 for increasing available hydraulic pressure, and a reservoir chamber 210 for storage of hydraulic energy. Controllable valves 214, 216, 218 and 220 respectively control flow between flowline 202 and intensifier 208, between intensifier 208 and the borehole, between chamber 210 and flowline 202, and between chamber 210 and the borehole. Accumulator module 130 is operated by module control electronics 212. Functioning of the elements of accumulator module 130 is described in more detail with reference to the flow line schematics of FIGS. 3B, 8B and 20. Accumulator module 130 allows a very high flow-rate to be achieved, and can be used to multiply the hydrostatic borehole pressure by using a low-rate pump. Intensifier 208 can have a variety of stepped piston ratios. The piston step ratio is selected based on the expected hydrostatic pressure (at the test depth in the borehole) and pumping pressure capability of pumpout module 122.

A method of energizing intensifier 208 (moving the stepped piston downward; see FIGS. 2A, 3B, 8B and 20) is as follows. The chamber between the large and small areas of the piston is subjected to hydrostatic pressure (frictional forces are neglected for simplicity). Denoting the small side of the piston as side 1 and the hydrostatic side as side 2, and p1 as pump pressure, p2 as hydrostatic pressure, A1 as small piston area and A2 as large piston area, then p1> p2*(A2/A1). When the pumping pressure limit is reached to push the hydrostatic pressure out of the chamber at side 2 of the piston, the following options are available: (1) Move sonde 100 to a shallow depth and energize intensifier 208 against lower hydrostatic pressure. Sonde 100 is then lowered in the borehole with intensifier 208 charged and valves closed. (2) Use multiple pumps in series at the same depth. The inlet pressure at the second pump can be the outlet pressure of the first pump so that very high pressures can be achieved at the outlet of the last pump. (3) Multiple intensifiers can be used with different stepped-piston ratios. The charging sequence can be in series for pressure multiplication. Discharging can be done simultaneously be hydraulically connecting the chambers in parallel with the valves.

A method of de-energizing intensifier 208 for hydraulic fracturing or to inflate a packer (when the intensifer piston is moved upward) is as follows. Designating p1' as fracture fluid pressure or packer inflation pressure, and p2' as hydrostatic pressure at depth in the borehole, then p1' (maximum)= p2'*(A2/A1). Designating Q2' as hydrostatic fluid flow-rate, then Q1' (maximum)=Q2'*(A1/A2). The maximum theoretical rate available is infinity. The rate will be controlled by the hydrostatic head, the restriction in the flow path and the formation pressure. The flowline components are designed to withstand the wear due to high flow rates.

As sonde 100 has long dwell periods (when descending into borehole, moving between beds of interest, etc.), hydraulic power module 126 can be used to charge the accumulator module 130 during these periods. Short-duration peak flow for fracturing is supplied by accumulator module 130, which is an economical method compared to using very large pumps.

Fluid chambers 128 may comprise a plurality of fluid chamber modules (shown at 128A and 128B) having respective chambers 222 and 224 which communicate with flowline 202 via respective controllable valves 226 and 228. Each module is shown having its own control electronics 230 and 232, respectively. Fluid chambers 128 enable recovery of samples of formation fluid which may be brought to the surface. Several sizes may be provided, each having individual control electronics. Fluid chambers 128 also may be used to carry surface fluid downhole. When the valve at the bottom of the piston is kept open to borehole fluid, the hydrostatic borehole pressure can provide a driving force to dump the chamber fluid to a location where the pressure is less than hydrostatic.

Hydraulic power module 126 comprises a hydraulic-oil pump 234, an oil reservoir 236 and a motor 238 to control the operation of pump 234. A compensating piston 240 having its upper surface at borehole fluid pressure and its lower surface in hydraulic connection with pump 234 via line 242 serves for pressure compensation of pump 234. Hydraulic power module 126 is pressure compensated for the hydrostatic pressure, i.e., the inlet pressure for the pump is hydrostatic. Hydraulic power module 126 provides hydraulic power needed to operate components of other modules, and can be connected at any location in the sonde below the electric power module. Surface control system 108 completes the motor power control loop by adjusting the DC motor/pump speed and torque as required by the hydraulic system.

Referring to FIG. 2B, pumpout module 124 comprises a reciprocating piston assembly 244 operated by a pressure-compensated pump assembly 246. Pumpout module 124 has multiple purposes. One purpose is to pump formation fluid from the formation to the borehole (this fluid is analyzed through different modules) until fluid analysis determines that an uncontaminated formation sample is being withdrawn. At this point formation fluid may be diverted into a sample chamber for recovery. A second purpose is to provide pressurized fluid to inflate packers. It can also pump fluid from a flow-line of the sonde to the borehole or to the formation. When used with accumulator module 130, pumpout module enables fluid to be pumped under higher pressures and flow-rates for inflating packers and/or for performing hydro-fracture. Because of power transmission limitations of wireline cable 104, pumpout module 124 can deliver only limited flow-rate and pressure (e.g., 1.2 gal/min and 4000 psi cannot be achieved simultaneously in the MDT tool's pumpout module—maximum pressure is achieved at minimum flow-rate and vice versa). Pumpout module 124 is operated in reverse mode to deflate packers or to withdraw fluid from the formation to the borehole or to fluid chambers in the sonde.

FIG. 2B also shows flow control module 122 which comprises a flow sensor 248, a flow controller 250, and a selectively adjustable restriction device such as valve 252. A predetermined sample size can be obtained at a controlled flow rate by operation of the hydraulic pistons in reservoirs 254 and 256. Hence larger pretest could be performed when straddle packers are used. Flow control module 122 provides constant pressure drawdown on the formation face, to enhance permeability determination and sampling. It precisely controls the flow-rate (by controlling movement of the piston), and thus flowing pressure.

Stress/rheology module 120 may take a variety of forms, preferred forms of which will now be described with reference to FIGS. 2A, 2B, 3A and 3B; 2A, 2B, 8A and 8B; 2A, 2B and 13; and 2A, 2B and 14.

A. Open Hole, Single Packer Configuration

Figure 3A:
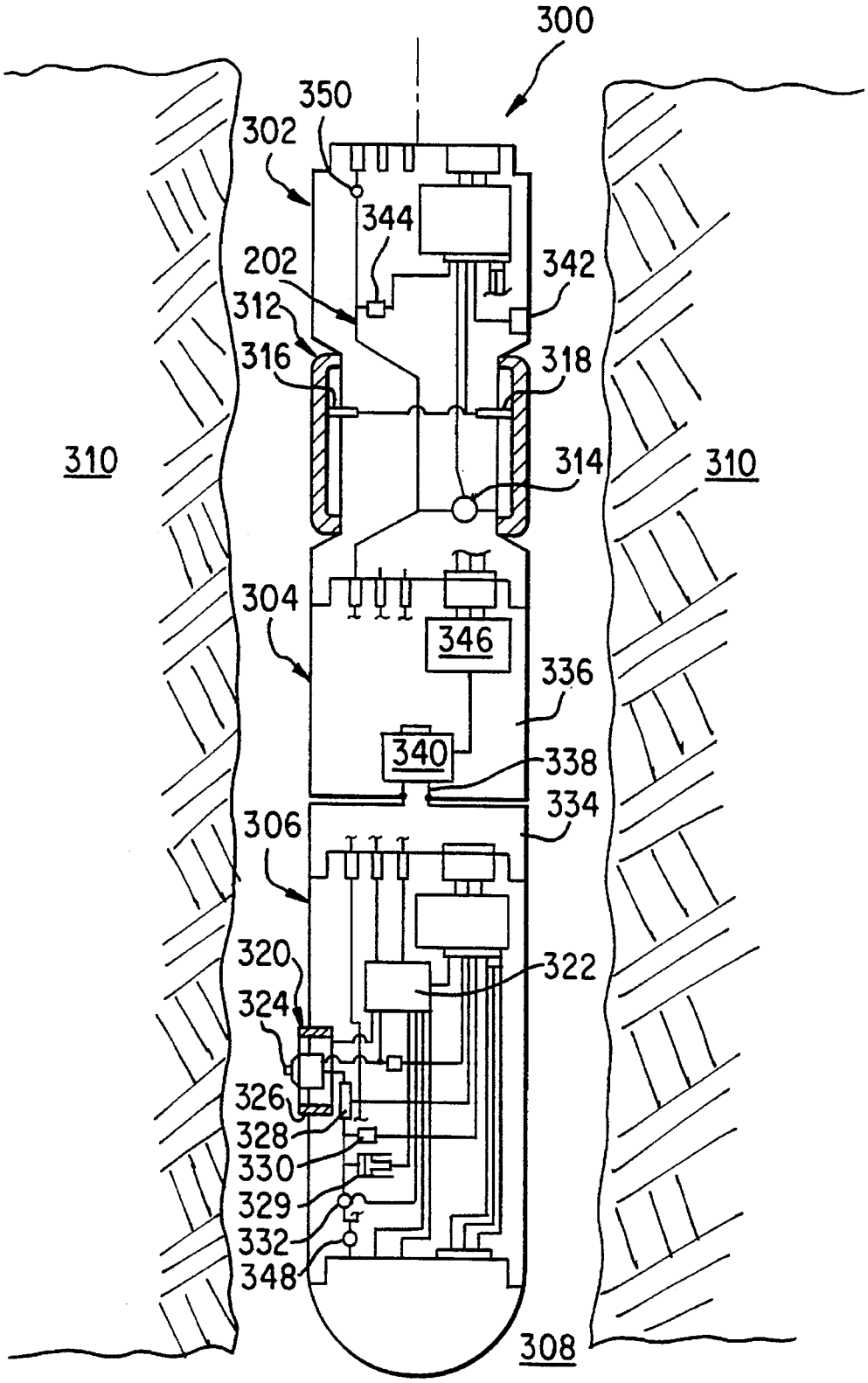
FIG. 3A is a schematic illustration of a first embodiment of the stress/rheology module of FIG. 1 in accordance with the present invention.

FIG. 3A shows schematically at 300 a first preferred embodiment of a stress/rheology module S. As illustrated, stress/rheology module 300 comprises an instrumented, inflatable packer module 302, an orienting module 304, and an MDT probe module 306. Sonde 100, including module 300, is shown positioned in a borehole 308 traversing an underground formation such that packer 302 is within a portion of the borehole passing through a predetermined bed 310.

Packer module 302 comprises an inflatable packer 312 which may be inflated with fluid under pressure from flowline 202 via a controllable valve 314. The inflation fluid may be borehole fluid or a fluid such as water or oil stored in a reservoir in sonde 100. The inflation fluid is supplied under pressure to flowline 202 by any suitable means, such as from pump 112 via coiled tubing 110 (FIG. 1) or from hydraulic power module 126 (FIG. 2A) or from accumulator chamber 210 (FIG. 2A).

Accumulator chamber 210 may be charged by any suitable means, such as from the surface by pump 112 via coiled tubing 110, by hydraulic power module 126, or by converting chemical energy to elastic strain energy (e.g., by converting chemical energy stored in a propellant to strain energy stored in a compressed fluid within the accumulator), or by a combination of these. In any case, the accumulator may be charged using fluid from a storage chamber in sonde 100 or using borehole fluid.

Packer 312 is fitted with a plurality of packer displacement sensors spaced about the sonde axis for measuring radial displacement of the packer wall as the packer is inflated. Two such sensors, illustrated at 316 and 318, will measure borehole diameter change in one direction. Additional sensors (not illustrated in FIG. 3A) are provided to measure borehole deformation in at least three different directions, for determination of fracture direction, directions of rock anisotropy and/or formation stress directions. The construction of packer 312 and of the displacement sensors may be as described in U.S. Pat. No. 4,733,567 to Serata, the content of which is incorporated herein by this reference. As described in the Serata patent, the displacement sensors may be linear variable displacement transducers (LVDTs). As an alternative to or in addition to fitting the packer with displacement transducers, mechanical caliper arms of conventional construction may be provided above, below, or above and below packer 312 for measuring borehole wall displacement as packer 312 is inflated.

Packer module 302 includes a pressure sensor 344 for detecting packer inflation pressure, an acoustic transducer 342 for detecting acoustic emissions in the borehole for purposes discussed below, and controllable valves 348 and 350 for controlling flow in flowline 202.

Stress/rheology module 300 further includes a probe module 306, preferably mounted at the bottom of sonde 100 to the lower end of an orienting module 304. Probe module 306 may be as used in the Schlumberger MDT tool, as described in U.S. Pat. No. 4,860,581 to Zimmerman. A probe assembly 320 is selectively moveable relative to sonde 100 by operation of a hydraulic probe actuator 322. Assembly 320 includes a probe 324 fitted with a donut (solid elastomeric pad-type) packer and mounted to a frame 326. Frame 326 is movable with respect to sonde 100 and probe 324 is movable with respect to frame 326. In operation, the extension of frame 326 helps to steady the sonde and brings probe 324 adjacent the borehole wall. From there, probe 324 can be pressed against the borehole wall for obtaining formation fluid pressures, resistivity measurements, and samples through the opening in the donut packer. Probe module 306 includes a flowline resistivity sensor 328, a flowline pressure sensor 330 and controllable flow valves 332 and 348. Probe module 306 has its own pretest chamber 329 (typically 20 cc, variable rate) which is used to perform smaller volume pretest. Smaller fluid volume is withdrawn with the probe or gunblock (point source) compared to straddle packer interval production (where fluid flows from a cylindrical source 360 degrees—around the borehole). The pretest method is well established in the industry to determine pore pressure and permeability.

Orienting module 304 allows probe module 306 to be controllably rotated about the axis of sonde 100 for placement of probe 324 at any desired position about the borehole wall. As illustrated schematically in FIG. 3A, orienting module 304 comprises a lower member 334 rotatably coupled to an upper member 336 by means of a shaft 338. Shaft 338 may be driven by a motor 340 or other suitable means under control of orienting electronics 346. Motor 340 may for example be a torsional motor or a hydraulically driven rotatory actuator in which linear motion of a piston is transformed into rotary motion. Other arrangements suitable for the purpose are within the scope of the invention. Probe module 306 is mounted to lower member 336, and upper member is mounted to the lower end of packer module 302. Once the orientation of sonde 100 is determined by means of orientation module 132, probe 324 of probe module 306 may be rotated by operating orienting module 304 for placement at any desired location about the borehole wall.

Figure 3B:
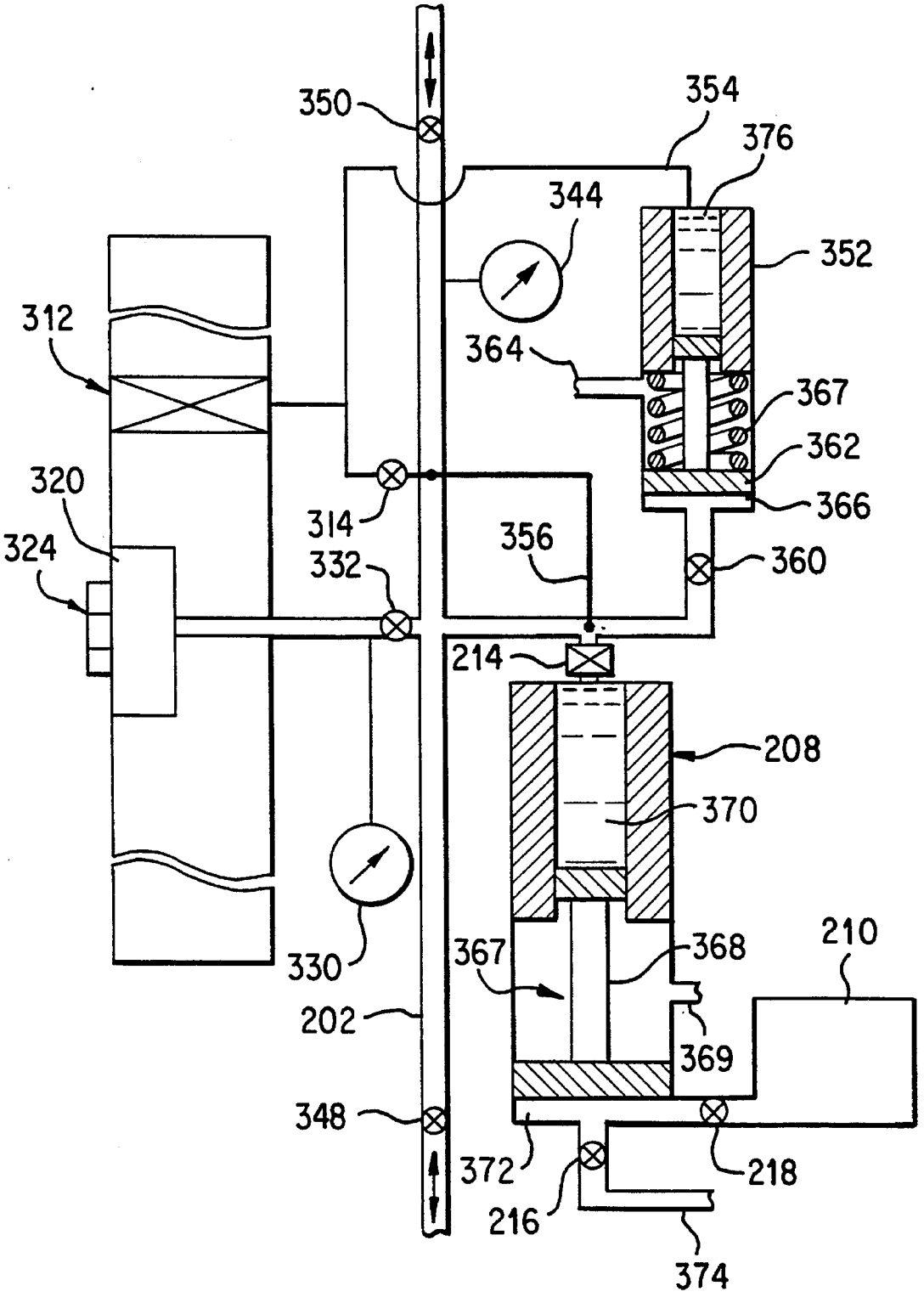
FIG. 3B is a simplified flowline schematic of the sonde embodiment of FIGS. 2A, 2B and 3A, including a packer auto-deflation system.

FIG. 3B shows a simplified flowline schematic of the sonde configuration illustrated in FIGS. 2A, 2B and 3A, and further illustrates an auto-deflation system for packer 312 comprising a hydraulic piston assembly 352, hydraulic lines 354 and 356, and controllable valves 314 and 360. Hydraulic line 354 communicates with packer 312. Piston assembly 352 comprises a spring-loaded, double-ended piston 362 in a cylinder having a central portion open at 364 to borehole pressure. The auto-deflation system is illustrated in a de-energized condition, with spring 367 extended.

Operation of portions of this configuration of sonde 110 is as follows:

1. Before inflating packer 312, the auto-deflation system is energized by opening valves 350 and 360, closing valve 314, and pumping fluid from pumpout module 124 through valve 360 into chamber 366. The fluid may be borehole fluid, fluid from a sample chamber of sonde 100, or fluid supplied from the surface via coiled tubing 110. When piston 362 has been moved upwardly to compress spring 367, valve 360 is closed, and valve 314 is opened for packer inflation.

2. Piston 368 of intensifier 208 is re-set to the position illustrated in FIG. 3B by closing valves 218, 360, 314 and 332, opening valves 214 and 216, and pumping fluid into chamber 370 to move piston 368 downwardly. Fluid in chamber 372 is thereby discharged to the borehole via valve 216 and line 374. Chamber 367 is open to borehole pressure through line 369.

3. Borehole fluid pressure may be used to activate intensifier 208 by closing valves 348, 350 and 218, and opening valves 214 and 216. Borehole pressure at line 374 causes piston 368 to move upwardly, and the energy may be discharged through valve 314 (for inflation of packer 312) or valve 332 (for discharge of fluid through probe 324).

4. Energy from accumulator chamber 210 may be discharged by closing valves 348, 350 and 216, opening valves 214 and 218, and opening either valve 314 (for inflation of packer 312) or valve 332 (for discharge of fluid through probe 324).

5. Packer 312 may be inflated using pumpout module 124, by closing valves 348 and 332 and opening valves 350 and 314.

6. Packer 312 may be deflated using pumpout module 124 in reverse operation to pump fluid from the packer, e.g., to the borehole or to a sample chamber, via valves 314 and 350. The auto-deflation system may also be used for deflation of packer 312 by opening valve 360 to allow piston 362 to move downwardly to withdraw fluid from packer 312 into chamber 376. The excess fluid from deflating packer 312 will flow through chamber 376 and line 364 to the borehole when piston 362 reaches the bottom of the stroke.

7. Formation fluid flow to sonde 100, and pressure from sonde 100 to the formation via probe 324, are controlled by valve 332. Fluid may be pumped from the formation by pumpout module 128 via valves 332 and 350. Fluid may be allowed to flow back from the formation at a controlled rate via valves 350 and 332 using pumpout module 128 connected in series with flow control module 122.

Figure 4A:
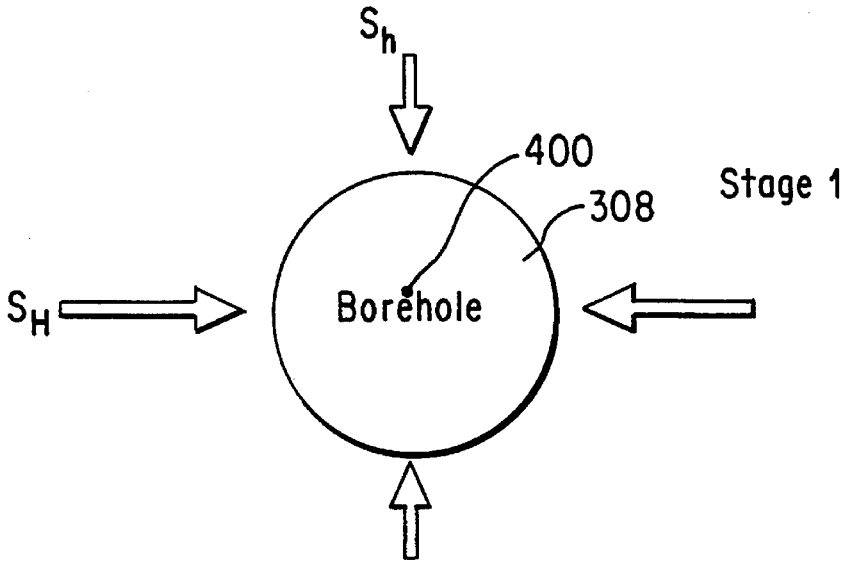
FIGS. 4*a* through 4*g* illustrate stages of borehole deformation induced by operation of the sonde of FIGS. 2A, 2B and 3A in accordance with the present invention.
Figure 4B:
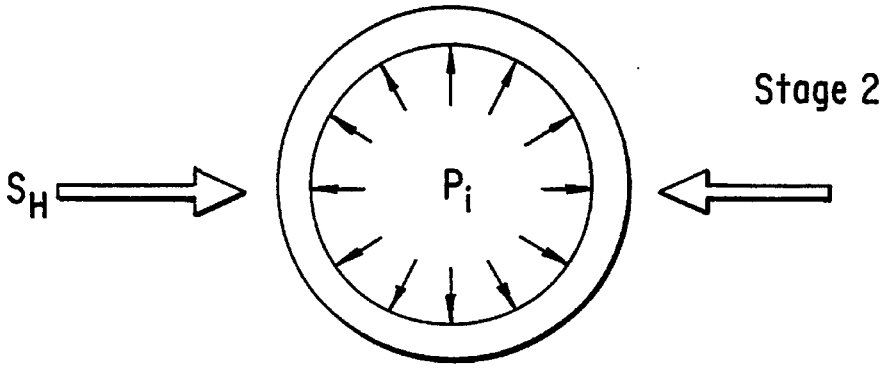
Figure 4C:
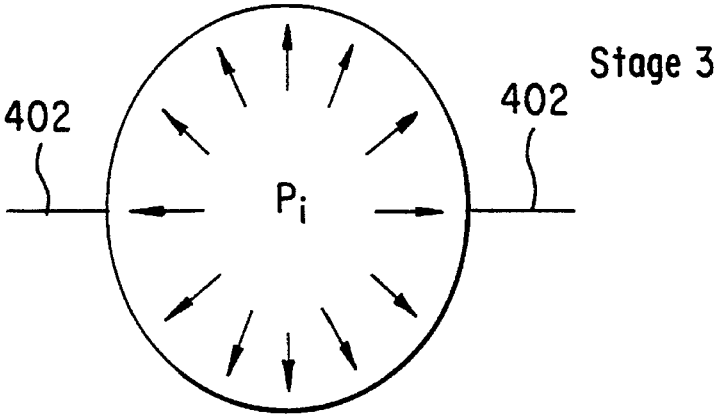

In operation, packer 312 is inflated and pressurized in a series of five stages which will be described with reference to FIGS. **4*a*–4*g* and FIG. 5. FIGS. 4*a*–4*g* show respective pressurization stages 1 through 5 of packer 312. FIG. 5 shows monitored parameters in relation to the packer pressurization sequence. Curve Q of FIG. 5 illustrates the packer pressurization sequence, with positive-going ("+1") excursions representing application of inflation fluid under pressure to pressurize packer 312, negative-going ("−1") excursions representing the drawing out from packer 312 of inflation fluid to depressurize packer 312**, and zero ("0")

levels representing no change in packer pressurization. For example, the positive-going excursions of curve Q may represent the operation of hydraulic pump 246 (FIG. 2A) in a first direction to inflate and pressurize packer 312, while the negative-going excursions may represent the operation of pump 246 in the opposite direction to deflate and depressurize packer 312. Suitable alternate means of packer inflation and deflation (including the auto-deflation system of FIG. 3B) are within the scope of the present invention.

Packer 312 is initially in a substantially deflated condition as shown in FIG. 3A, so that sonde 100 may be run into the borehole at a time prior to time $t_0$ of FIG. 5, with packer 312 positioned within a bed 310 of interest. As shown in the borehole cross-section of FIG. 4*a*, bed 310 has an axis of maximum horizontal principal stress SH and an axis of minimum horizontal principal stress Sh, the maximum and minimum principal horizontal stress axes being mutually orthogonal in a plane substantially perpendicular to borehole axis 400.

In Stage 1, packer 312 is inflated until just in contact with the borehole wall. As shown in FIG. 5, pressure (P) within the packer, radial displacement of the packer walls (U), fluid volume (V) inside the packer, and acoustic emissions (AE) are monitored to determine when the packer contacts the formation. Packer inflation pressure is detected by sensor 340 (FIG. 3A), inflation fluid volume is determined by monitoring inflation fluid flow, borehole diameters are detected by packer displacement sensors (FIG. 3A) and/or calipers, and acoustic emissions are detected by acoustic sensor 342 (FIG. 3A). Stage 1 packer inflation commences at a time $t_0$ and is continued until packer 312 contacts the formation at a time $t_1$ as represented by inflation sequence Q of FIG. 5. During the inflation interval $t_0$-$t_1$ shown in FIG. 5, the packer pressure P increases slightly, packer volume V increases, the packer wall displacement U increases to the diameter of the borehole, and an acoustic emission is detected when the packer contacts the borehole wall. For simplicity, only three borehole diameters, $U_1$, $U_2$, $U_3$ are shown in FIG. 5, though more or fewer may be monitored as desired. When the packer has contacted the borehole wall at time $t_1$, packer inflation is stopped and the sonde's instrumentation is preferably zeroed during interval $t_1$-$t_2$ in preparation for borehole fracturing.

In Stage 2, packer 312 is further pressurized to exert stress on the formation below the fracture initiation stress (Stage 2 pressures are always less than 1 Pb). As shown in the borehole cross-section of FIG. 4*b*, pressure Pi within packer 312 causes packer 312 to exert force on bed 310 radially outwardly from the borehole axis. As shown in FIG. 5, the Stage 2 pressurization of packer 312 commences at a time t2. During pressurization in Stage 2, acoustic emissions AE from the deforming rock are monitored with an array of acoustic receivers, radial deformation of the borehole wall is monitored at multiple locations about the tool axis, internal packer pressure is monitored, and the volume of fluid in the packer is monitored.

As pressure Pi within packer 312 is increased, the packer inflation-fluid volume V increases and borehole diameters U1, U2 and U3 increase. As the pressure Pi within packer 312 approaches the formation breakdown pressure 1 Pb at time t3 of FIG. 5, the number of acoustic emissions AE increase significantly, signaling the initiation of bed fracture. Also, the borehole diameter measurements U1, U2 and U3 begin to diverge as the borehole wall begins to distend more along the axis of minimum principal stress. FIG. 4*c* shows in Stage 3 a cross-section of borehole 308 with a fracture 402 initiated in bed 210 in a plane through the borehole axis.

When fracture initiation is detected at time t3 from the acoustic emissions AE and/or from borehole diameter measurements, packer pressurization is stopped. Fracturing of bed 210 continues during a brief time interval t3–t4 as the packer pressure is held at the breakdown pressure 1 Pb, while acoustic emissions AE and/or borehole deformation U and/or packer pressure P and/or packer volume V are monitored.

At fracture initiation, the rate of acoustic emissions and the frequency characteristics of the acoustic emissions change as elastic strain energy stored in the rock is converted to fracture surface energy. A fracture will change the elastic stiffness of the formation surrounding the tool. The change in stiffness will be reflected in a decrease in dP/dt (the rate of increase in packer pressure P decreases) and an increase in dV/dt (packer volume increases as the fracture opens). Fractures initiated in this manner are stable; that is, such fractures do not propagate further unless the packer inflation pressure is increased.

Figure 4D:
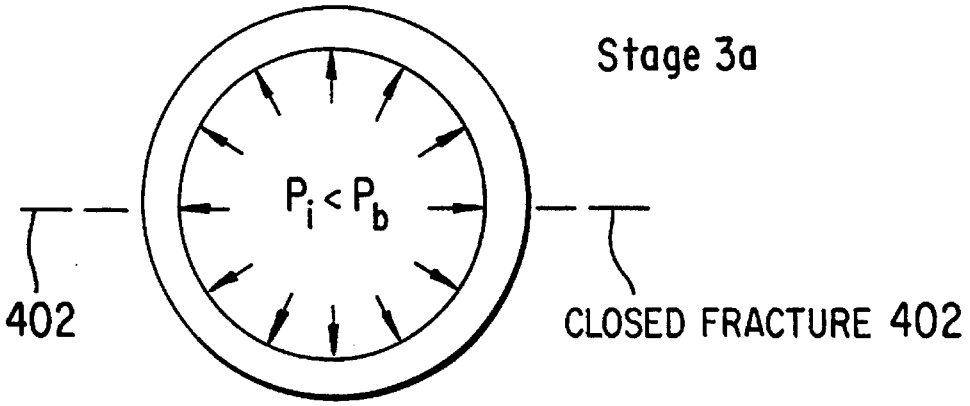
Figure 5:
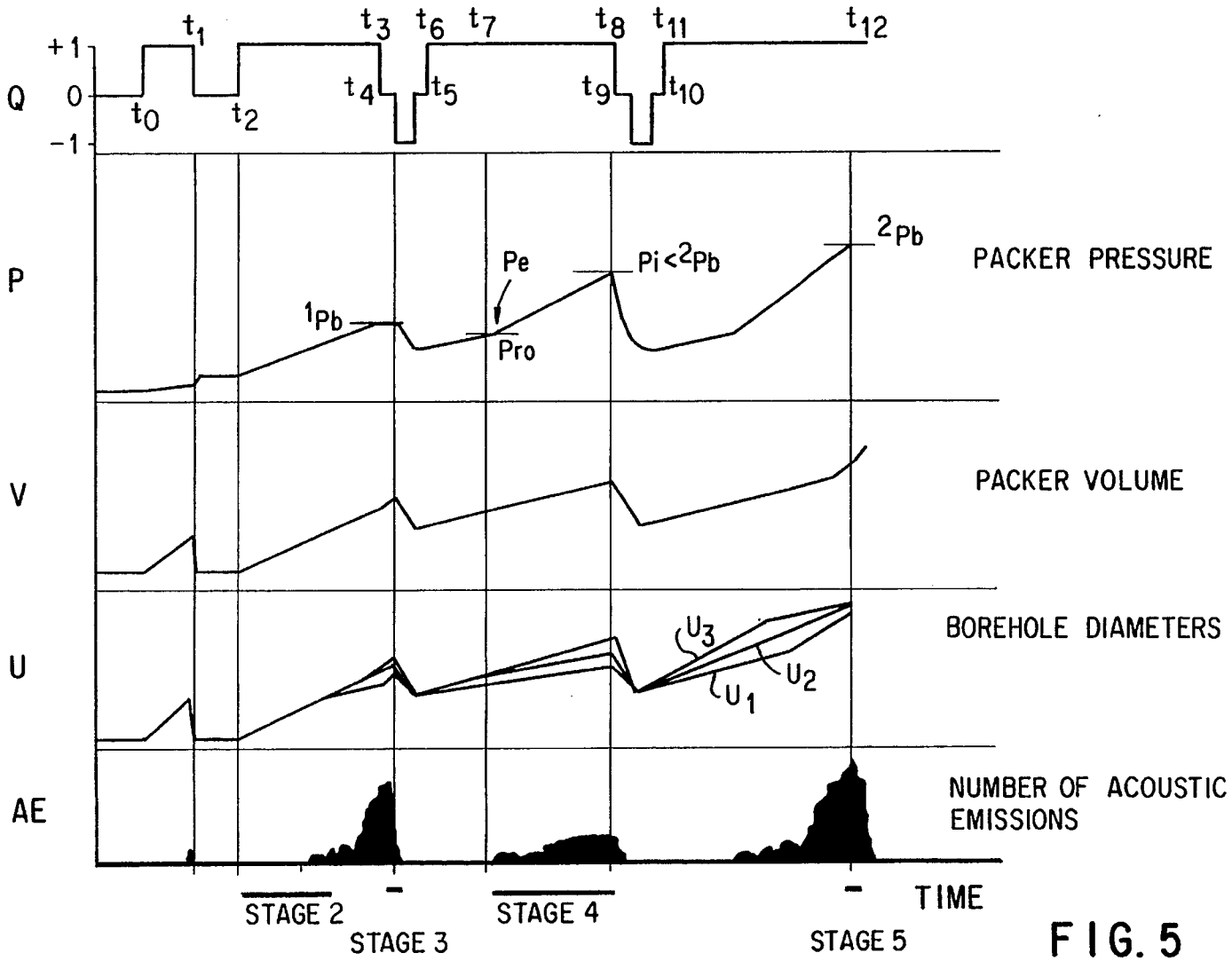
FIG. 5 is a data/pump sequence illustrating operation of the sonde of FIGS. 2A, 2B and 3A in accordance with the present invention.

Referring to FIG. 4*d* and to FIG. 5, the inflation pressure of packer 312 is decreased below the breakdown pressure during a time interval t4–t5 to allow the fracture to close. Packer pressure is reduced either by opening a valve to allow flow-back of the inflation fluid from packer 312, or by activating pumpout module 124 (FIG. 2B) and/or the auto-deflation system (FIG. 3B) to withdraw inflation fluid from packer 312. As packer pressure is reduced during time interval t4–t5, the packer volume and borehole diameters decrease, and the number of acoustic emissions AE is low.

Figure 4E:
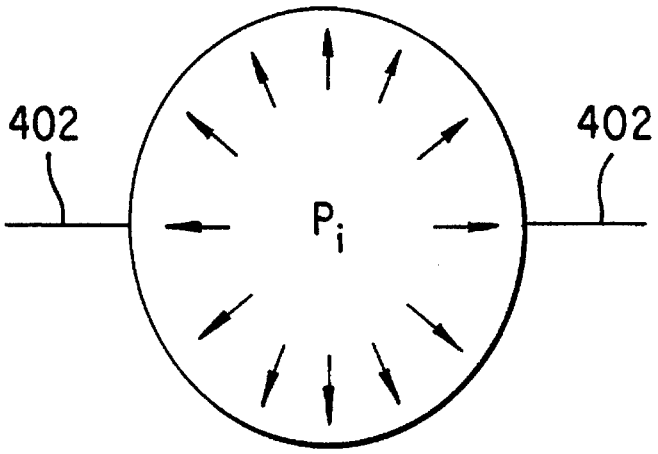

Packer pressure is again increased during a time interval t6–t8 to re-open and extend fracture 402, as illustrated in FIG. 4*e*. Fracture extension beyond Pro is again detected by monitoring acoustic emissions AE, borehole diameters U, packer volume V and packer pressure P. The packer pressure 1 Pro at which the fracture first re-opens, shown in FIG. 5 at time t7, is termed the first-cycle fracture re-opening pressure. Fracture re-opening pressure will be less than the breakdown pressure, and can be determined by comparing the borehole displacements at time t (e.g., Ui(t)) where t approaches t7 with the borehole displacements at the breakdown pressure (e.g., Ui(Pb)), and comparing the packer volume at time t where t approaches t7 (e.g., V(t)) with packer volume at the breakdown pressure (e.g., V(Pb)). When the fracture opens, the borehole displacements will suddenly change in response to an increased borehole diameter perpendicular to the fracture azimuth. As the fracture opens, the packer volume will increase and rate of packer pressurization will decrease. As packer pressure increases and the fracture extends beyond its previous maximum length (FIG. 5, Stage 4), a new flurry of acoustic emissions will be recorded, packer pressure and the rate of packer pressure will increase, and packer volume will also increase.

Figure 4F:
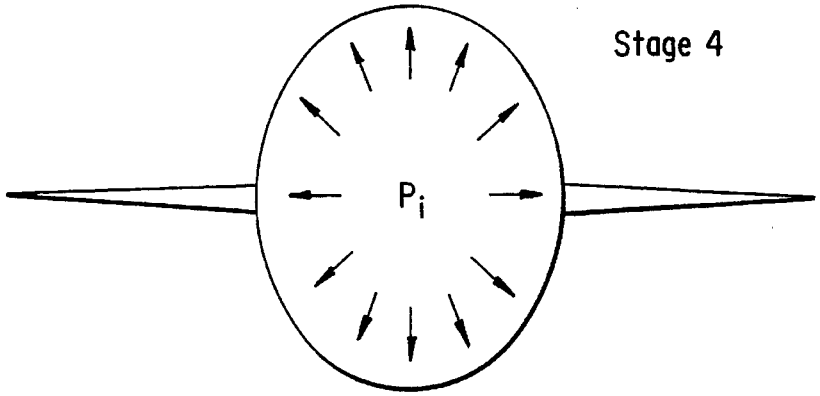

Referring to FIG. 4*f* and to FIG. 5, pressurization continues in Stage 4 beyond re-opening pressure 1 Pro to the fracture extension pressure Pe (at a time t between times t7 and t8) to propagate fracture 402 away from the borehole. Acoustic emissions AE are generated as soon as new fracture surface is created, beginning at pressures just above re-opening pressure 1 Pro at a time t>t7 and continuing to time t8. The increase of packer inflation pressure is terminated at time t8, before a second set of fractures initiates orthogonal to the first fracture 402 (i.e., before commencement of Stage 5, FIG. 4*g*). Fracture orientation is again determined in the manner described above. The pressure at time t8 is arbitrary, but less than the secondary-fracture breakdown pressure, 2 Pb. Pressure 2 Pb may be estimated a priori from a model or from local knowledge. Monitoring acoustic emissions AE, borehole displacements Ui, dP/dt and dV/dt will indicate when packer pressure is approaching pressure 2 Pb.

Packer pressure is decreased below pressure 1 Pro during a time interval t9–t10 (FIG. 5) to allow the fracture to close. Packer pressure is reduced either by opening a valve to allow flow-back of packer inflation fluid or by pump-back operation of pumpout module 124.

Figure 4G:
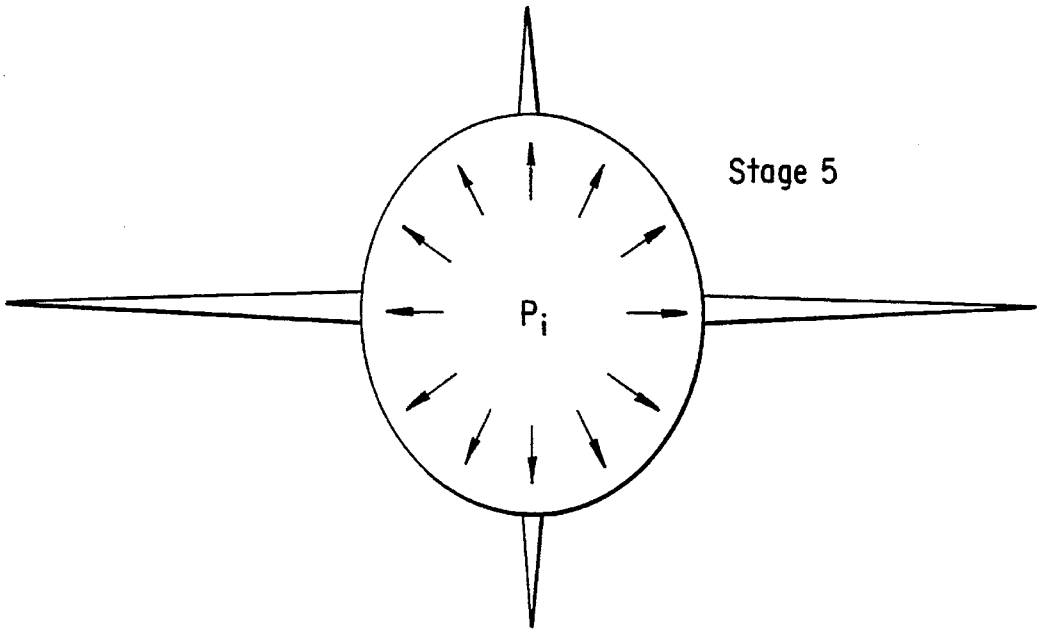

Packer pressure is again increased during a time interval t11–t12 until fracture opening is detected by acoustic emissions AE, borehole diameter measurements U, packer volume V and packer pressure P (Stage 5, FIG. 4*g;* time t12, FIG. 5). This completes the first-cycle fracture opening to stage 5 at packer inflation pressure 2 Pb.

To improve measurement statistics, the complete cycle (from times t6 to t12) or any subcycle, e.g., times t6–t8 or t10–t12, may be repeated one or more times. Pressurization can continue beyond time t12 to extend the stage 5 fractures. The key parameters to determine are the fracture orientations (which give the stress directions), the breakdown pressures 1 Pb and 2 Pb, and the re-opening pressures 1 Pro and 2 Pro. (Pressure 2 Pro is the re-opening pressure for the Stage 5 fractures, obtained by extending pressurization beyond time t12, not illustrated.) Breakdown pressures can only be measured once, but statistics can be obtained on re-opening pressure data by cycling pressure in the packers within appropriate ranges. For re-opening primary fractures (e.g., fracture 402, FIG. 4*e*), pressure cycles are greater than or equal to borehole pressure and less than or equal to pressure 2 Pb, the initiation pressure of secondary fractures. For re-opening secondary fractures, the pressure cycles between the borehole pressure and greater than or equal to pressure 2 Pb. The lower bound on reopening pressures for secondary fractures does not have to be as low as borehole pressure. One may wish to cycle between any pressure below the reopening pressure 2 Pro and a pressure greater than 2 Pro. Pressure must be greater than 2 Pro to reopen the secondary fractures. Pressure 2 Pro can be determined in the same manner as pressure 1 Pro was determined, the only difference being the packer pressure cycle. Borehole displacement measurements are used to identify at what pressure the secondary fracture opens and closes.

The direction of the least principal horizontal stress Sh of bed 310 is determined from oriented borehole deformation measurements. Measurements of stress/rheology module 300 are made relative to a sonde coordinate system. The gravitational and magnetic field measurements of orientation module 132 relate the sonde coordinate system to geographic coordinates, so that the geographic orientation of stress magnitudes and rock anisotropy can be determined.

Fracture orientation may be determined at any time while the fracture is propagating during pressurization between P=1 Pb and P<2 Pb. Fracture orientation is determined by calculating the principal displacements from the multitude of oriented displacement measurements (for example, from measured borehole diameters U1, U2 and U3, shown as separate lines in FIG. 5 from late Stage 2 and before Stage 5). In an isotropic formation, the direction of maximum principal stress is parallel to the least principal displacement, and the direction of least principal stress is parallel to the maximum displacement, i.e., in the direction of fracture opening. If the fracture changes direction while it is extending (t7 to t8, FIG. 5), the principal displacements will rotate. Fracture orientation away from the borehole may indicate the true far-field stress direction. This direction may or may not be different than the initial fracture azimuth determined at time t3.

Fracture orientation is determined from inversion of the radial displacements vs. angle data. For a vertical fracture in a vertical borehole, three diameters measured at 120 degree angular separation are sufficient to determine the fracture azimuth. V. HOOKER et al., IMPROVEMENTS IN THE THREE-COMPONENT BOREHOLE DEFORMATION GAGE AND OVERCORING TECHNIQUES, Report of Investigations 7894, U.S. Bureau of Mines, 1974. In deviated holes, where the borehole axis does not lie in a plane defined by the induced fracture, a multitude of azimuth caliper measurements made at multiple locations along the axis of the tool may be needed to determine fracture orientation. Fracture orientation may be computed in real time or may be determined after testing from recorded data. This discussion of far-field fracture azimuth pertains to hydraulic fractures (e.g., as in Section B below) where fluid pressure is acting over the entire fracture surface. It applies to a situation where the caliper inside the packer or inside a straddle interval (Section B below) is recording while a hydraulic fracture is extending as in the case of open-hole stress testing. Monitoring fracture rotation is less important for packer fracturing since these fractures do not extend far from the borehole.

Figure 6A:
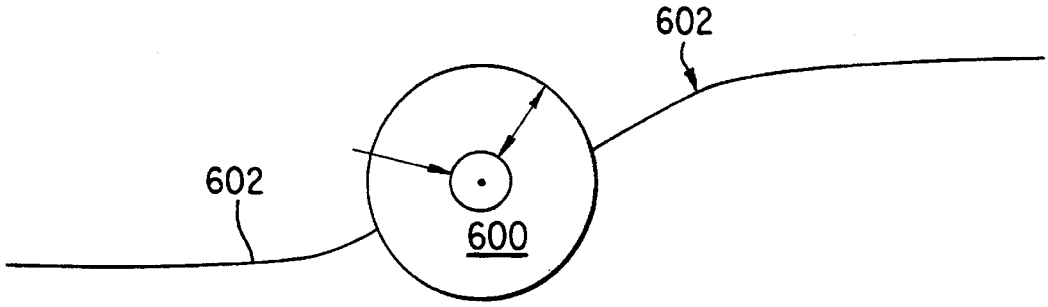
FIGS. 6*a* through 6*c* illustrate a method of determine far-field fracture azimuth from measurements made with various embodiments of the sonde of FIG. 1 in accordance with the present invention.
Figure 6B:
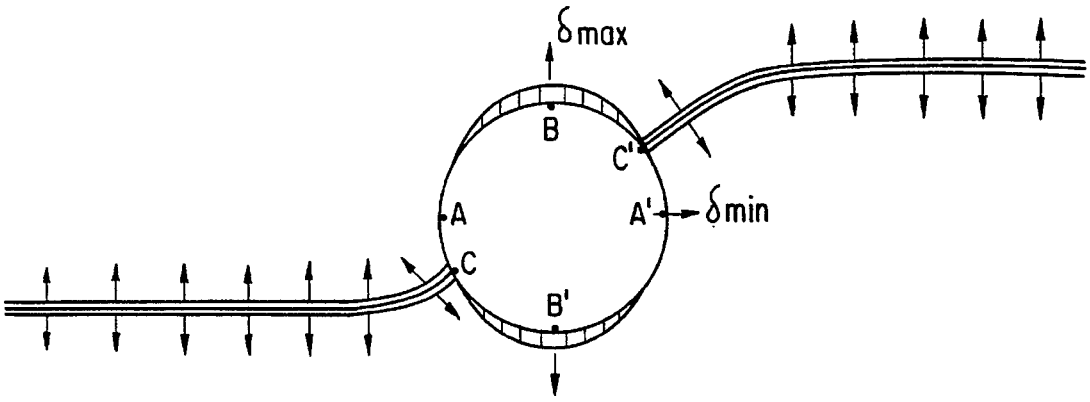
Figure 6C:
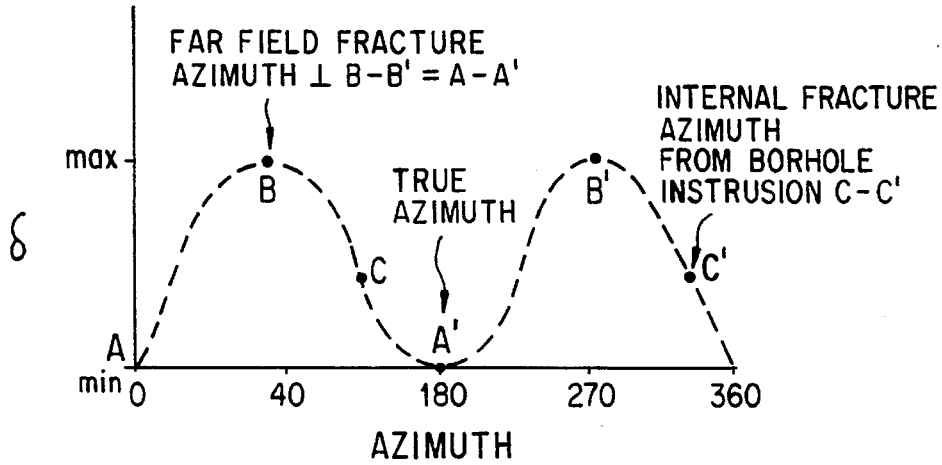
Figure 7A:
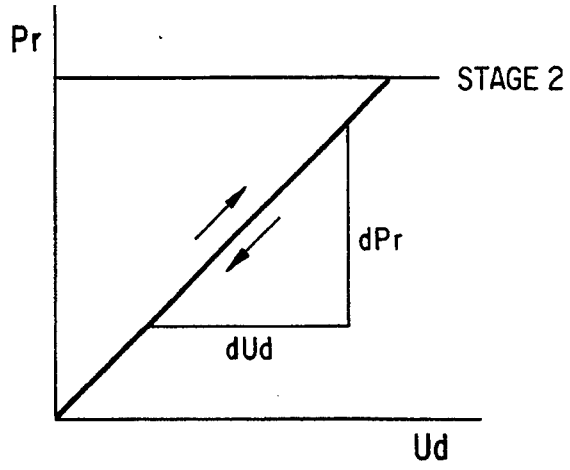
FIGS. 7*a* through 7*f* show examples of stress-strain responses of formation rocks of various types, illustrating operation of sonde embodiments in accordance with the present invention.
Figure 7B:
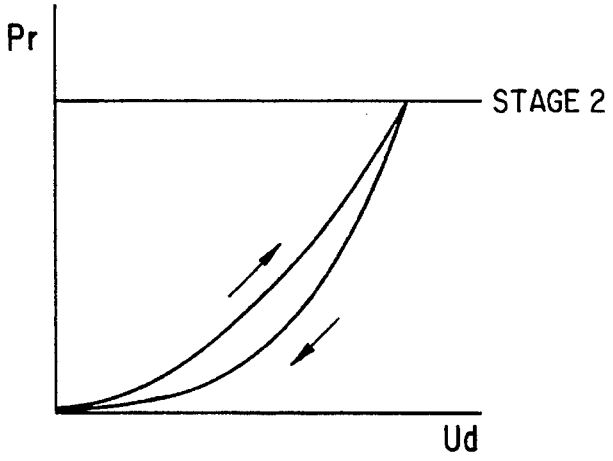
Figure 7C:
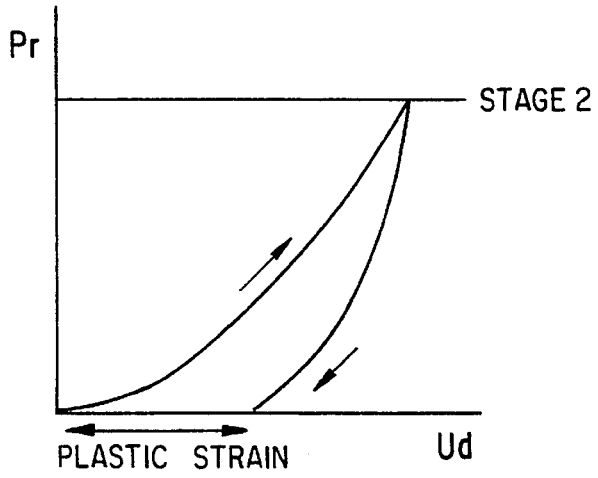
Figure 7D:
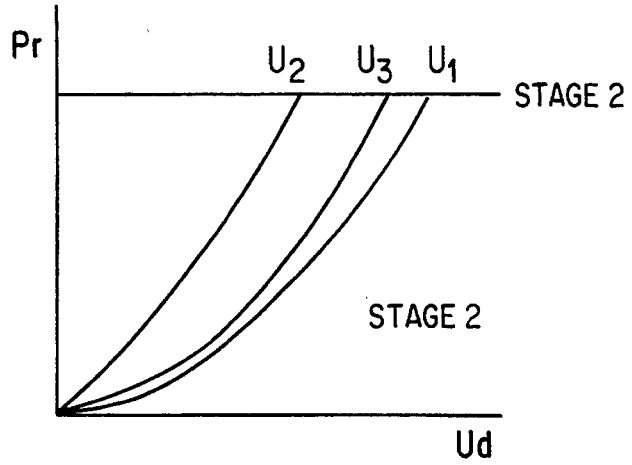
Figure 7E:
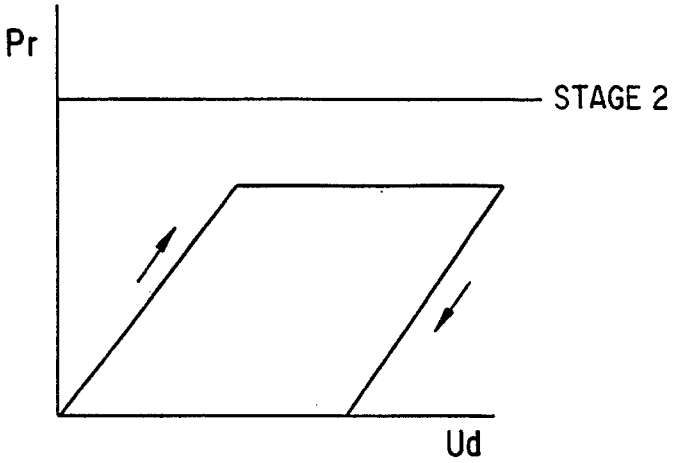
Figure 7F:
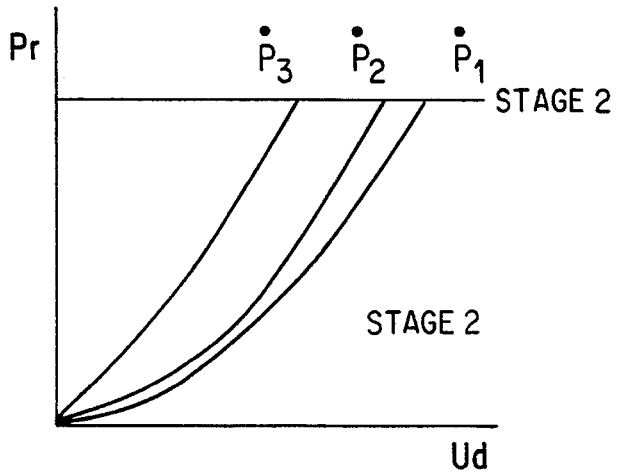

As shown in the example of FIG. 6*a*, the azimuth of a fracture 602 as it intersects a borehole 600 may not be the same as the far-field azimuth of formation fracture. Fractures produced in anisotropic rock or in rocks subjected to low deviatoric stress may rotate as they propagate away from the wellbore. (Deviatoric stress is the magnitude of the differences between principal stresses, e.g., $|\sigma_1-\sigma_3|$, $|\sigma_1-\sigma_2|$, $|\sigma_2-\sigma_3|$, where the principal stresses are $\sigma_1$, $\sigma_2$ and $\sigma_3$.) The azimuth of the anisotropic wellbore displacement field can be used to determine the far-field fracture azimuth. This is because the borehole displacement field is controlled by the orientation of the entire pressurized fracture-face, rather than the fracture azimuth at the wellbore. In essence, the azimuth of greatest diameter change when the fracture is opened is normal to the average fracture azimuth. As shown in FIGS. 6*b* and 6*c*, the radial borehole displacement field $\delta(P, \theta)$ is measured. The azimuth $\theta$ corresponding to the greatest value of $\delta$ (that is, the azimuth $\theta$ corresponding to $\delta_{max}$ is perpendicular to the far-field fracture azimuth. The direction is obtained from the plot of $\delta$ vs. $\theta$ shown in FIG. 6*c*. This discussion of far-field fracture azimuth pertains to hydraulic fractures where fluid pressure is acting over the entire fracture surface.

It applies to a situation where a caliper or other borehole deformation device (within or adjacent to the packer or in a straddle interval) is recording while a hydraulic fracture is extending as in the case of open-hole stress testing. Monitoring fracture rotation is less important for packer fracturing (e.g., using a packer to fracture the rock as in the sonde configuration of FIGS. 2A, 2B and 3A) since these fractures do not extend far from the borehole.

For purposes of determining in-situ formation stress, it is preferred to propagate a fracture of small diameter and limited spatially. For a single fracture, packer pressure must be kept below the pressure at which an orthogonal set of fractures develops (Stage 5 FIG. 4*g;* see also Serata U.S. Pat. No. 4,733,567). The radial and axial extent of fracturing will be small because of loading conditions; see W. WARREN, PACKER INDUCED STRESSES DURING HYDRAULIC FRACTURING, report no. SAND-79-1986, Sandia Laboratories, Albuquerque, N.Mex., 1979. Fracture extent is determined by rock properties and packer pressure. No fractures will be formed if the rock is not deformed in the brittle field. As the brittle ductile transition of clean sandstones is known, which beds are in the brittle field can be predicted in advance. Beds in the brittle field are of material which deforms by fracturing on a scale large compared to grain size; the brittle field is defined by strain rate, in-situ stress, and temperature.

Stress magnitudes can be determined from the pressure data using several methods after contact pressures are obtained from packer pressures. See, for example, C. LJUNGGREN et al., *Sleeve fracturing—A borehole technique for in-situ determination of rock deformability and rock stresses,* PROCEEDINGS OF THE INTERNATIONAL SYMPOSIUM ON ROCK STRESS AND ROCK STRESS MEASUREMENTS, Stockholm, 1–3 September 1986, pp. 323–330; Serata U.S. Pat. No. 4,733,567; PH. CHARLEZ et al., *A new way to determine the state of stress and the elastic characteristics of rock massive,* PROCEEDINGS OF THE INTERNATIONAL SYMPOSIUM ON ROCK STRESS AND ROCK STRESS MEASUREMENTS, Stockholm, 1–3 September 1986, pp. 313–322; R. PLUMB, The *Correlation Between the Orientation of Induced Fractures with In-Situ* Stress or Rock Anisotropy,in HYDRAULIC FRACTURING STRESS MEASUREMENTS, National Academy Press, 1983, pp. 221–234; and W. WARREN, PACKER INDUCED STRESSES DURING HYDRAULIC FRACTURING, report no. SAND-79-1986, Sandia Laboratories, Albuquerque, N.Mex., 1979. All pressures used in calculation, such as 1 Pb and 1 Pro, represent contact pressures. See FIG. 5, Stages 3 to 4, times t4–t7. Breakdown pressure is related to the maximum and minimum horizontal principal stresses, SH and Sh respectively, by the Hubbert and Willis breakdown equation:

$$P_b=3Sh-SH+T-P_p$$

where T is the tensile strength and $P_p$ is the pore pressure of the rock. Tensile strength T is measured by the difference:

$$T=Pb-1\ Pro$$

M. HUBBERT et al., *Mechanics of Hydraulic Fracturing,* PET. TRANS. AIME, Vol. 210, 153–166, 1957. For a sufficiently long fracture, the method of Ljunggren and Stephansson, 1986, may be used to determine Sh from nPro, where n is greater than 1 and the fracture has been extended as far as possible without generating the second orthogonal set of fractures as in the method of Serata U.S. Pat. No. 4,733,567. Stage 5, FIG. 4*e* shows the initiation of secondary fractures.

A second approach is to invert displacement data Ur(θ, P) for principal stress magnitudes. According to the method of PH. CHARLEZ et al., 1986, re-opening pressures can be used to calculate principal stresses where in-situ stresses satisfy the condition:

$$\sigma_1<3\sigma_2$$

where $\sigma_1$ is the maximum principal stress and $\sigma_2$ is the least principal stress in the plane perpendicular to the borehole. This condition is satisfied for most of the major oil producing basins world-wide. Fractures will be open at the borehole wall if this condition is not satisfied. If the borehole is pressurized such that the fracture opens but does not propagate, using linear elasticity, the borehole displacements can be calculated from:

$$U(\theta)=F(\sigma_1, \sigma_2, P, R, L, E, \upsilon, \theta)$$

where θ is angular position around the borehole referenced to geographic coordinates using orientation module 132, P is the borehole pressure, R is the borehole radius, E is Young's modulus, υ is Poisson's ratio, and L is the fracture length. Given knowledge of the function F, measurements of U(θ) can be inverted for the magnitude and direction of in-situ stress, and fracture length. The number of measurements depends on the number of unknowns for which one is to solve. In practice, this problem is solved numerically. (See PH. CHARLEZ et al., 1986.)

A third option for determining stress magnitudes is the method of Serata U.S. Pat. No. 4,733,567, using breakdown pressures 1 Pb and 2 Pb in conjunction with the well-known elasticity solution for the stress concentration, $\sigma_\Theta$, around the surface of a hole in a stressed medium. Consider the stress concentration at the azimuth (call it θ=0) where the first fracture forms (FIG. 4*c*):

$$\sigma_\Theta(\theta=0)=3\ \sigma_2-\sigma_1+T-P_p$$

and the stress concentration at the azimuth (θ=90) where the second fracture forms (FIG. 4*g*):

$$\sigma_\Theta(\theta=90)=3\ \sigma_1-\sigma_2+T-P_p$$

At fracture initiation:

$$\sigma_\Theta(\theta=0)=1\ \text{Pb}$$

$$\sigma_\Theta(\theta=90)=2\ \text{Pb}$$

$P_p$ is the pore pressure measured using the pre-test and T is tensile strength determined from:

$$T=Pb-Pro$$

The principal stresses can be obtained by solving the simultaneous equations:

$$Pb=3\ \sigma_{2-\sigma 1}+T-P_p$$

$$2\ Pb=3\ \sigma_1-\sigma_2+T-P_p$$

where 2 Pb is the breakdown pressure at θ=90, not twice the breakdown pressure at θ=0.

The formation breakdown pressure Pb (pressure at which the rock fractures) can be determined from simultaneous measurements of:

packer inflation pressure vs. time (Pi(t), FIG. 5), packer inflation-fluid volume vs. time (Vp(t), FIG. 5), where Vp is the packer volume, radial packer displacement of rock or rock-packer interface vs. packer pressure (Ur(θ,P)) or time (Ur(θ, t), FIG. 5), where Ur=Ui, i=1, 2, 3, . . . , and/or the number and frequency content of acoustic emissions vs. time (AE(t), FIG. 5). See stage 3 at time t3, FIG. 5.

The most definitive determination of the formation breakdown is obtained when a number of coincident measurement signals are analyzed. At formation breakdown, a short, unstable fracture forms having a radial extent which is less than the borehole diameter (Stage 3, FIG. 4*c*). When the fracture forms, the deformation modulus of the rock decreases and the rock anisotropy increases. Associated with the decreased formation stiffness is an increase in packer volume and a simultaneous decrease in the rate of increase in packer pressure. A measure of dV/dP is a more sensitive indication of breakdown. The number of acoustic emissions (AE) will typically peak during fracture initiation. Amplitude and frequency content of the AE signals help discriminate small-scale microfracturing from larger scale rupture, e.g., coalescence of microfractures leading the macroscopic fracture (FIG. 5, stage 3).

Symbols used here are defined as follows:

Pi internal packer pressure $P_p$ pore pressure

Pb breakdown pressure in the direction of $\sigma_1$ ($\theta$=0)

2 Pb breakdown pressure in the direction of $\sigma_2$ ($\theta$=90)

$P_n$ nth pressurization rate dP/dt

U displacement perpendicular to the tool axis (same as Ur)

Ui ith radial displacement measurement, i=1, 2, 3, . . . . The i displacement 1.5 measurements are displaced by an angle $\theta$. The magnitude of angle $\theta$ depends on the number of displacement sensors. Typically, i=6 and $\theta$= 60 degrees.

Ud diameter displacement equals the sum of two diametrically opposed radial displacements, $\theta$=180 degrees.

$P_r$ Pressure normal to the borehole surface corrected for packer stiffness. $P_r$ is slightly less than Pi (see W. WARREN, 1986).

V Packer volume

AE Acoustic emissions $\sigma_1$ maximum principal stress $\sigma_2$ intermediate principal stress $\sigma_3$ least principal stress SH maximum horizontal stress, a far-field earth stress component which may equal $\sigma_1$ or $\sigma_2$.

Sh minimum horizontal stress, a far-field earth stress component which may equal $\sigma_2$ or $\sigma_3$.

The ability to maintain an opening (a well borehole) deep underground can depend on the accurate identification of rock rheology. Stress-strain behavior of rock cannot be measured at great depth by prior-art borehole logging methods, so expensive rock cores have until now been required to provide the necessary mechanical data about the rock. With the present invention, anisotropy and rheology of the formation rock can be determined from the slope and curvature of radial displacement (Ud) vs. pressure (Pr) curves. Examples of such rock responses are shown in FIGS. *7a–7f*.

If a rock property such as strength or modulus varies with direction, the rock is anisotropic. In subsurface formations, bedding planes and fractures are the usual fabric elements which cause a rock to be anisotropic. Rheology is a description of the deformation and flow characteristic of a material. The degree of anisotropy and the rheological classification of rock are known to depend on stress level and loading rate (e.g. dP/dt). For lack of data, many engineering calculations assume that rocks are isotropic linear elastic materials.

A series of load-unload pressure cycles will indicate the general rheological character of the formation. To determine intrinsic mechanical properties, load-unload cycles are performed in stage 2, at pressures below Pb (FIG. 5). The load-unload cycles are preferably performed over a range of loading rates (e.g. dP/dt) using energy stored in an accumulator, such as in accumulator module 130 (FIG. 3A). Use of an accumulator overcomes the limited performance of downhole pumps. The provision of orientation module 132 (FIG. 3A) in accordance with the invention allows the direction of anisotropy to be determined, in contrast to the methods and apparatus of Serata U.S. Pat. 4,733,567.

FIG. *7a* illustrates how the shear modulus is determined. The curve shows the response of an idealized isotropic linear elastic formation, e.g.. the slope of the curve (dPr/dUd) is constant, the rock unloads along the loading curve, and the slope is not dependent on azimuth.

FIG. *7b* shows the response of an idealized isotropic non-linear elastic formation, e.g. the slope of the graph is not constant, the rock loads and unloads along different curves, there is no permanent strain when unloading is completed, and the load-unload curves are independent of azimuth.

FIG. *7c* shows the response of an idealized isotropic non-linear inelastic formation, e.g., the slope of the graph is not constant, the rock loads and unloads along different curves, there is permanent strain when unloading is completed, and the load-unload curves are independent of azimuth.

FIG. *7d* shows loading curves for an idealized, anisotropic, non-linear elastic formation, e.g.. the slope of the graph is not constant, the rock loads and unloads along different curves in each direction, and there is no permanent strain when unloading is completed, but the load-unload curves are dependent on azimuth. Unloading curves are not shown in FIG. *7d* for simplicity of illustration (the loading-unloading curve for each azimuth would be similar to the curve of FIG. *7b*).

FIG. *7e* shows the response of an idealized isotropic linear elastic—perfectly plastic formation, e.g., the slope of the graph is constant up to the flow stress, at which point the rock strains without input of additional stress. The rock unloads along the elastic loading curve, but there is a significant non-recoverable plastic strain.

FIG. *7f* shows the response of a strain-rate sensitive material. For clarity, an isotropic (no azimuthal dependence), non-linear (dP/dU is not constant) material is illustrated. Such a material typically has higher modulus (dP/dU) at higher loading rates (dP/dt), e.g., a fluid-saturated, porous, permeable rock. At high loading rates (dP/dt), the fluid does not flow and the modulus of the composite rock frame plus fluid is measured. This is the so-called un-drained response of the material. At loading rates slow compared to the rate of diffusion of pore fluid, the modulus is lower. In the low rate limit the modulus of the rock frame is measured. This is the so-called drained response of the material. The strain-rate sensitivity of the formations' deformation modulus may be determined by repeating load-unload cycles as described above at different pressurization rates (dP/dt).

The repeated load-unload cycles are preferably performed using a charged accumulator to deliver energy at rates not deliverable with a down-hole pump due to the limited power transmission capability of wireline cable 104. Energy stored in the accumulator is discharged into the packer through controllable valve 314 (FIGS. 3A and 3B) so as to deform the rock at a controlled rate.

After the testing sequence is completed for a first formation bed, packer 312 is deflated and sonde 100 is displaced along the borehole axis to place the packer at a location of the borehole passing through a second predetermined bed. After the testing sequence is repeated for the second bed, packer 312 is deflated and sonde 100 is again moved for investigation of a further bed, and so on. Pore pressure is a fundamental quantity required for nearly all stress and rock strength calculations. The sonde configuration of FIG. 3A may be used to perform a pressure draw down pre-test of the formation. Pre-test is performed after probe 324 is set, before deforming the formation rock, either for the rheology test or for fracturing. Fluid is withdrawn at a constant rate from the formation via probe 324 and valve 332 and pressure at gauge 330 is recorded vs. time (see FIG. 3B). After draw-down, the pressure at gauge 330 is recorded vs. time as fluid from the formation re-pressurizes flowline 202. The equilibrium pressure is pore pressure, which is needed to calculate stresses from breakdown pressures (e.g., the Hubbert and Willis equation) and to compute effective stresses from total stresses measured by sonde 100. Drawdown and buildup permeabilities can also be computed from the recorded data. The method of U.S. patent application Ser. No. 07/761,213, now U.S. Pat. No. 5,269,180, of Dave et al.

can be applied to compute injection permeability from slow-rate injection.

Figure 15:
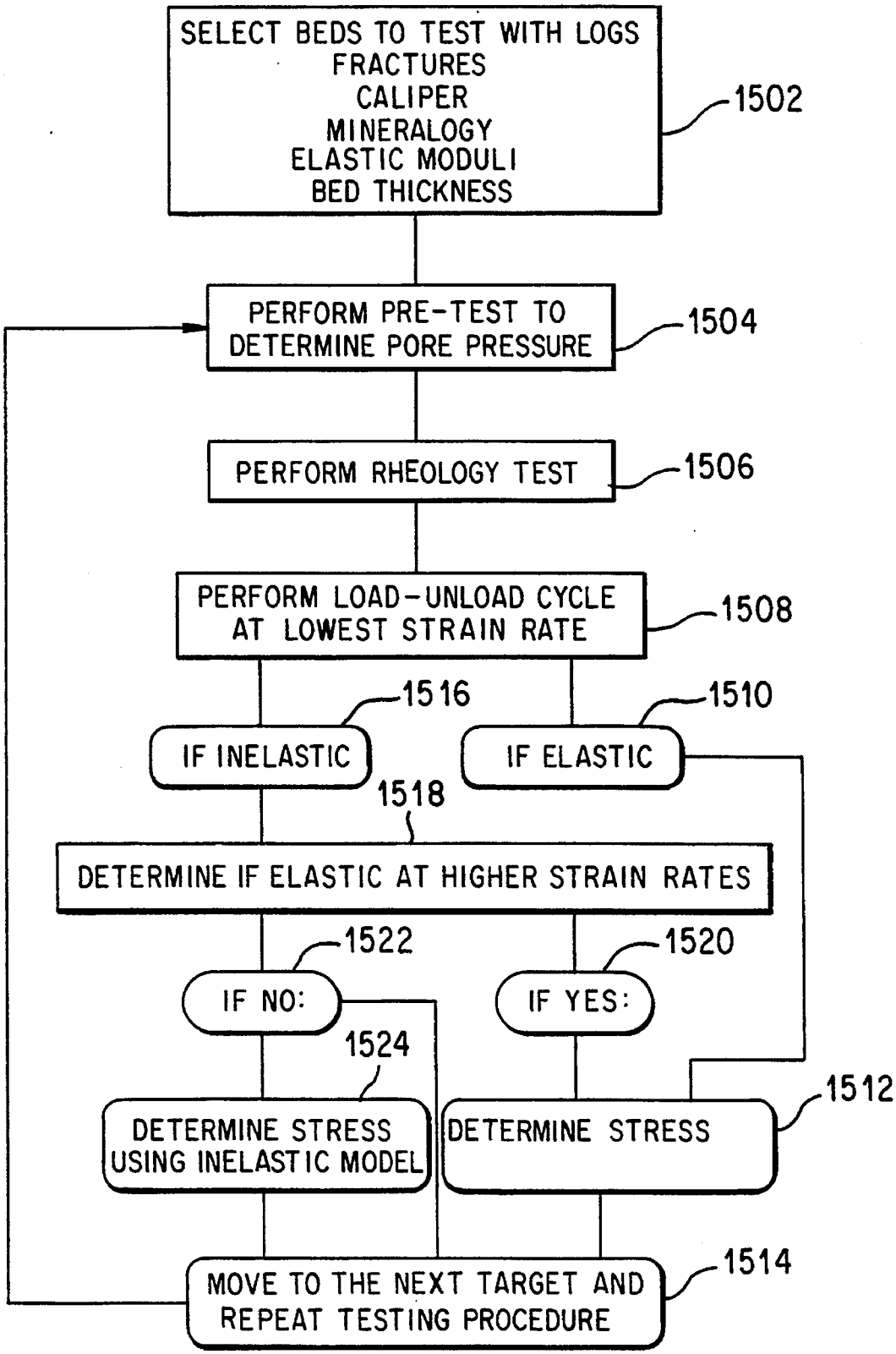
FIG. 15 illustrates an exemplary stress-testing sequence in accordance with the present invention using either the open-hole, single-packer sonde configuration of FIGS. 2A, 2B and 3A, or using the open-hole hydrofracturing sonde configuration of FIGS. 2A, 2B and 8A.

FIG. 15 illustrates an exemplary stress-testing sequence using either the openhole, single-packer sonde configuration just described, or using the open-hole hydrofracturing sonde configuration described in Section B. below. It is desired to determine whether the rock is elastic. If it is elastic at low strain rate, that is enough. If the rock appears to be sufficiently inelastic to conduct a fracture at the lowest rate, then higher loading rates are used. Beds to be tested are selected at step 1502 from existing data about the formation (e.g., from previous borehole logs), such as fractures, caliper readings, mineralogy, elastic moduli and bed thickness. After the sonde is positioned at a bed of interest, a pre-test is performed in step 1504 to determine pore pressure. A rheology test is performed at step 1506, using a series of load-unload cycles at pressures below 1 Pb (FIG. 5, Stage 2). The rheology test is terminated at yield pressure. Yield pressure is indicated by the slope of the pressure-displacement graph (dP/dU). Yield occurs at a high pressure above the elastic region where the slope dP/dU decreases from the constant linear slope characteristic of the elastic region. In step 1508, a load-unload cycle is performed at lowest strain rate, and a determination made whether the formation is elastic or inelastic. If elastic (step 1510), stress is determined in step 1512. The sonde is then moved to the next target and the testing procedure is repeated (step 1514). If inelastic (step 1516), a determination is made whether the formation is elastic at higher strain rates (step 1518) by performing load-unload cycles at higher strain rates. Strain rates cannot be specified a priori; the subsequent test rates depend on the results of the first test. Constraints on the choice of rates include the loading rate limitations of the tool, and the magnitude of borehole deformation. If yes (step 1520), stress is determined at the indicated higher strain rate. Stress is determined using, e.g., methods as described herein. For hydrofracturing it comprises measuring Pb, Pro, closure pressure and pore pressure, and calculating SH from the breakdown equation. For packer fracturing it comprises measuring pore pressure, 1 Pb, Pro and 2 Pb, and calculating stresses from simultaneous solution of the two breakdown equations, e.g., using Serata's method. If no (step 1522), stress may optionally be determined using an inelastic model (step 1524) before moving the sonde to the next target and repeating the testing procedure (step 1514).

B. Open Hole Hydrofracturing Configuration

Figure 8A:
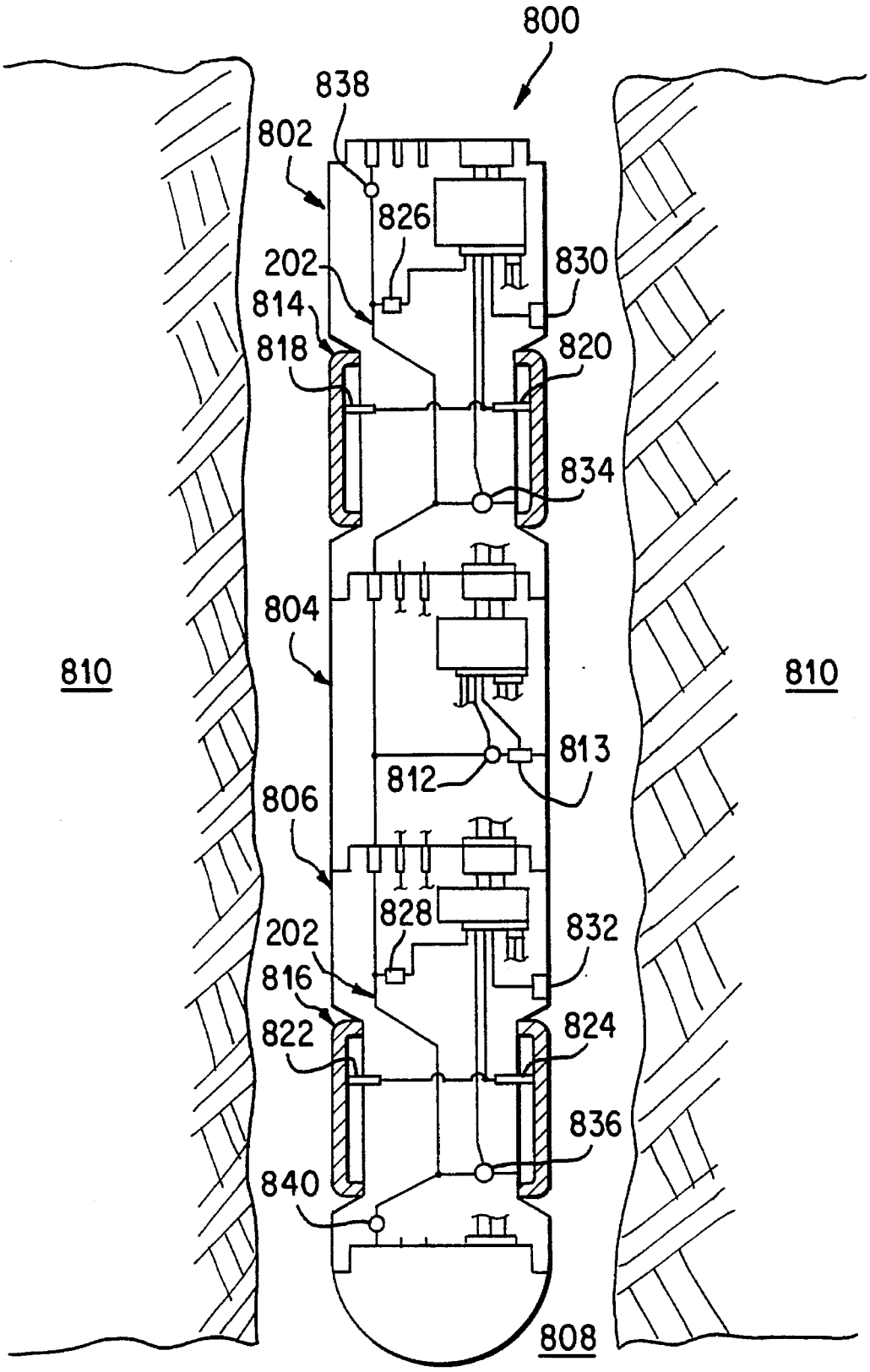
FIG. 8A is a schematic illustration of a second preferred embodiment of a stress/rheology module of the sonde of FIG. 1 in accordance with the present invention.

FIG. 8A shows schematically at 800 a second preferred embodiment of a stress/rheology module S for use with modules of FIGS. 2A and 2B and, optionally, other modules. Sonde 100, including module 800, is shown positioned in a borehole 808 traversing an underground formation such that module 800 is within a portion of the borehole passing through a predetermined bed 810.

Pressure equalization lines and other conventional straddle packer features are not shown for clarity of illustration.

As illustrated, stress/rheology module 800 comprises a pair of packers forming a straddle packer assembly with a selectable straddle interval. That is, an upper packer module 802 having an inflatable packer 814 and a lower packer module 806 having an inflatable packer 816 are joined by an interval module 804. The length of interval module 804 is selected when making up sonde 100 to attain a desired straddle interval length between the packers. One (or both, as illustrated) of packer modules 802 and 806 may be constructed in the manner of packer module 302 (FIG. 3A) with instrumentation for detecting radial packer deformation (sensors 818, 820, 822, 824, etc.), packer pressure (gauges 826, 828), packer inflation volume, and acoustic emissions (sensors 830, 832). Controllable valves 834 and 836 control fluid communication between flowline 202 and packers 814 and 816 for inflation and deflation of the packers. Controllable valves 838 and 840 control flow in flowline 202. Controllable valve 812 controls communication between flowline 202 and the straddle interval. A pressure sensor 813 measures pressure in the straddle interval.

Figure 8B:
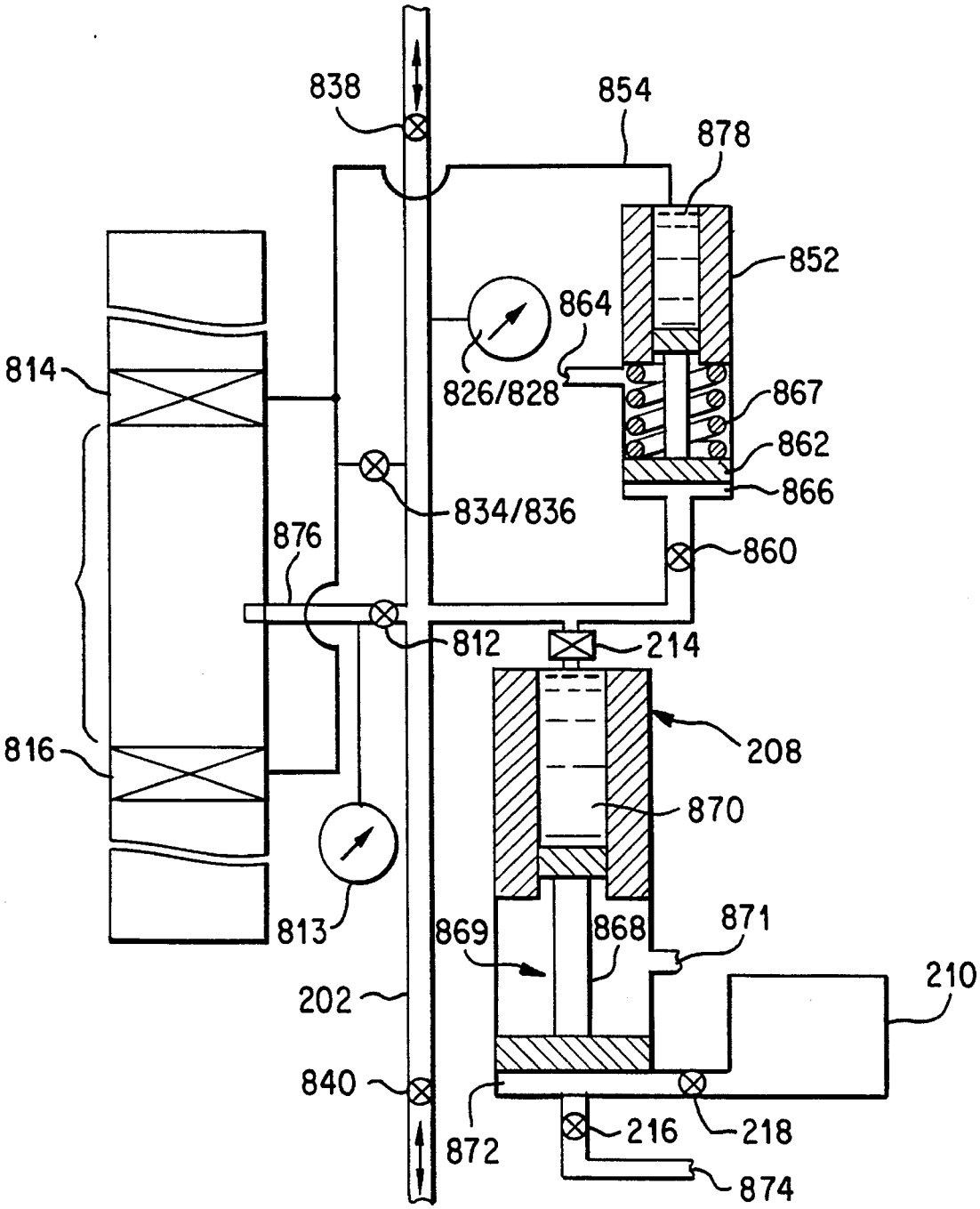
FIG. 8B is a simplified flowline schematic of the sonde embodiment of FIGS. 2A, 2B and 8A, including a packer auto-deflation system.

FIG. 8B shows a simplified flowline schematic of the sonde configuration illustrated in FIGS. 2A, 2B and 8A, and further illustrates an auto-deflation system for packers 814 and 816 comprising a hydraulic piston assembly 852, hydraulic line 854, and controllable valves 834/836 and 860. Hydraulic line 854 communicates with packers 814 and 816. Piston assembly 852 comprises a spring-loaded, double-ended piston 862 in a cylinder having a central portion open at 864 to borehole pressure. The auto-deflation system is illustrated in a de-energized condition, with spring 867 extended.

Operation of portions of this configuration of sonde 110 is as follows:

1. Before inflating packers 814/816, the auto-deflation system is energized by opening valves 838 and 860, closing valves 834/836, and pumping fluid from pumpout module 124 (or from pump 112) through valve 860 into chamber 866. The fluid may be borehole fluid, fluid from a sample chamber of sonde 100, or fluid supplied from the surface via coiled tubing 110. When piston 862 has been moved upwardly to compress spring 867, valve 860 is closed, and valves 834/836 are opened for packer inflation.

2. Piston 868 of intensifier 208 is re-set to the position illustrated in FIG. 8B by closing valves 218, 860, 834/836 and 812, opening valves 214 and 216, and pumping fluid into chamber 870 to move piston 868 downwardly. Fluid in chamber 872 is thereby discharged to the borehole via valve 216 and line 874. Chamber 869 is open to borehole pressure via line 871

3. Borehole fluid pressure may be used to activate intensifier 208 by closing valves 838, 840 and 218, and opening valves 214 and 216. Borehole pressure at line 874 causes piston 868 to move upwardly, and the energy may be discharged through valves 834/836 (for inflation of packers 314/316) or through valve 812 (for discharge of fluid into the straddle interval through line 876).

4. Energy from accumulator chamber 210 may be discharged by closing valves 838, 840 and 216, opening valves 214 and 218, and opening either valves 834/836 (for inflation of packer 814/816) or valve 812 (for discharge of fluid into the straddle interval through line 876).

5. Packers 814/816 may be inflated using pumpout module 124, by closing valves 840 and 812 and opening valves 838 and 834/836.

6. Packers 814/816 may be deflated using pumpout module 124 in reverse operation to pump fluid from the packers, e.g., to the borehole or to a sample chamber, via valves 834/836 and 838. The auto-deflation system may also be used for deflation of packers 814/816 by opening valve 860 to allow piston 862 to move downwardly to withdraw fluid from packers 314/316 into chamber 878.

7. The formation can be pressurized using pumpout module 124 to pump borehole fluid into the interval via valves 838 and 812 after packers 314/316 are inflated. The pressure and flow-rate are limited by the power transmission capability of wireline 104 (about 1 kw maximum) if pumpout module 124 is electrically powered. The formation can be pressurized at higher pressures and flow-rates using fluid pressure from pump 112 (FIG. 1) supplied via coil tubing 110 and valves 838 and 812. The formation can also be pressurized at higher pressures and flow-rates using energy stored in accumulator 210 and supplied via valve 218, intensifier 208, and valves 214 and 812. Energy from accumulator 210 can be used alone, or simultaneously with pumpout module 124, or as a boost after pumpout module 124 has reached its pressure capacity.

8. Formation fluid flow or pressure from sonde 100 can be isolated by closing valve 812.

9. Fluid can be pumped back from the formation via valve 812 to a sample chamber, or to the borehole above or below the straddle interval, using pumpout module 124 in reverse mode. Fluid may be allowed to flow back from the formation at a controlled rate via valves 812 and 838 using pumpout module 128 connected in series with flow control module 122.

In operation, module 800 is set in the borehole with the straddle interval between the packers positioned in a bed 810 of interest as illustrated in FIG. 8A. Packers 814/816 are inflated to isolate the straddle interval. A pressure draw down pre-test is performed a) to ensure that a good packer seal has been achieved and b) to measure pore pressure. The pressure pre-test is performed as a series of steps which (1) ensure a good packer seal by creating a pressure drop in the flow line, (2) inject fluid into the formation, (3) measure pore pressure, formation pressure and/or (4) inject clean fluids sequentially to measure formation characteristics (e.g., wettability). Pre-test is performed before deforming the formation rock, either for the rheology test or for fracturing. Packer inflation pressure and the pressure in the straddle interval are monitored to determine a good packer seal; when a good seal is achieved tile interval pressure will follow the packer pressure. Fluid is withdrawn at a constant rate from the formation via line 876 and valve 812 and pressure at gauge 813 is recorded vs. time (see FIG. 8B). After draw-down, tile pressure at gauge 813 is recorded vs. time as fluid from the formation re-pressurizes flowline 876.

If the equilibrium pressure is another other than hydrostatic head, it is taken as pore pressure. As a check, a pressure build-up test is run and the interval pressure monitored vs. time; pore pressure should be the same for both the draw-down and build-up tests. Pore pressure is needed to calculate stresses from breakdown pressures (e.g., the Hubbert and Willis equation) and to compute effective stresses from the total stresses measured by sonde 100. Pore pressure from the pre-test is attempted before deforming the formation rocks, either for rheology test or for fracturing. Draw-down and buildup permeabilities can also be computed from the recorded data. The method of U.S. patent application Ser. No. 07/761,213, now U.S. Pat. No. 5,269,180, of Dave et al. can be applied to compute injection permeability from slow-rate injection. If the formation does not respond to a pre-test, sonde 100 is preferably re-positioned with the straddle interval in front of fractures intersecting the borehole and a draw-down pre-test conducted. If no pore pressure can be measured, the test procedure is continued and rheology (optional but desirable) and stress are measured by either the packer fracturing method (see Section A. above) or with hydraulic fracturing (described below).

After the pre-test, a determination is made from bed thickness if sonde 100 should be repositioned. Beds of interest may be too thin to make all measurements in the desired bed without moving sonde 100, as instrumented packers 314/316 are located above and below the straddle interval. (Pore pressure is measured in the straddle interval, while rheology is measured at the packer location(s).) Sonde 100 may therefore have to be re-positioned if the rocks opposite the packers are different than those in the straddle interval.

Rock rheology is determined as described with reference to FIGS. *7a–7e*. A series of load-unload pressure cycles will indicate the general rheological character of the formation. To determine intrinsic mechanical properties, load-unload cycles are performed at pressures below formation breakdown pressure, Pb. The load-unload cycles are preferably performed over a range of loading rates (e.g. dP/dt) using energy stored in an accumulator, such as in accumulator module 130. The provision of orientation module 132 (FIG. 3A) in accordance with the invention allows the direction of anisotropy to be determined.

The instrumented packer(s) can be used to obtain more accurate stresses from a hydro-fracturing test. A rheology test will indicate whether hydrofracture interpretation models based on elasticity are valid. In porous and permeable elastic formations, the breakdown pressure obtained by fracturing the formation with a packer is more accurate than measuring breakdown pressure with a fluid. In highly permeable formations, high loading rates may be needed to fracture the formation. The required rates can be determined by a loading rate test (FIG. *7f*). A loading rate test will show that inelastic stress models will be needed if the rocks do not exhibit brittle behavior at deliverable rates.

A method of operation in a typical low-permeability rock is as follows:

1. Select bed and set sonde 100 in a target bed of the formation (Step 1502, FIG. 15);

2. Measure pore pressure (step 1504, FIG. 15);

3. Conduct rheology test (FIGS. *7a–7f* & step 1506, FIG. 15);

4. If elastic, fracture the formation with a packer (Stage 3, FIG. *4c*);

5. Determine fracture re-opening pressure (FIGS. *4d–4e*);

6. Move sonde, set packers to isolate straddle interval, and inject fluid into packer-induced fracture (fluid volume designed to keep fracture within bed of interest);

7. Determine fracture closure stress;

8. Calculate maximum principal stress from model of formation breakdown pressure (e.g., the Hubbert and Willis equation).

A method of operation in a high-permeability rock is as follows:

1. Select bed and set sonde 100 in a target bed of the formation (Step 1502, FIG. 15);

2. Measure pore pressure (step 1504, FIG. 15);

3. Conduct rheology test (FIG. 7 & step 1506, FIG. 15);

4. If inelastic, conduct a loading rate test (FIG. *7f*) (high loading rates will require use of accumulator 210 or pump 112 and coiled tubing 110)

5. If rock is brittle at higher loading rate, proceed as in the method given above for typical low-permeability rock.

Another method of operation in a high-permeability rock is as follows:

1. Select bed and set sonde 100 in a target bed of the formation (Step 1502, FIG. 15);

2. Measure pore pressure (step 1504, FIG. 15);

3. Conduct rheology test (FIG. 7 & step 1506, FIG. 15);

4. If rock is elastic-plastic (FIG. 7*e*), determine stress using inelastic models.

After completing the pre-test procedure and rock rheology measurements, rock stress measurements are conducted. Fracturing is performed using an instrumented packer (e.g., packer 814) as in the open hole single packer fracturing methods described in Section A with reference to FIGS. 3A–6, and/or open-hole hydraulic fracturing is performed. If not already correctly positioned, sonde 100 is placed with the straddle interval in the bed of interest if the rock is to be fractured hydraulically.

That is, for packer fracturing the instrumented packer is inflated to exert stress on the formation sufficient to initiate a fracture in the bed of interest. During inflation of the instrumented packer, acoustic emissions in the vicinity of the packer are monitored, radial borehole deformation at multiple locations about an axis passing through the packer are detected, packer inflation pressure is monitored, and packer inflation flow-rate is controlled. A packer inflation pressure level is determined at which the fracture is initiated in the bed of interest. Packer pressurization is stopped after breakdown in detected, usually on the basis of acoustic emissions and borehole deformation measurements (FIG. 5, time interval t3–t4). Orientation of the fracture is determined from the monitored radial borehole deformations. Several re-opening cycles are preferably performed (FIGS. 4*d*–4*e*), to obtain statistics on the rock tensile strength, T, and fracture azimuth.

The instrumented packer used to initiate a fracture is then deflated to allow the straddle-packer pair to be re-positioned. Sonde 100 is displaced along the borehole axis to position the straddle interval over the packer-induced fracture in the bed of interest. Both packers (e.g., packers 814 and 816) of the straddle-packer pair are inflated to isolate the fracture zone. Packers 814 and 816 are pressurized enough to provide a pressure seal between the straddle interval and the wellbore above the uppermost packer and below the lowermost packer. Pressure isolation of the interval is confirmed by monitoring interval pressure and packer inflation pressure as the packers are inflated; good sealing of the interval by the packers is indicated by an increase of the interval pressure as the packers reach sealing pressure, due to compression of fluid in the interval by the expanding packers.

Once the fracture zone is isolated, a controlled quantity of fluid is injected into the straddle interval at a controlled rate to extend the packer-induced fracture. The quantity and rate of the injected fluid are controlled so as to limit the diameter of the fracture to approximately the bed thickness. The maximum size (e.g., radius in meters) of the hydraulically induced fracture is predetermined from measurement of the mechanical facies thickness established when selecting the targets. It is desired to test a bed where porosity and clay content are essentially constant, as determined from logs of formation porosity and clay content. The thickness of the region of constant clay content and porosity is taken as the bed thickness.

Figure 9A:
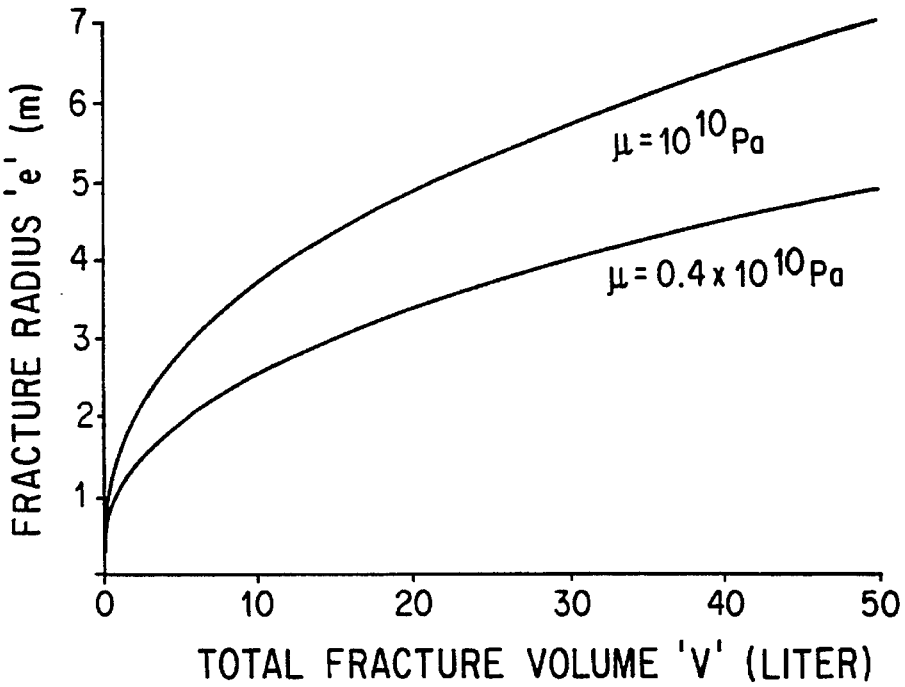
FIG. 9*a* shows an example of the diameter of a penny-shaped fracture as a function of fluid volume of the fracture.
Figure 9B:
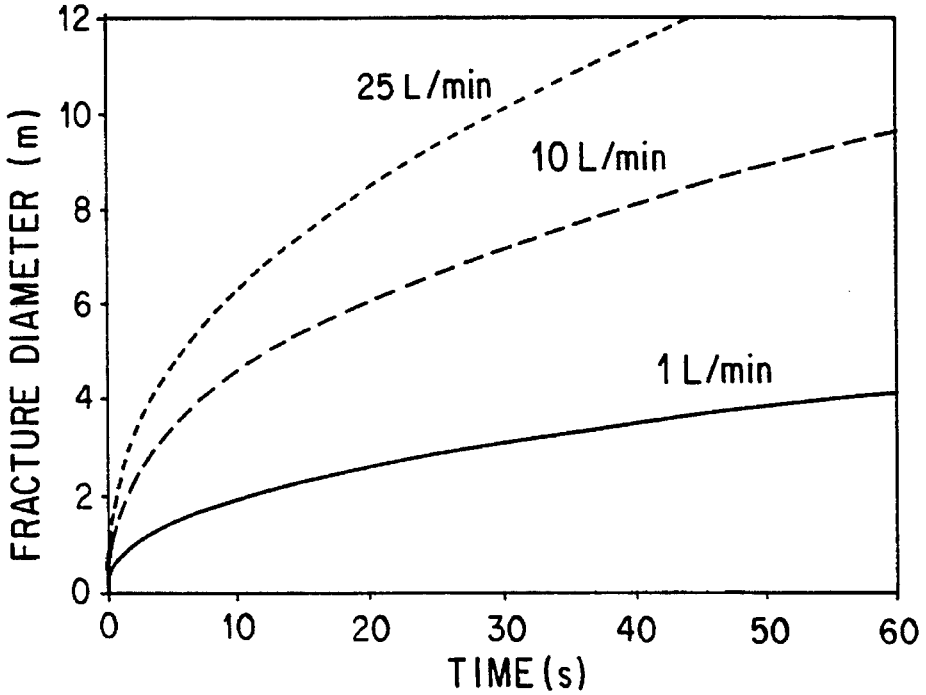
FIG. 9*b* shows a further example of fracture geometry prediction.
Figure 10:
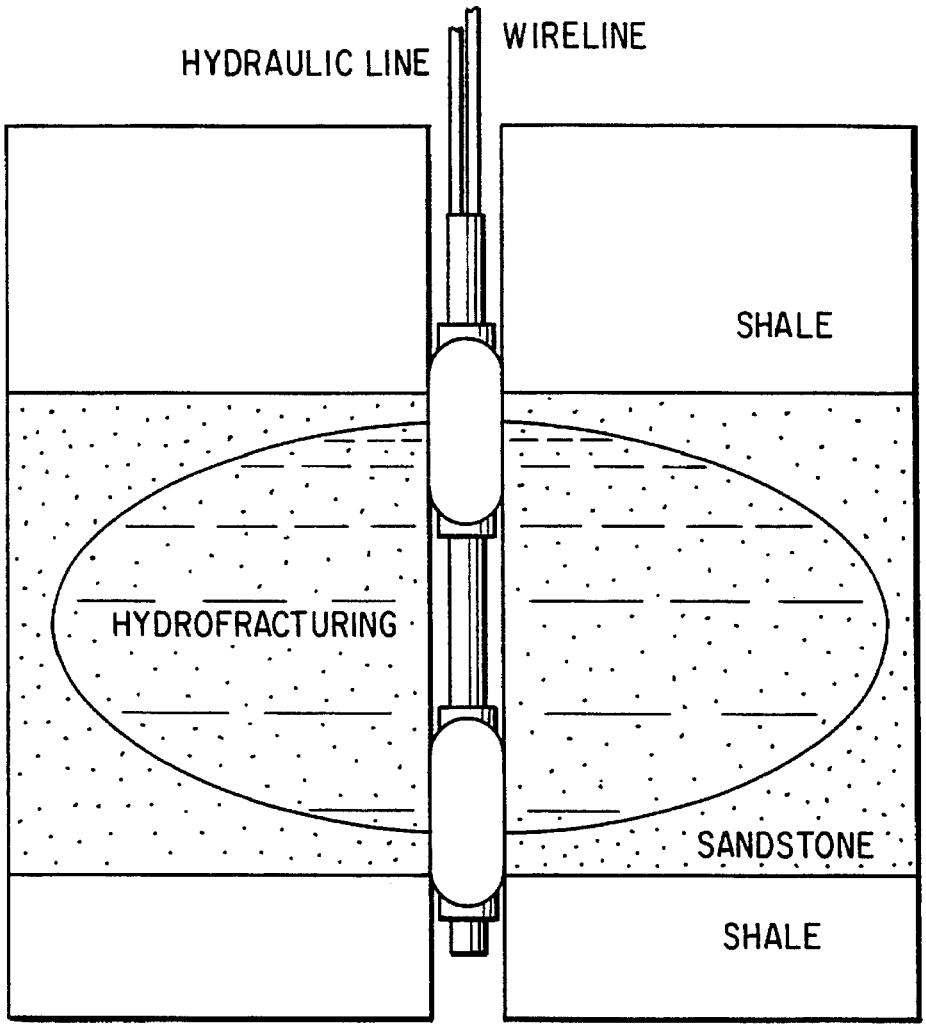
FIG. 10 shows an example in which the straddle-packer sonde configuration of the present invention is used to conduct hydraulic fracture stress measurements in a sandstone layer lying between two shale layers.

The maximum volume of fluid that can be pumped into the formation without propagating out of the bed is calculated from fracture models. FIG. 9*a* shows an example of the diameter of a penny-shaped fracture as a function of fluid volume of the fracture, from a publication by Evans and Engelder, 1987. FIG. 9*b* shows another example of fracture geometry prediction. By limiting the extent of the fracture, a stress measurement is obtained for a single mechanical facies. FIG. 10 shows an example in which the straddle-packer sonde configuration is used to conduct hydraulic fracture stress measurements in a sandstone layer lying between two shale layers, in which each packer seal is approximately 1.04 meter and the straddle interval is approximately 1.45 meter.

It is generally not desired to create the maximum diameter fracture on the first extension cycle, but instead to make a series of measurements as the fracture is progressively extended to the maximum diameter. Fluid inside the straddle interval is pressurized further to extend the hydrofracture. The energy stored in the volume is limited so that upon unstable crack growth, the final fracture size will not exceed the design diameter. Once the energy has been released, the straddle interval is shut in. After each extension, fluid is pumped back or allowed to flow back from the fracture into the sonde so that, upon subsequent fracture extension episodes, the fracture size can be well-controlled.

Fracture orientation is determined as the fracture propagates, by monitoring radial displacement of the borehole wall and calculating principal displacements from the multitude of oriented displacement measurements (e.g., as described in Section A, using measurements of orientation module 132 to orient the displacement measurements). Module 800 may advantageously be equipped with an additional array of caliper arms within the straddle interval (e.g., as a part of interval module 804) to supplement the borehole displacement measurements of instrumented packers 814 and/or 816.

Figure 16:
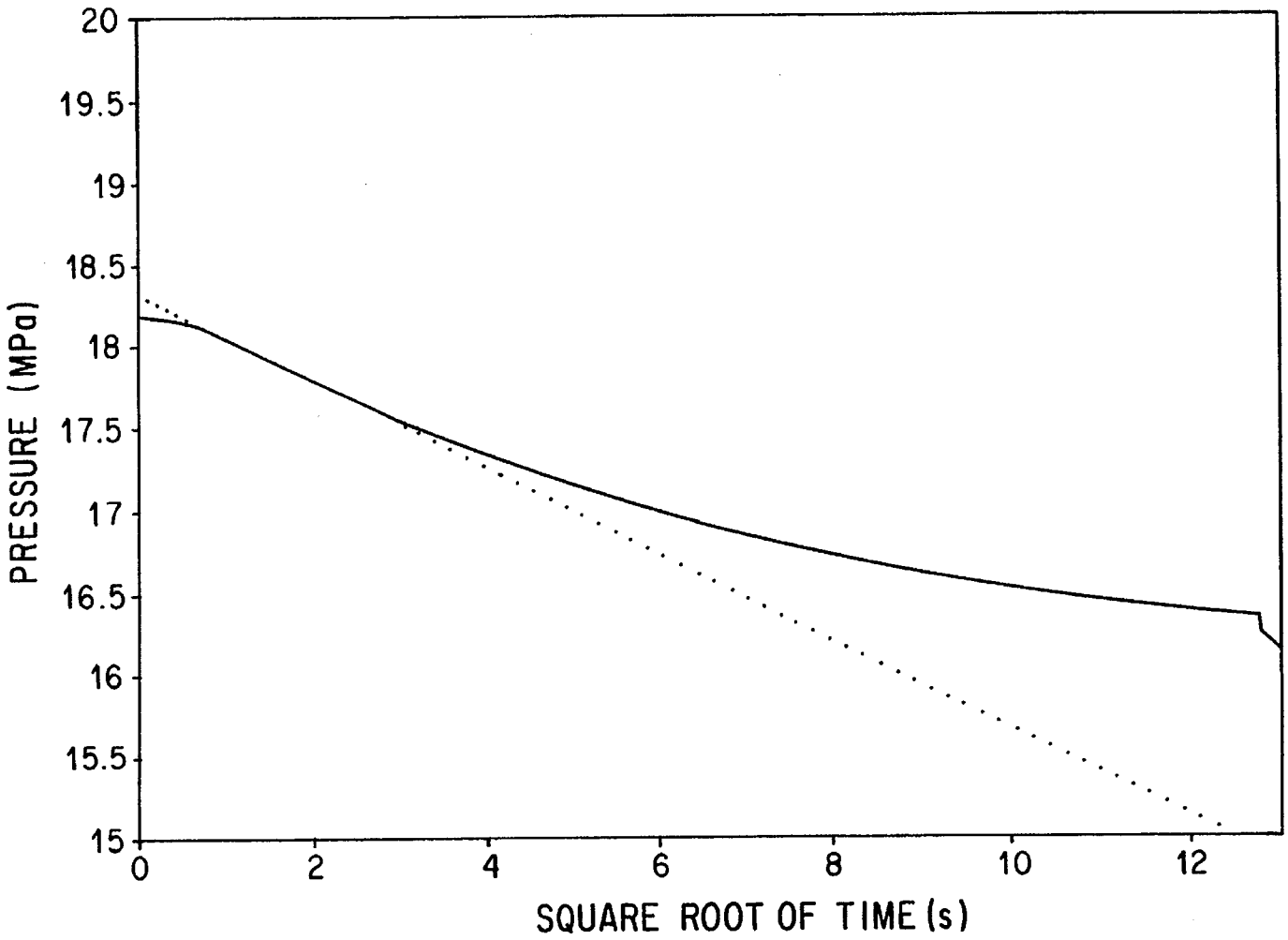
FIG. 16 illustrates a method of determining closure stress in accordance with the invention by monitoring straddle-interval pressure vs. a function of time.

After the first fracture extension stage has been completed, closure stress is determined. One method of determining closure stress is to shut in the straddle interval and monitor pressure vs. time or pressure vs. some function of time (e.g., pressure vs. square root of time) as illustrated in FIG. 16. Another method of determining closure stress is to monitor pressure vs. time using pump-back (e.g., with pumpout module 124). The pump-back method achieves a controlled fracture size by immediately reversing the pump upon detection of formation breakdown. Instead of allowing the fracture to close passively by allowing fluid to flow back into sonde 100, the fluid is actively pumped back. This is a potentially faster method of reaching the closure pressure.

Figure 17A:
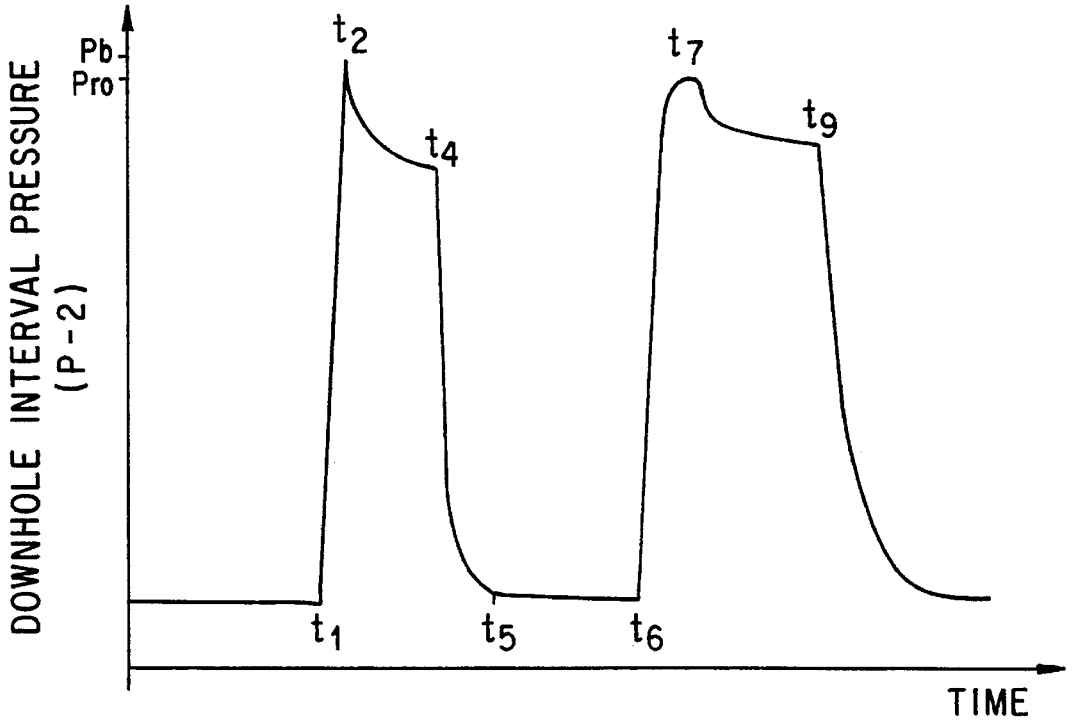
FIG. 17 illustrates the data/flow sequence of a flow-back method of sonde operation in accordance with the present invention.
Figure 17B:
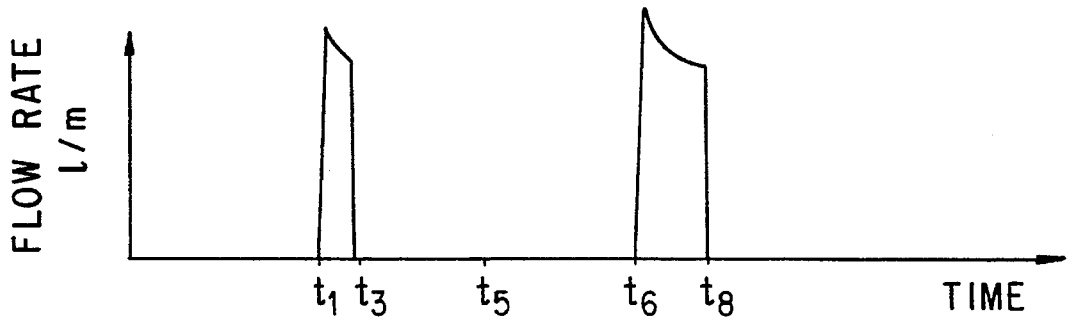
Figure 17C:
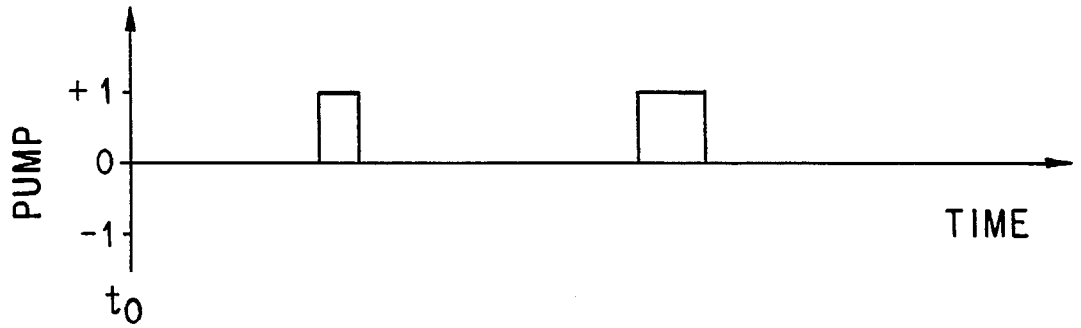
Figure 18A:
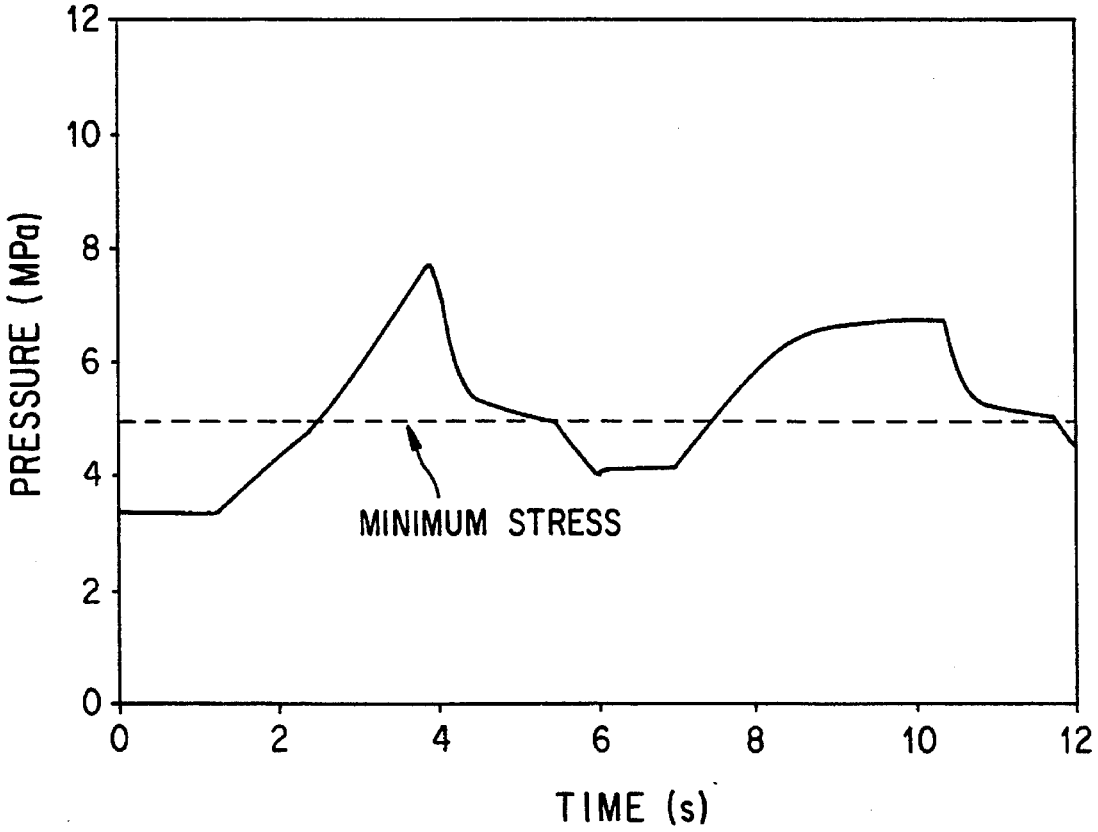
FIG. 18 illustrates the data/flow sequence of a pump-back method of sonde operation in accordance with the present invention.
Figure 18B:
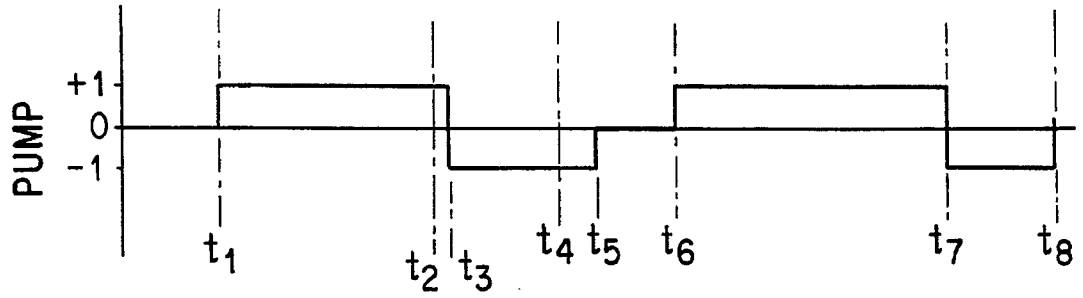

FIG. 17 and 18 show sonde operating sequences applicable to open-hole hydrofracturing. (The sequences also apply to cased-hole hydrofracturing. Cased-hole closure stress is interpreted the same way, but cased-hole breakdown pressures cannot be used to calculate SH.)

Referring to FIGS. 17 and 8B, a flow-back operating sequence is as follows. At time t0, the pump is off, valve 812 is closed, and gauge 813 measures pore pressure (as in FIGS. 21 and 22). At time t1, valve 840 is closed, valves 838 and 812 are open, and the pump is on to pressurize the straddle interval. At time t2, breakdown pressure is reached, and fracturing is initiated. From time t2–t3, the pressure drops as the fracture extends. At time t3, the pump is stopped, valves 838 and 812 are closed, and gauge 813 measures pressure decay as the fracture continues to propagate and fluid in the fracture leaks off into the formation. A plot of pressure vs. a function of time for the time interval t3–t4 is used to determine closure stress, Sh (see FIG. 16). At time t4, valves 812 and 838 are opened to allow fluid to flow back from the fracture. Flow-back is preferably though flow control module 122 to measure the fluid volume returned. The maximum fluid is returned when straddle interval pressure equilibrates with borehole pressure. At time t5, the pressure is equilibrated, as measured by gauge 813. The sequence of time interval t1–t5 is repeated during time interval t6–t10. Multiple fracture pressurization-flow back cycles may be performed where injected volume will be such that fracture diameter is limited to the design diameter and fluid returned is not greater than the volume injected into the fracture. See, for example, K. EVANS et al., *Appalachian stress study 1. a detailed description of in situ stress variations in Devonian shales of the Appalachian plateau,* J. GEO. RES., 94/B6, 7129–7154, 1989.

Referring to FIGS. 18 and 8B, a pump-back operating sequence is as follows. At time t0, the pump is off, valve 812 is closed, and gauge 813 measures hydrostatic head in the borehole. At time t1, valve 840 is closed, valves 838 and 812 are open, and the pump is on to pressurize the straddle interval. At time t2, breakdown pressure is reached, and fracturing is initiated. From time t2–t3, uncontrolled fracture propagation occurs. At time t3, the pump is reversed to commence pump-back of fluid from the straddle interval. At time t4, the fracture closes (= Sh). At time t5, pump-back is stopped. At time t6, the pump is on to re-pressurize the fracture. During time interval t6–t7, the pump remains on for controlled extension of the fracture. At time t7, pump-back is commenced. At time t8, fracture closure occurs.

The maximum horizontal stress can be computed from the Hubbert and Willis breakdown equation described in Section A above.

As the power available from wireline 104 to drive pumpout module 124, accumulator 210 is preferably used to allow for a wider range of flow rates, e.g., for fracturing and for fracture extension of porous and permeable rocks. These rocks are loading-rate sensitive materials. If they are pressurized (loaded) at rates faster than fluid pressure can diffuse away from the borehole, pore pressure will increase and fractures can be created. The key is to load rapidly enough. This may be done either with the packer fracturing method, high-rate open-hole hydraulic fracturing using borehole fluid, or high-rate open-hole fracturing using fluids stored in chambers of sonde 100.

Figure 11:
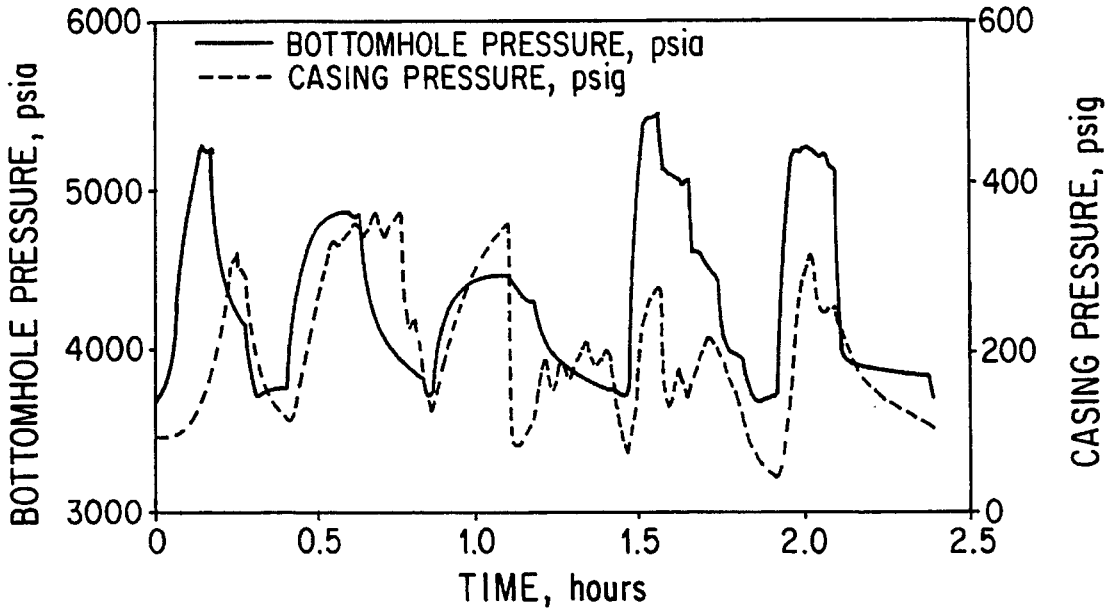
FIG. 11 illustrates an example of communication between the bottom-hole pressure in the test interval and the pressure in the borehole casing annulus outside the test interval in the straddle-packer sonde configuration of the present invention.

Leakage around the straddle packers is also advantageously monitored during pressurization of the interval. If fluid injected into the straddle interval leaks past the packers (e.g., due to inadequate packer sealing), it may not be possible to fracture the formation. Inability to pressurize the interval can also be caused by formation permeability. If the packer seal is bad, resetting the packers is an option. If formation permeability is the cause, the accumulator can be used to pressurize the interval. Leakage can be detected by monitoring pressure above and/or below the straddle interval. An example of communication between the bottom-hole pressure in the test interval and the pressure in the borehole casing annulus outside the test interval is illustrated in FIG. 11.

After monitoring pressure vs. time or (pressure vs. f(t)) for determination of fracture closing pressure, pumpout module 124 is operated to pump fluid out of the straddle interval to reduce pressure in the fracture. Pressure in the interval and the volume of fluid pumped back from the formation are monitored as the fluid is pumped back. Interval pressure and fluid volume measurement will indicate when all of the fluid injected to create the fracture has been returned to the sonde.

Injection of a controlled quantity of fluid into the straddle interval is preferably repeated several times, using a range of fluid injection rates and pumping back after each injection. During each injection cycle, interval pressure is monitored to allow control of the fracture size; acoustic emissions, borehole deformation and volume of fluid injected are also monitored. If the initial fracture is less than the maximum design size, fluid injection may be used to extend the fracture to the design size in one or more pressurization-depressurization cycles. After the design fracture diameter has been reached, care is required to prevent unwanted fracture growth upon subsequent fracture re-opening cycles. Unwanted fracture growth is prevented by controlling the total fluid volume re-injected into the fracture. When the fracture design size is achieved and the fracture is closed due to pump-back, subsequent injection volume is carefully controlled to reopen the fracture without further fracture extension.

Figure 12:
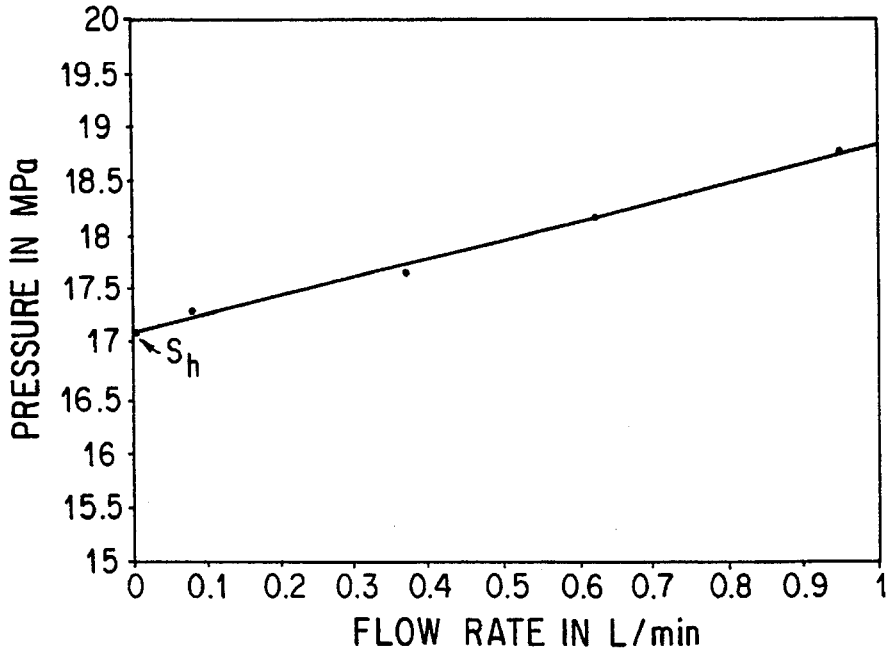
FIG. 12 shows an example of data relating measured pressure to flow rate for repeated injection at various injection rates in accordance with the invention.

Repeated injection at various injection rates (a "step-rate" test) produces a set of data relating measured pressure to flow rate, an example of which is illustrated in FIG. 12. The step-rate test is used to confirm that a fracture has been created and to measure the least principal stress in very permeable formations. The least principal stress Sh in permeable formations is the pressure intercept at zero flow rate, as shown in the example of FIG. 12. In general, closure pressure is least principal stress. A step-rate test can be used to measure least principal stress in high permeability intervals. Examples of high permeability intervals include those with previously created hydrofractures, favorably oriented pre-existing fractures or high-permeability unfractured formations.

Figure 24A:
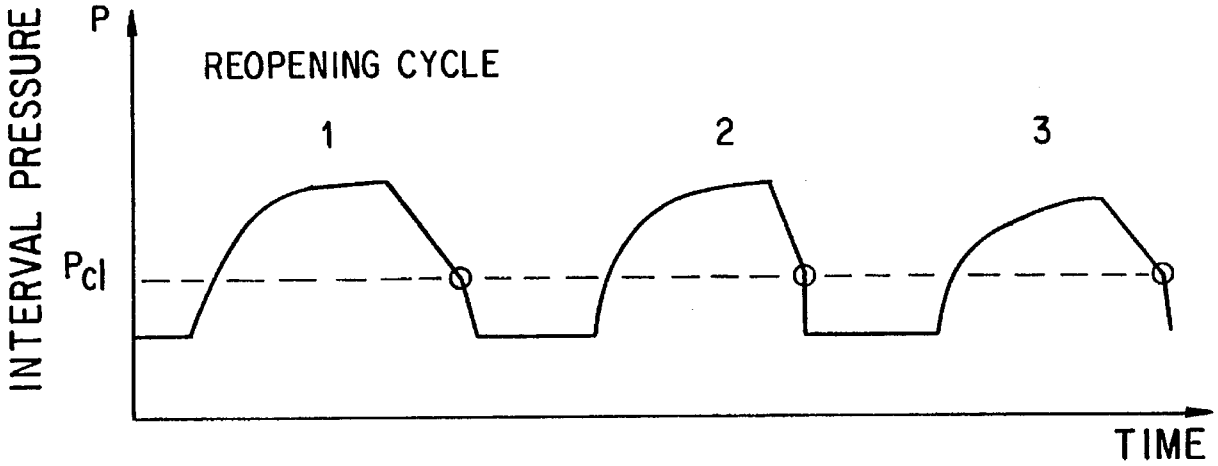
FIG. 24 illustrates a data/flow test sequence for multiple-rate pump-back in accordance with the present invention.
Figure 24B:
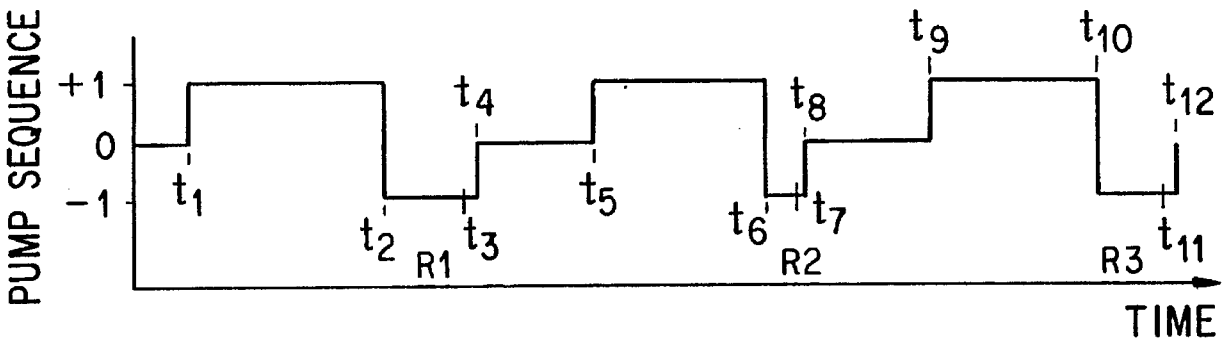

FIG. 24 illustrates a data/pump test sequence for multiple-rate pump-back. At time t1, a first fracture re-opening cycle is commenced by injecting into the fracture a predetermined volume of fluid, Vf, to control the fracture diameter. When fluid volume Vf has been injected, at time t2, the pump is reversed to pump back fluid at a rate R1. At time t3, the fracture closes at a closure pressure Pcl (indicated by a change in slope of pressure vs. time) which is taken as least principal stress. When fluid volume Vf has been pumped back from the formation at time t4, the pump is stopped. A second fracture re-opening and pump-back cycle is performed in the same manner during time interval t5–t8, except that the pump-back rate, R2, for the second cycle is measurably different from the first-cycle pump-back rate, R1. A third fracture re-opening and pump-back cycle is performed in the same manner during time interval t9–t12, except that the pump-back rate, R3, for the third cycle is measurably different from the first-cycle pump-back rate, R1, and the second-cycle pump-back rate, R2.

In some cases there can be uncertainty in identifying a change in slope of the graph of pressure vs. time (or pressure vs. some function of time). Fracture closure, fluid leak-off and fracture growth can have different rate constants. It is therefore preferred to release pressure in the fracture at a different rate for each pressurization/de-pressurization cycle. Pressure release can be achieved either by allowing passive flow-back of the injected fluid into the sonde, or by active pump-back of the fluid, e.g., using pump-back module 124. Closure stress is the one variable that should not change as a function of flow back or pump back rates. The closure stress is then identified as the common slope discontinuity observed at all rates. In all cases the injected fluid volume is controlled such that fracture diameter is limited to the design diameter and fluid returned to the sonde is not greater than the volume of the fracture.

C. Cased Hole Gunblock Configuration

Figure 13:
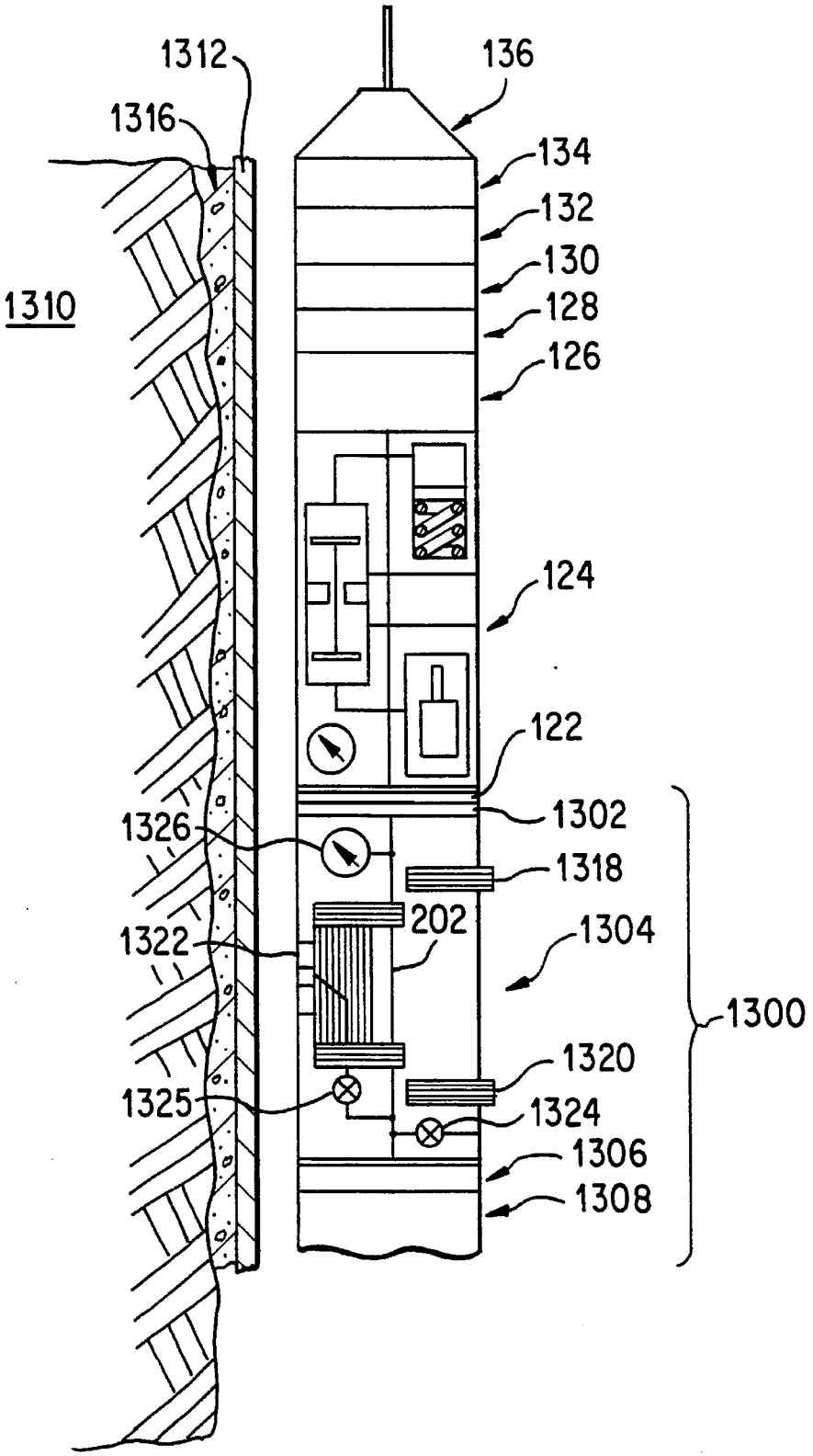
FIG. 13 is a schematic illustration of a further preferred embodiment of sonde 100 in accordance with the invention including a cased-hole stress/rheology module 1300.

FIG. 13 shows schematically a further preferred configuration of sonde 100 comprising adapter head 136, modules 134, 132, 130, 128, 126, 124 and 122 (FIGS. 2A and 2B), and a stress/rheology module 1300. Sonde 100 is shown positioned adjacent a bed of interest 1310 in a borehole lined with a casing 1312 and having the space between bed 1310 and casing 1314 filled with cement 1316.

Module 1300 comprises an orienting module 1302 (e.g. the orienting module 304 of FIG. 3A), a gunblock module 1304, an acoustic emissions module 1306 having one or more sensors for detecting acoustic emissions, and an optional imaging module 1308. Gunblock module 1304 may be of any suitable construction, e.g., in the manner of the conventional Schlumberger repeat formation tool (RFT), or having capability for repairing perforations made in the casing as described for example in U.S. patent application Ser. No. 815,982, now U.S. Pat. No. 5,195,588,of Dave filed Jan. 2, 1992, incorporated herein by this reference. Imaging module 1308 may be of any suitable construction having transducers for emitting and receiving sonic energy to enable generation of an image of the borehole, e.g., in the manner of the conventional Schlumberger ultrasonic imaging tool (USIT) or borehole televiewer tool (BHTV), or as described in U.S. patent application Ser. No. 815,982.

Figure 19A:
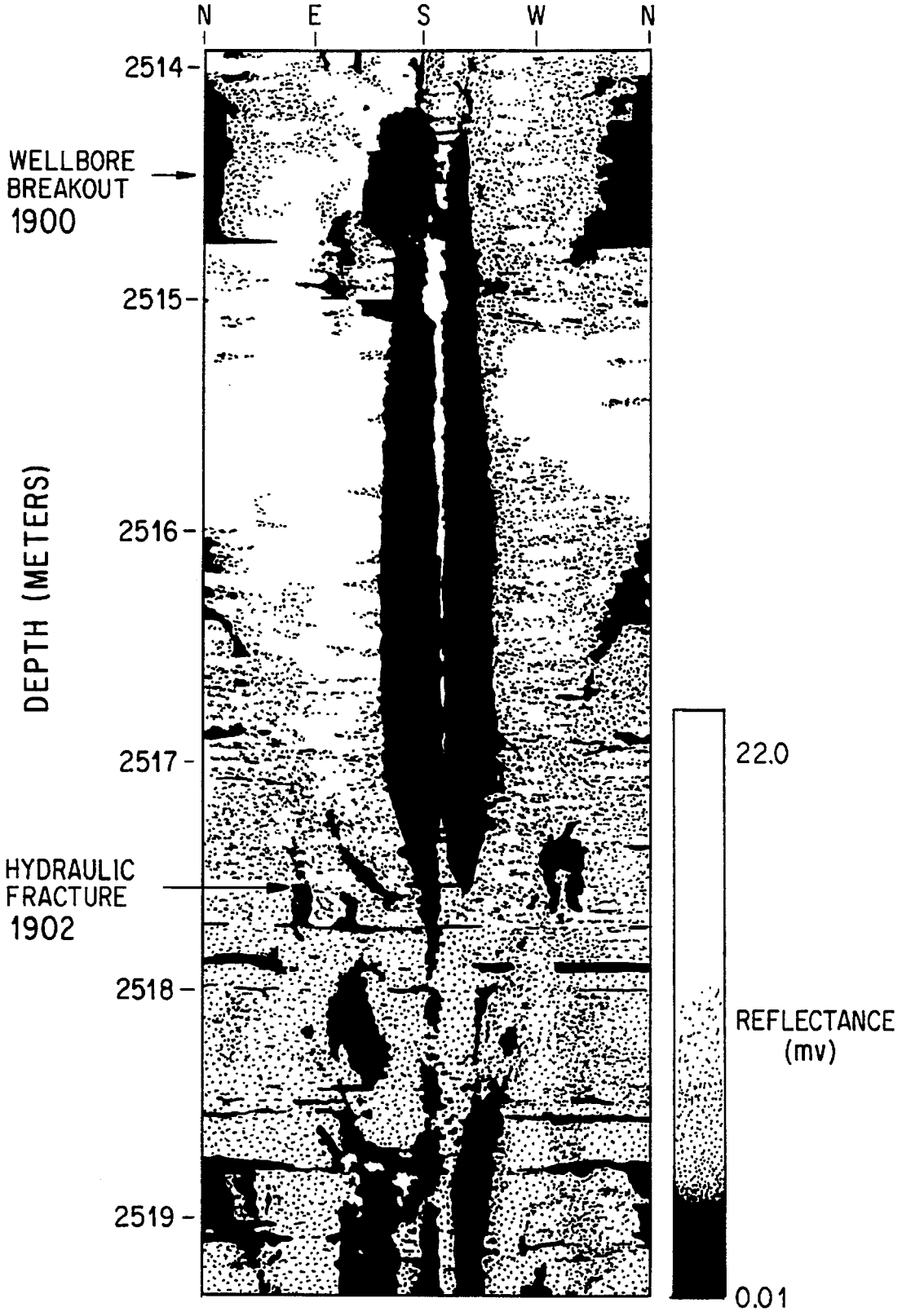
FIG. 19A shows an example of an ultrasonic imaging log of a portion of a borehole showing features indicative of stress directions, such as a stress-induced breakout and a fracture.
Figure 19B:
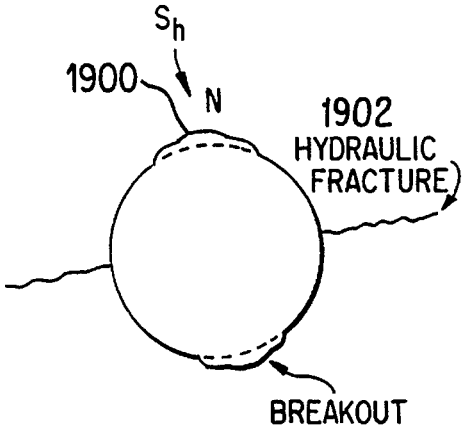
FIG. 19B illustrates the orientation of the breakout and fracture of FIG. 19A relative to a cross-section of the borehole.

A formation bed of interest is selected, based on available information about lithology and bed thickness. The bed of interest is chosen with reference to clay content logs (e.g., from the Schlumberger geochemical logging tool (GLT)) and elastic moduli (e.g., from sonic and density logs). Sonic. density and GLT logs are examples of reference logs which are normally recorded with a Gamma-ray log. The Gamma-ray log is correlated with the reference logs. Thus, a Gamma-ray log in cased hole can be used to locate the bed of interest. An azimuth about the borehole axis of the maximum principal stress of the bed of interest is determined, from available open hole logs of the borehole. FIG. 19A shows an example of an ultrasonic imaging log of a portion of a borehole showing such features as a stress-induced breakout 1900 and a fracture 1902 indicative of stress directions. FIG. 19B illustrates the orientation of breakout 1900 and fracture 1902 relative to a cross-section of the borehole. Sonde 100 is placed in the borehole with gunblock module 1304 positioned adjacent the bed of interest. Gamma-ray (GR) and/or collar-locator (CCL) logs of the borehole are used for correlation. Imaging module 1308 allows the inner and outer surfaces of casing 1312 to be imaged using focused transducers for identification of corroded casing surfaces. Severely corroded surfaces should be avoided to assure good packer sealing. It is also important to identify the integrity of the bond between outer surface of the casing and cement, using imaging module 1308, before a perforation is made in the casing.

When gunblock module 1304 is positioned adjacent the bed of interest, orienting module 1302 is activated to position gunblock module 1304 at a proper azimuth for perforating the casing in a plane normal to the least principal stress. A tool-set command is then issued. Sonde 100 is pushed against the wall of the casing by operation of hydraulic members 1318 and 1320, thereby pressing gunblock packer 1322 in contact with casing 1312. Flowline 202 is isolated from the hydrostatic pressure by closing equalizing valve 1324. The packer seal is verified by a pre-test operation performed by moving a piston to expand the volume of flowline 202 by, e.g., 10–20 cc. Expansion of flow line 202 causes a drop in the flow line pressure from hydrostatic to almost zero pressure (less drop if gas is trapped). Constant lower pressure at gauge 1326 indicates a good seal. If the flow line pressure creeps back to hydrostatic pressure, a leak is suspected and the tool may be retracted and reset. It is important to verify packer seal by pretest, before a perforation is made.

When good sealing of the packer to the casing is confirmed, the perforating device of gunblock module 1304 is activated to produce a single perforation through the casing and cement to establish pressure communication with the bed of interest. The perforating device is preferably a shaped charge (e.g., comprising an outer case, main explosive charge, primer charge and a metallic liner), although any other suitable means for making a hole through the casing may be used, such as an electromechanical drilling device. Pressure in the flow line is monitored as the perforation is made. In the case of a shaped charge, detection of a pressure spike in the flow line (e.g., by gauge 1328, shown in FIG. 20) indicates firing of the charge.

A further pre-test procedure is preferably performed after communication is established between flow line 202 and the bed of interest through the perforation in the casing. The pre-test procedure may be as described, for example, in U.S. patent application Ser. No. 07/761,213 of Dave and Ramakrishnan (Attorney Docket No. 60.983). A Pre-test piston is moved to expand the volume of flow line 202 at a controlled rate, dropping the pressure in flow line 202. The pressure is constantly recorded for the known flow rate. At the end of the pretest, the flow line pressure equalizes to formation pressure. Formation permeability can be calculated from the pressure build-up measurement. Pressure draw-down measurements are not used in determining permeability as the shape of the perforation (e.g., penetration length, diameter) are unknown.

Figure 20:
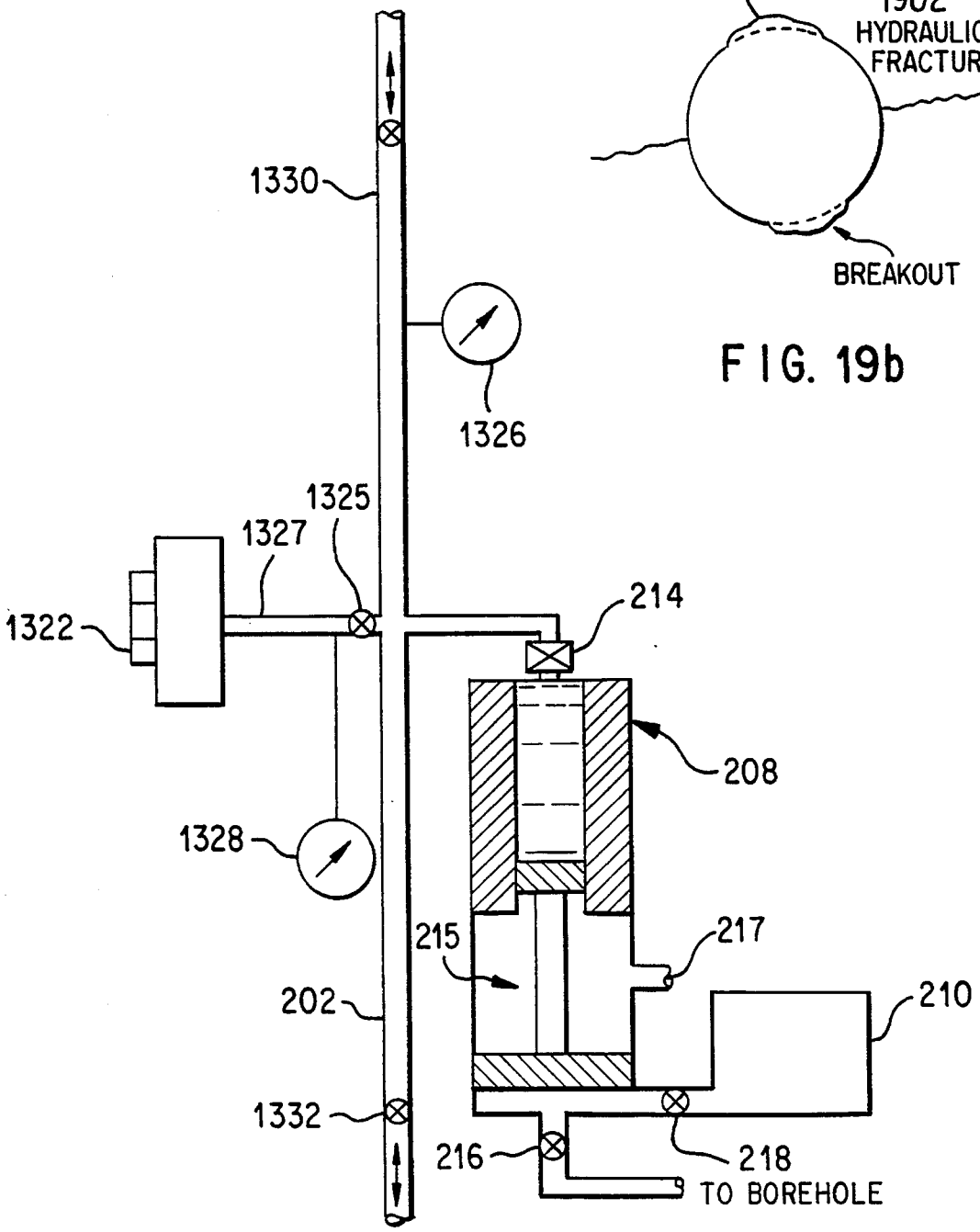
FIG. 20 illustrates a partial flowline schematic of the sonde configuration of FIG. 13 in accordance with the present invention.

FIG. 20 illustrates a partial flowline schematic of the configuration of FIG. 13. Fluid communication between flowline 202 and the formation through line 1327 and the casing perforation (not illustrated) is controlled by controllable valve 1325.

A pressure gauge 1327 enables pressure in line 1326 to be monitored. Controllable valves 1330 and 1332 control flow in flowline 202. Intensifier 208 and accumulator 210 are as described previously, with flow controlled by controllable valves 214, 216 and 218. Chamber 215 is open to borehole pressure via line 217.

A controlled volume of fluid is injected through the perforation into the bed of interest at a controlled rate to create a fracture in the bed of interest of a diameter not exceeding approximately the thickness of the bed of interest. Measurements of pressure vs. time, cumulative volume vs. time, and acoustic emissions vs. time are made. Pumpout module 124 and/or accumulator 210 are preferably used to deliver the flow to create the fracture. For simplicity, the following discussion refers to pump operation, though use of the accumulator is also contemplated.

Figures 21A, 21B, 21C, 21D:
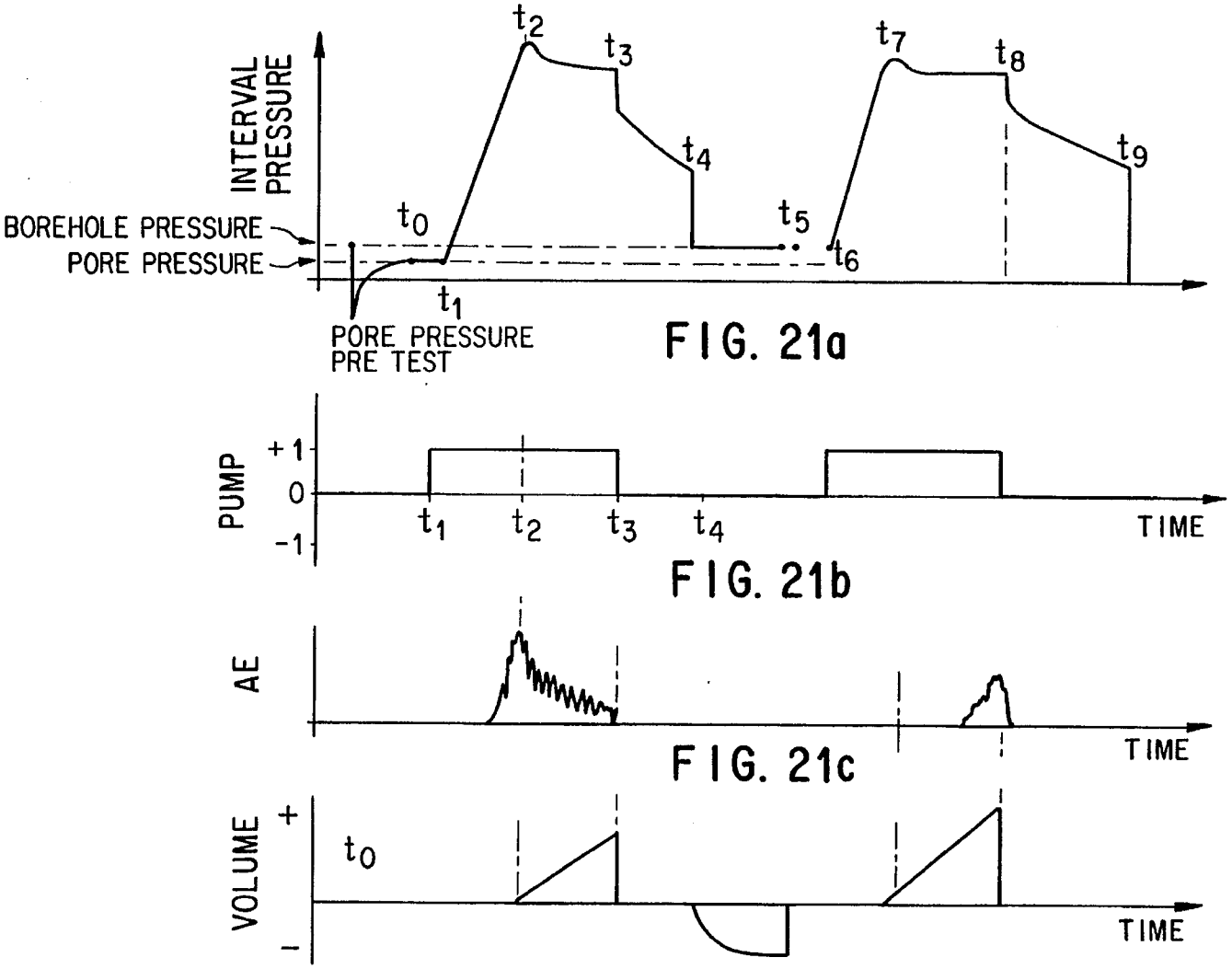
FIG. 21 illustrates a data/flow sequence for flow-back operation of cased hole embodiments of the sonde of FIG. 1 in accordance with the present invention.

FIG. 21 illustrates a data/pump sequence using the classical flow-back method of Evans et al., 1989. Time is measured after the second (the pressure draw-down) pre-test described above. At time t0, the pump is off, valve 1325 is closed, and gauge 1328 measures pore pressure. At time t1, valve 1332 is closed, valves 1330 and 1325 are open, and the pump is on to pressurize the formation. At time t2, breakdown pressure is reached, fracture is initiated, and a burst of acoustic emissions (AE) is recorded as fluid starts flowing into the formation. During time interval t2–t3, pressure drops as the controlled fracture extends. The injected fluid volume is monitored and compared to a pre-determined maximum volume corresponding to the maximum fracture diameter. Acoustic emissions (AE) are recorded so long as new fracture surface is created.

At time t3, the pump is stopped after the desired volume of fluid has been injected. Valves 1330 and 1325 are closed, gauge 1328 measures pressure decay as the fracture continues to propagate and fluid in the fracture leaks off into the formation. A plot of pressure vs. some function of time for time interval t3–t4 is used to determine closure stress (see, e.g., FIG. 16). Closure stress is taken as least principal stress.

At time t4, valve 1330 is opened to borehole pressure and then valve 1325 is opened to allow fluid in the fracture to flow back into the borehole. The maximum fluid is returned when the pressure in flowline 1326 (e.g., fracture pressure) equilibrates with borehole pressure. Flow-back is preferably through flow control module 122 to measure the volume of fluid returned. Once the fluid is all returned, gauge 1328 will equilibrate to borehole pressure at time t5.

The sequence of steps from times t1 through t5 is repeated beginning at time t6. Fracture re-opening pressure is indicated at time t7. During time interval t7–t8, a burst of acoustic emissions (AE) will be recorded if the volume injected in this repressurization cycle exceeds the maximum volume injected in the first cycle.

Figures 22A, 22B, 22C, 22D:
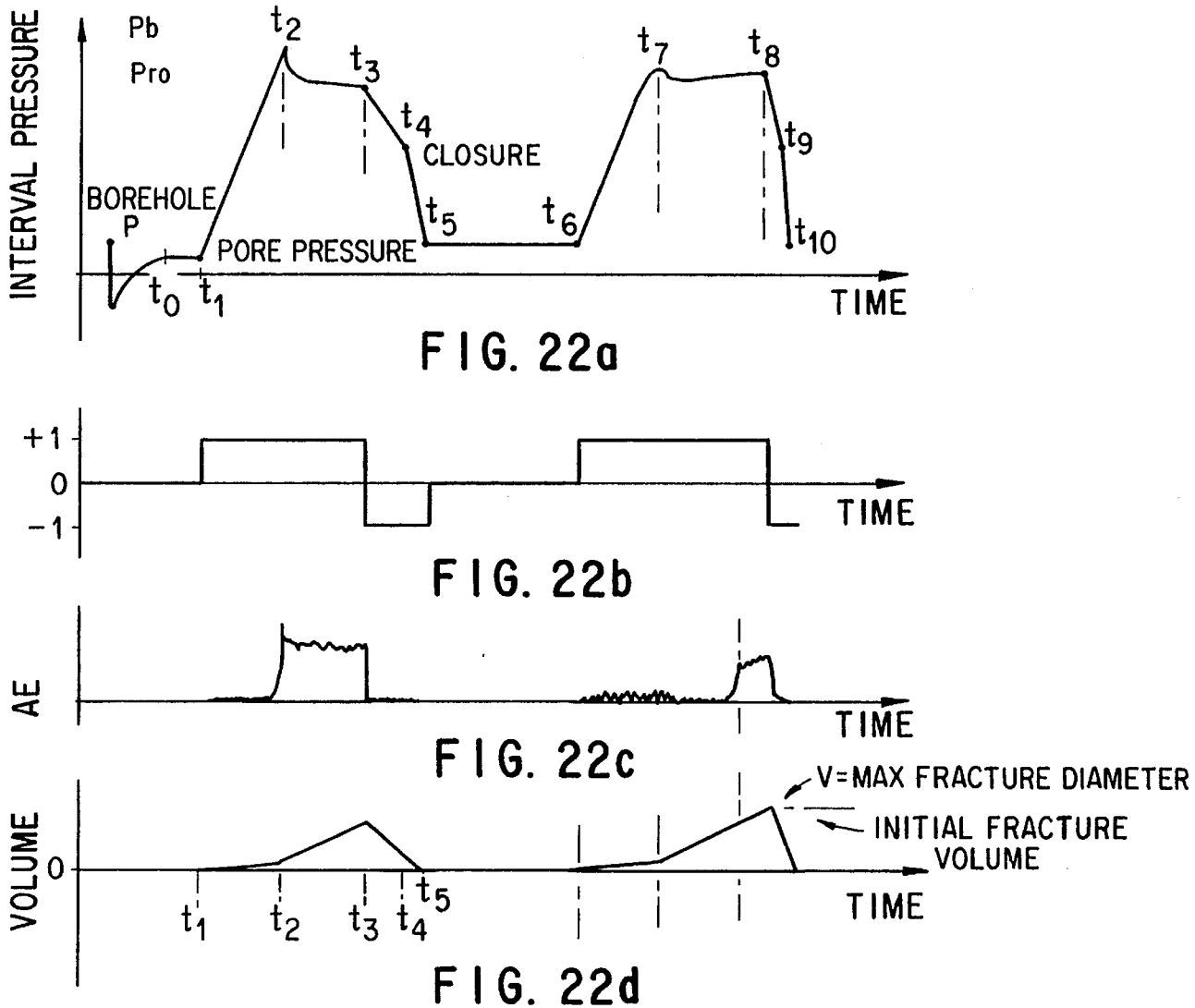
FIG. 22 illustrates a data/flow sequence for pump-back operation of cased hole embodiments of the sonde of FIG. 1 in accordance with the present invention.

FIG. 22 illustrates a data/pump sequence using a pump-back method. Time is measured after the second (the pressure draw-down) pre-test described above. At time t0, the pump is off, valve 1325 is closed, and gauge 1328 measures pore pressure. At time t1, valve 1332 is closed, valves 1325 and 1330 are open, and the pump is on to pressurize the interval. At time t2, breakdown pressure is reached, fracture is initiated, a burst of acoustic emissions (AE) is recorded, and the formation begins taking in fluid. During time interval t2–t3, pressure drops as the controlled fracture extends. Injected fluid volume is monitored and compared to a pre-determined maximum volume corresponding to the maximum fracture diameter. Acoustic emissions (AE) are recorded so long as new fracture surface is created.

At time t3, the pump is stopped after the desired volume of fluid has been injected. The pump is then reversed and pump-back is started. Fluid volume pumped back is monitored. The closure pressure at time t4 represents the least principal stress. When all injected fluid is returned from the formation at time t5, pump-back is stopped. Valves 1330 and 1325 are opened to allow formation pressure to equilibrate with borehole pressure. The flow line is then isolated from borehole pressure.

At time t6, valve 1325 is opened and the pump is started to re-pressurize the fracture. Fracture re-opening pressure is indicated at time t7. During time interval t7–t8 (controlled fracture extension), a burst of acoustic emissions (AE) will be recorded if the volume injected in this re-pressurization cycle exceeds the maximum volume injected in the first cycle. At time t8, pump-back is again started. The pump-back rate may differ from that used in the period t3–t5. Fracture closure is indicated at time t9. At time t10, pump-back is stopped when all injected fluid is returned from the formation. Formation pressure is again allowed to equilibrate with borehole pressure via valves 1325 and 1330.

Accumulator 210 is used in the pressurization sequences of FIGS. 21–22, e.g., when pumpout module 124 cannot develop the breakdown pressure because of high rock permeability, or when pressure limitations of pumpout module 124 are exceeded because of high in-situ stress. Consider, for example, the time intervals t1–t2 of FIGS. 21–22, assuming accumulator 210 is charged.

In the case of high permeability, a test is commenced using the pump-back method. If a breakdown cannot be reached using pumpout module 124, valve 1330 is closed, and control valve 214 is opened to pressurize the formation at a rate sufficient to achieve breakdown. Injection using accumulator 210 is continued until the design fracture size is reached. Valve 214 is then closed, and the stress test is continued using the pump-back mode described above. The accumulator is recharged, and a re-opening sequence is performed by repeating these steps using the accumulator.

In the case of high stress, a test is commenced as described with reference to FIG. 21 (flow-back method) or FIG. 22 (pump-back method). If a breakdown cannot be reached using pumpout module 124, valve 1330 is closed, and control valve 214 is opened to pressurize the formation at a rate sufficient to achieve breakdown. Valve 214 is closed, valve 1330 is opened, and the fracture is extended using pumpout module 124. The stress test is continued using the pumpout module and either the flow-back or pump-back techniques to determine stress. The accumulator is recharged, and a fracture re-opening sequence is performed by repeating these steps.

After completing measurements, gunblock module 1304 is retracted so that sonde 100 can be moved to perform stress measurement process in another bed of interest. If desired, the perforation in the casing can be plugged at the conclusion of the final pump-back, as described for example in U.S. patent application Ser. No. 815,982 of Dave filed Jan. 2, 1992.

D. Cased Hole-Perforating Gun/Straddle Packer Configuration

Figure 14:
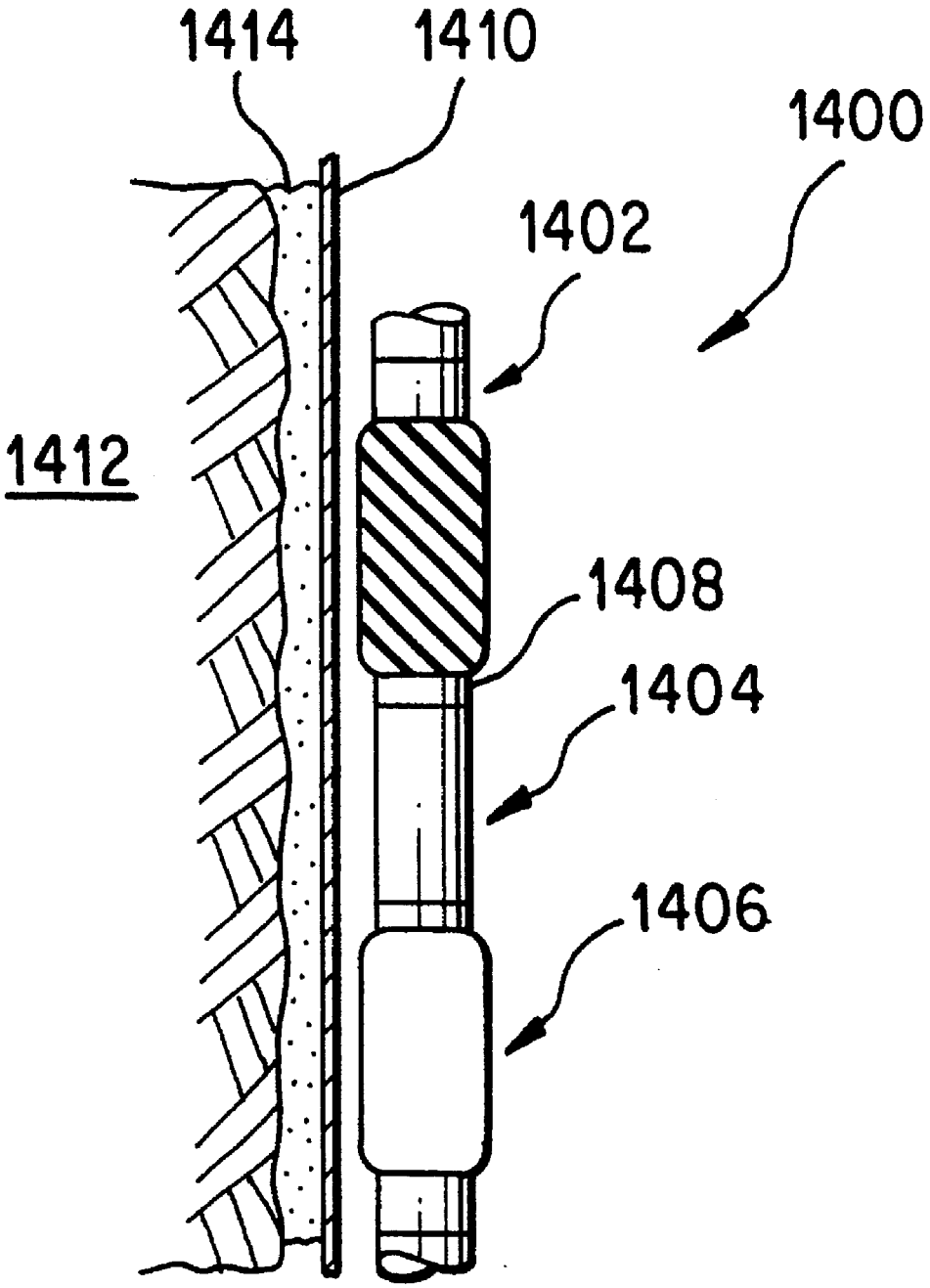
FIG. 14 is a schematic illustration of a further preferred embodiment of a stress/rheology module of the sonde of FIG. 1 in accordance with the present invention.

FIG. 14 shows schematically at 1400 a further preferred embodiment of a stress/rheology module S. As illustrated, stress/rheology module 1400 comprises a pair of packers 1402 and 1406 forming a straddle packer assembly with a casing perforation device 1404 and an acoustic emissions subassembly 1408 located in the straddle interval having sensors for detecting acoustic emissions. Packers 1402 and 1406 need not be instrumented (as is the case in the embodiment of FIG. 8A). Perforation module 1404 comprises a plurality of shaped charges (or other suitable perforating means) arranged about the axis of sonde 100 for creating a helical array of perforations in the casing. Module 1400 is shown situated in a casing 1410 adjacent a formation bed of interest 1412. The annulus between casing 1410 and bed 1412 is filled with cement 1414.

A formation bed of interest is selected based on available information about lithology and bed thickness. The mechanical facies of interest are selected using open hole logs. A casing collar locator and/or through-casing logs such as Gamma-ray logs, are used for correlation of casing collars with mechanical facies, to locate the mechanical facies of interest. If open hole logs are unavailable, cased hole logs such as sonic and/or GLT can be used to identify the mechanical facies of interest.

Once mechanical facies targets are identified, the casing surface and cement bond quality are evaluated using the Schlumberger ultrasonic imaging tool (USIT) or other appropriate device to ensure: a) that packers 1402 and 1406 will seal against the inside casing surface, and b) that there are no major channels behind the casing which would allow pressurized fluid to leak off behind the casing rather than fracturing the formation rock. The USIT may be run as part of sonde 100 (e.g., imaging module 1308); other cased-hole tools (e.g., for GLT and sonic logs) are run separately from sonde 100.

In operation, module 1400 is set in the borehole with perforation module 1404 positioned adjacent a bed 1412 of interest as illustrated in FIG. 14. Packers 1402 and 1406 are set in the casing to isolate the straddle interval between the packers. An initial pressure draw-down test is performed by withdrawing fluid from the interval. (See, e.g., the flowline schematic of FIG. 8B, also applicable to this embodiment. References to items in FIG. 8A will be made here to assist understanding of the operating sequence.) Pressure in the interval is monitored to assure that packers 1402 and 1406 are properly sealed. Pumpout module 124 is operated to withdraw substantially all fluid from the straddle interval (e.g., via valves 812 and 838 of FIG. 8A). The fluid may be pumped into a chamber of sonde 100 or into the casing above or below the straddle interval. Withdrawal of the fluid serves to minimize the shock to the packers when perforating guns of device 1404 are fired (e.g., air is more compressible than fluid), and to lower the pressure in the straddle interval relative to that in the formation. When the casing is perforated, this pressure gradient causes crushed rock debris lining the perforation tunnel to flow into the borehole. This unblocks the perforation and improves pressure communication between the straddle interval and the formation.

Perforating guns (or other suitable perforating means) of device 1404 are selectively activated to create multiple perforations through the casing and cement over 360 degrees of azimuth about the borehole axis, to thereby establish fluid communication between the straddle interval and the bed of interest.

A pressure draw-down pre-test is then performed to further clean up the perforations and to determine formation pore pressure in the bed of interest. The interval pressure is equilibrated with borehole pressure, e.g., via flowline 202 and valves 812/838 (FIG. 8B) and 218/220 (FIG. 2A). Pressure draw-down is performed by expanding the volume of flowline 202 by moving a piston in a large-volume chamber (e.g., about 1000 cc, such as chamber 222 (FIG. 2A).

After completion of the pre-test, a predetermined volume of fluid is injected into the straddle interval at a controlled rate to initiate a fracture. Straddle-interval pressure vs. time, acoustic emissions vs. time (number, and spectral characteristics) and leakage around packers are monitored during fluid injection. The pressurized volume is chosen so that the induced fracture is less than the thickness of the mechanical facies of interest. Formation breakdown pressure is determined by monitoring interval pressure vs. time, and acoustic emissions vs. time and volume of fluid injected into the interval.

Closure stress is determined using one of the methods described above, e.g. with reference to FIG. 21 (flow-back method) or FIG. 22 (pump-back method). The flow-back technique is performed with the straddle interval is shut in (e.g., valve 812 closed) and pressure decline vs. time (or pressure vs. some function of time as in FIG. 16) is monitored. In the pump-back technique, a quantity of fluid equal to the volume of fluid injected is pumped back while pressure vs. time is monitored. Multiple fracture pressurization-flow back cycles may be performed where injected volume will be such that fracture diameter is limited to the design diameter and fluid returned is not greater than the volume injected into the fracture.

After determining closure stress (e.g., by monitoring pressure decay vs. time), fluid is allowed to flow from the formation back into sonde 100 (e.g., see FIG. 21). After flow-back, a controlled volume of fluid is again injected into the straddle interval at a controlled rate to propagate the fracture, limited to the maximum design diameter of the fracture. During fluid injection, interval pressure vs. time, acoustic emissions vs. time and fluid volume injected vs. time are monitored. Acoustic emissions are diagnostic of fracture propagation occurring as new fracture surface is created. Pressure is diagnostic of the fracture growth (see K. NOLTE et al, *Interpretation of Fracturing Pressures,* J. PETROLEUM TECHN., Sep. 1981, pp. 1767–1775. Fluid volume is monitored to ensure fracture size is limited to design size and to indicate how much fluid must be pumped back or flowed back after closure stress determination.

Referring to the data/pump sequence of FIG. 21 and the flowline schematic of FIG. 8B, a method of flow-back operation is as follows. Time is measured after the draw-down pre-test. At time t0, the pump is off, valve 812 is closed to isolate the interval, and gauge 813 measures pore pressure. At time t2, valve 840 is closed, valves 838 and 812 are open, and the pump is on to pressurize the interval. At time t2, breakdown pressure reached, the fracture is initiated, a burst of acoustic emissions (ALE, from sensors in sub 1408) are recorded, and fluid starts flowing into the formation.

During time interval t2–t3, pressure drops as the controlled fracture extends. Injected fluid volume is monitored and compared to a pre-determined maximum volume corresponding to the maximum fracture diameter. Acoustic emissions are recorded so long as new fracture surface is created. When the desired volume of fluid has been injected, the pump is stopped at time t3. This initial volume is less than or equal to the design volume. Valves 812 and 838 are closed, and gauge 813 measures pressure decay as the fracture continues to propagate and fluid in the fracture leaks off into the formation. A plot of pressure vs. some function of time during time interval t3–t4 (see, e.g., FIG. 16) is used to determine closure stress, which is taken as the least principal stress.

At time t4, valve 838 is opened to borehole pressure, then valve 812 is opened to allow fluid in the fracture to flow back into the borehole through flowline 202. The maximum fluid is returned when interval pressure equilibrates with borehole pressure. Flow-back is preferably through flow control module 122 to measure the volume of fluid returned. Once the fluid is all returned, gauge 813 will equilibrate to borehole pressure, at time t5.

The steps of time interval t1–t5 are repeated one or more times, beginning at time t6. Fracture re-opening pressure is indicated at time t7. During time interval t7–t8, a burst of acoustic emissions AE will be recorded if the volume injected in a re-pressurization cycle exceeds the maximum volume injected in the first cycle. The rate and volume of injection for each repetition may be different than for the initial cycle.

Fracture closure stress can also be determined by actively pumping back the injected fluid volume and monitoring interval pressure vs. time (see, e.g., FIG. 22, time interval t4–t5). Multiple cycles may be performed to determine fracture closure stress, pumping back the injected fluid at a different rate for each cycle. Whether the flow-back or the pump-back method is used, typically 3 to 5 cycles of closure stress measurement are conducted. In some cases it is desirable to conduct cycles in which the fracture size is progressively extended over different volumes of the formation. A break in the slope of the plot of pressure vs. f(t) during pump-back indicates fracture closure pressure, which is taken as least principal stress.

The minimum pump-back rate is dictated by the permeability of the formation. Rates greater than the minimum are chosen on a case by case basis to obtain sufficiently different fracture closure rates to give a good measure of closure pressure. Fracture closure rates depend in a complex way on the rheology of the formation (which can be indicated by the open-hole instrumented packer configurations described above), the ambient in-situ stress level, the fluid withdrawal rate and formation permeability. Fracture closure can be modeled but it cannot be accurately predicted downhole until rheology permeability etc. are known. A practical approach is simply to conduct tests over a range of rates which result in different fracture closure rates. Volume determines fracture size. This is why pump-back at different rates is desirable.

Figure 23:
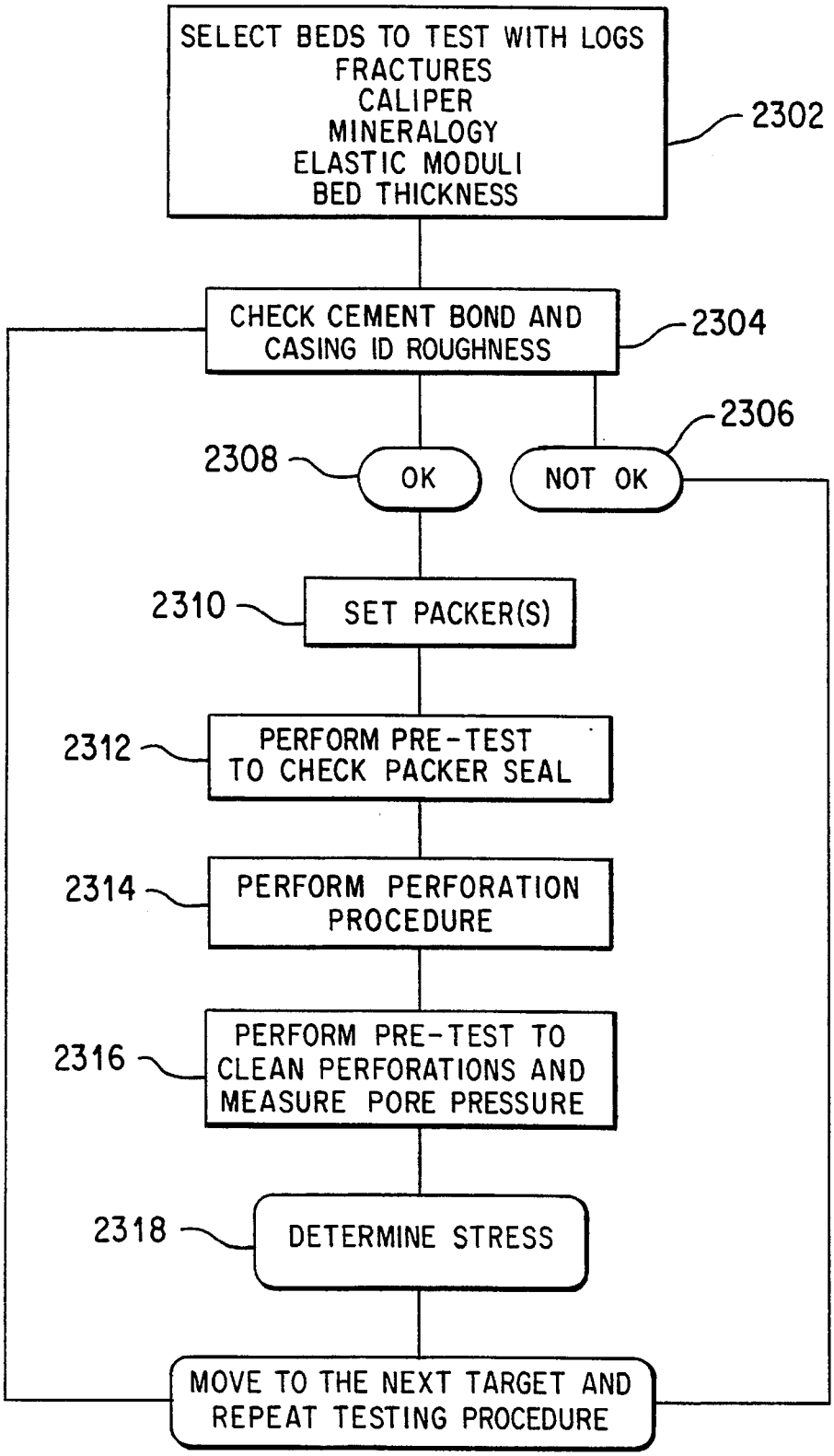
FIG. 23 illustrates an exemplary stress-testing sequence for the cased-hole embodiments of the sonde of FIG. 1 in accordance with the present invention.

FIG. 23 illustrates an exemplary stress-testing sequence using either the cased-hole sonde configuration described in Section C. or the cased-hole sonde configuration described in Section D. Beds to be tested are selected at step 2302 from existing data about the formation (e.g., from previous borehole logs), such as fractures, caliper readings, mineralogy, elastic moduli and bed thickness. Casing interior diameter roughness and cement bond are checked at step 2304 using suitable logs. If not OK (2306), the sonde is re-positioned. If OK (2308), the packer or packers are set (2310). A pre-test is performed in step 2312 to check packer sealing. The casing is then perforated, at step 2314. A pre-test is performed at step 2316 to clean perforation and measure port pressure. Stress is then determined at step 2318. After stress determination in the bed of interest, the sonde is moved to the next target bed for repetition of the testing procedure.

Fracture re-opening sequences may be performed using any fluid volume less than or equal to the volume corresponding to the maximum fracture diameter.

General Note Applicable to all Sonde Configurations

Bed of Interest, e.g., Mechanical Facies. A working definition of a Mechanical Facies (M) is massive sedimentary unit or an ensemble of finely bedded sedimentary units which has stress-strain and failure behavior distinct from other sedimentary sequences. Major differences in mechanical behavior (stress-strain and failure) are related to the average porosity and the average clay content of the sedimentary rock. Furthermore the mechanical behavior of a particular sedimentary rock (characterized by an average porosity and an average clay content) will depend on the effective confining pressure.

The elastic shear modulus or Young's modulus are important properties used to distinguish mechanical facies. For basin stress analysis, it is important to know if there is tectonic strain. The existence of tectonic strain can be recognized by analyzing stress measurements made in rocks with widely varying elastic moduli (FIG. 10). In formations with little variation in clay content the elastic moduli may provide the only physical basis for distinguishing mechanical facies. Even when clay content varies significantly (e.g. from 0% to >40% by volume of solid) significant differences in elastic modulus exist among similar M defined on the basis of clay content and porosity due to grain size and cementation differences.

The thickness of M and definition of thin beds is mainly dictated by typical well diameters and the vertical resolution of logs. Finely bedded (thin beds) means thickness <0.5 ft; when thickness is less than 6", conventional logs measure average bed properties.

Selecting a mechanical facies is a hierarchical process.

a. Determine range of mechanical facies (M) penetrated by a well based on mineralogy and acoustic logs porosity vs. clay content and shear modulus b. Determine thickness of each M (intersection of M and well)

c. Determine location and orientation of fractures intersecting, using borehole imaging.

d. Identify the M without any fractures.

e. Identify location of single fractures which can be isolated by the straddle packer.

f. Determine location of bad hole regions (using, e.g., the USIT caliper) where borehole rugosity would prevent packer sealing.

e. determine direction of Sh, azimuth of borehole breakouts (see, e.g., FIGS. 19A and 19B). In open hole applications this stress direction can be compared to stress direction determined from the strike hydraulic fractures. For example in a vertical well, the strike of vertical hydraulic fractures should be 90 degrees from the breakout azimuth (e.g., FIG. 19A). For slightly dipping fractures, the dip direction (e.g., the low part of the sinusoidal trace of hydrofracture in FIG. 19A), is in the direction of Sh.

Targets for hydrofracturing (configurations of sonde 100 described in Sections B, C and D):

a. identify M with thickness greater than or equal to about 3 m.

b. identify the subset of a. without fractures and without bad borehole conditions.

c. select as targets mechanical facies identified in b. which span the greatest range of clay content and elastic moduli.

Targets for sleeve fracturing or rheology testing (configurations of sonde 100 described in Sections A and B):

a. same as above but with M thickness greater than or equal to about 1.

Targets for fracture reopening:

a. identify M with thickness greater than or equal to about 3 m.

b. identify M containing a single fracture which can be isolated using the straddle packer (e.g., the entire fracture plane crosses the borehole in a vertical distance less than the spacing between the two packers). The straddle packer is set so that the fracture is located in the interval between the two packers.

c. target M identified in b. with the most diverse fracture orientations (Strikes and dips).

To determine the complete state of stress from fracture reopening, one needs a minimum of three and a maximum of nine suitably oriented fractures in a space of uniform stress. Since stress varies with lithology, the constraints of the method can best be met by testing fractures of different orientation in similar M. In so doing, an estimate of the stress tensor in that M is obtained. If one does not need to know the vertical stress or if it is known or if it is assumed that the vertical stress is a principal stress then only three vertical fractures of different strike are needed to determine the principal stress magnitudes and orientation in the horizontal plane. Other simplifications are also possible.

The preferred embodiments described above are not intended to be limiting, but are instead intended as merely illustrative of the present invention. Those of skill in the art will recognize that many modifications may be made in the disclosed embodiments without departing from the spirit and scope of the present invention as defined by the following claims.

We claim:

1. A system for obtaining measurements in a borehole from which in-situ stress of an underground formation can be estimated, wherein the system comprises a sonde and an electric wireline cable connected to the sonde for conveying the sonde in the borehole, and wherein the sonde comprises:

a) pressure-creating means producing hydraulic energy;

b) a stress/rheology module coupled to the pressure-creating means via a flow line and having an inflatable packer and a controllable valve coupled to the inflatable packer and to the flowline for establishing hydraulic communication between the inflatable packer and the flowline for receiving hydraulic energy therefrom and applying to the formation at a controlled rate a force opposing in-situ stress in the formation, pressure sensing means for monitoring a pressure related to the force applied to the formation by the inflatable packer, means for monitoring inflation fluid flow to the inflatable packer to determine inflation volume of the inflatable packer, and an acoustic sensor for detecting acoustic emissions in the borehole as the force is applied to the formation;

c) force reducing means coupled to the inflatable packer for controllably reducing the force applied to the formation; and d) a flow control means in hydraulic communication with the borehole for withdrawing formation fluid from the formation at a controlled rate for pressure draw-down pre-test and comprising a probe affixed to and movable relative to the sonde, an orienting module mechanically coupled to the probe for controllably positioning the probe at a selected rotational position around a longitudinal axis of the sonde, a controllable actuator mechanically coupled to the sonde and to the probe for applying the probe to the borehole wall, and a flow control module hydraulically coupled to the probe at constant pressure.

2. A system as claimed in claim 1, further comprising a hydraulic energy source located outside the borehole, and a tubing for conveying hydraulic energy from the source to the sonde for charging the stress/rheology module with hydraulic energy while the sonde is in the borehole.

3. A system as claimed in claim 1, wherein the force reducing means comprises a controllable flow-back valve coupled to the inflatable packer for releasing hydraulic energy therefrom at a controlled rate when the flow-back valve is opened.

4. A system as claimed in claim 1, wherein the force reducing means comprises a pump-out module, the pump-out module comprising a controllable pump assembly in hydraulic communication with the inflatable packer for pressurizing and depressurizing the packer.

5. A system as claimed in claim 1, wherein the stress/rheology module further comprises a plurality of displacement sensors attached to the sonde and disposed for detecting radial displacement of the borehole walls at multiple locations about a central axis of the sonde.

6. A system as claimed in claim 5, wherein the sonde further comprises an orientation module forming an integral part of the sonde and having sensors for detecting orientation of the sonde in the borehole relative to the earth's gravitational field and relative to the earth's magnetic field.

7. A system for obtaining measurements in a borehole from which in situ stress of an underground formation can be estimated, wherein the system comprises a sonde and an electric wireline cable connected to the sonde for conveying the sonde in the borehole, and wherein the sonde comprises:

a) an accumulator module having a reservoir for storing hydraulic fluid, a flow line, and a controllable valve coupled to the reservoir and to the flow line for controlling transfer of hydraulic fluid between the reservoir and the flow line;

b) a stress/rheology module coupled to the accumulator module and having force applying means coupled to the flow line for receiving hydraulic fluid from the flow line and applying to the formation at a controlled rate a force opposing in-situ stress in the formation wherein the force applying means comprises an inflatable packer and a controllable valve coupled to the inflatable packer and to the flowline for establishing hydraulic communication between the inflatable packer and the flowline, means for monitoring inflation fluid flow to the inflatable packer to determine inflation volume of the inflatable packer, and an acoustic sensor for detecting acoustic emissions in the borehole as the force is applied to the formation;

c) force reducing means coupled to the force applying means for controllably reducing the force applied to the formation; and d) a flow control means in hydraulic communication with the borehole for withdrawing formation fluid from the formation at a controlled rate for pressure draw-down pre-test, the flow control means comprising a probe affixed to and movable relative to the sonde, an orienting module mechanically coupled to the probe for controllably positioning the probe at a selected rotational position around a longitudinal axis of the sonde, a controllable actuator mechanically coupled to the sonde and to the probe for applying the probe to the borehole wall, and a flow control module hydraulically coupled to the probe to drawing fluid through the probe at constant pressure.

8. A system as claimed in claim 7, wherein the stress/rheology module further comprises a plurality of displacement sensors attached to the sonde and disposed for detecting radial displacement of the borehole walls at multiple locations about a central axis of the sonde.

9. A system as claimed in claim 8, wherein the sonde further comprises an orientation module forming an integral part of the sonde and having sensors for detecting orientation of the sonde in the borehole relative to the earth's gravitational field and relative to the earth's magnetic field.

10. A system as claimed in claim 7, further comprising a hydraulic fluid source located outside the borehole, and a tubing for conveying hydraulic fluid from the source to the sonde for charging the stress/rheology module with hydraulic fluid while the sonde is in the borehole.

11. A system as claimed in claim 7, wherein the force reducing means comprises a controllable flow-back valve coupled to the inflatable packer for releasing hydraulic energy therefrom at a controlled rate when the flow-back valve is opened.

* * * * *